US012181189B2

(12) United States Patent
Lingrey et al.

(10) Patent No.: US 12,181,189 B2
(45) Date of Patent: Dec. 31, 2024

(54) CEILING-MOUNTABLE HEAT PUMP SYSTEM

(71) Applicant: Climate Master, Inc., Oklahoma City, OK (US)

(72) Inventors: David J. Lingrey, Yukon, OK (US); Edward A. Wall, Oklahoma City, OK (US); Eric H. Albrecht, Oklahoma City, OK (US); Michael S. Privett, Tuttle, OK (US); Juan Antonio Espinosa Gonzalez, Oklahoma City, OK (US)

(73) Assignee: Climate Master, Inc., Oklahoma City, OK (US)

( * ) Notice: Subject to any disclaimer, the term of this patent is extended or adjusted under 35 U.S.C. 154(b) by 0 days.

(21) Appl. No.: 17/523,169

(22) Filed: Nov. 10, 2021

(65) Prior Publication Data

US 2023/0147346 A1 May 11, 2023

(51) Int. Cl.
*F24F 1/02* (2019.01)
*F24F 1/0047* (2019.01)
(Continued)

(52) U.S. Cl.
CPC ..... *F25B 30/02* (2013.01); *F24F 1/0047* (2019.02); *F24F 1/0063* (2019.02); *F24F 1/029* (2019.02);
(Continued)

(58) Field of Classification Search
CPC ..... F24F 1/0047; F24F 1/0063; F24F 13/20; F24F 1/029; F24F 1/03; F24F 1/0317;
(Continued)

(56) References Cited

U.S. PATENT DOCUMENTS 1,723,649 A * 8/1929 Heath ..... A47C 17/46 5/140
3,354,774 A * 11/1967 Smitzer ..... G03B 27/50 271/263
(Continued)

FOREIGN PATENT DOCUMENTS

AU 2013200092 B2 4/2013
CA 1178268 11/1984
(Continued)

OTHER PUBLICATIONS

"134-XS and 134-S Series Compressors ECOnomizer (EA-12-03-E)," 134-XS and 134-S series—Application and Maintenance Manual, Technical report EA1203E, RefComp Refrigerant Compressors, undated but believed to be publicly available at least as early as Mar. 2014 (4 pages).
(Continued)

*Primary Examiner* — Jerry-Daryl Fletcher
*Assistant Examiner* — Daniel C Comings
(74) *Attorney, Agent, or Firm* — Crowell & Moring LLP; Thomas E. Williams

(57) ABSTRACT

An example heat pump system includes a low-height cabinet configured to be mounted to a ceiling. The low-height cabinet includes a frame and a plurality of panels that define a compressor compartment, a blower compartment, and a plenum compartment. The frame includes one or more dividers that separate the blower compartment, the plenum compartment, and the compressor compartment from each other. The example heat pump system also includes a
(Continued)

compressor installed horizontally in the compressor compartment, a heat exchanger installed vertically in the compressor compartment, a blower assembly installed in the blower compartment, and an air coil installed in the blower compartment.

22 Claims, 54 Drawing Sheets

(51) Int. Cl.

| | |
|---|---|
| ***F24F 1/0063*** | (2019.01) |
| ***F24F 1/029*** | (2019.01) |
| ***F24F 1/03*** | (2019.01) |
| ***F24F 1/0317*** | (2019.01) |
| ***F24F 13/20*** | (2006.01) |
| ***F25B 30/02*** | (2006.01) |
| *F25B 13/00* | (2006.01) |

(52) U.S. Cl.
CPC ..... *F24F 1/0317* (2019.02); *F24F 13/20* (2013.01); *F24F 2221/14* (2013.01); *F25B 13/00* (2013.01)

(58) Field of Classification Search
CPC .. F24F 2013/202; F24F 221/14; F24F 221/36; F24F 2221/14; F24F 2221/36; F25B 13/00; F25B 30/02
See application file for complete search history.

(56) References Cited

U.S. PATENT DOCUMENTS 3,460,353 A 8/1969 Ogata et al.
3,916,638 A 11/1975 Schmidt
3,938,352 A 2/1976 Schmidt
4,072,187 A 2/1978 Lodge
4,091,636 A 5/1978 Margen
4,173,865 A 11/1979 Sawyer
4,179,894 A 12/1979 Hughes
4,257,239 A 3/1981 Partin et al.
4,299,098 A 11/1981 Derosier
4,399,664 A 8/1983 Derosier
4,441,901 A 4/1984 Endoh
4,476,920 A 10/1984 Drucker et al.
4,493,193 A 1/1985 Fisher
4,528,822 A 7/1985 Glamm
4,538,418 A 9/1985 Lawrence et al.
4,575,001 A 3/1986 Oskarsson et al.
4,584,844 A 4/1986 Lemal
4,592,206 A 6/1986 Yamazaki et al.
4,598,557 A 7/1986 Robinson et al.
4,645,908 A 2/1987 Jones
4,646,537 A 3/1987 Crawford
4,646,538 A 3/1987 Blackshaw et al.
4,685,307 A 8/1987 Jones
4,693,089 A 9/1987 Bourne et al.
4,698,978 A 10/1987 Jones
4,727,727 A 3/1988 Reedy
4,766,734 A 8/1988 Dudley
4,776,180 A 10/1988 Patton et al.
4,796,437 A 1/1989 James
4,798,059 A 1/1989 Morita
4,798,240 A 1/1989 Gerstmann et al.
4,799,363 A 1/1989 Nakamura
4,835,976 A 6/1989 Torrence
4,856,578 A 8/1989 McCahill
4,893,476 A 1/1990 Bos et al.
4,909,041 A 3/1990 Jones
4,909,312 A 3/1990 Biedenbach et al.
4,920,757 A 5/1990 Gazes et al.
4,924,681 A 5/1990 De Vit et al.
4,938,032 A 7/1990 Mudford
5,038,580 A 8/1991 Hart
5,044,425 A 9/1991 Tatsumi et al.
5,081,848 A 1/1992 Rawlings et al.
5,088,296 A 2/1992 Hamaoka
5,099,651 A 3/1992 Fischer
5,105,629 A 4/1992 Parris et al.
5,136,855 A 8/1992 Lenarduzzi
5,172,564 A 12/1992 Reedy
5,187,944 A 2/1993 Jarosch
5,224,357 A 7/1993 Galiyano et al.
5,239,838 A 8/1993 Tressler
5,269,153 A 12/1993 Cawley
5,305,822 A 4/1994 Kogetsu et al.
5,309,732 A 5/1994 Sami
5,323,844 A 6/1994 Sumitani et al.
5,339,890 A 8/1994 Rawlings
5,355,688 A 10/1994 Rafalovich et al.
5,372,016 A 12/1994 Rawlings
5,438,846 A 8/1995 Datta
5,461,876 A 10/1995 Dressler
5,463,619 A * 10/1995 van Steenbrugge ... H04B 1/205 370/357
5,465,588 A 11/1995 McCahill et al.
5,477,914 A 12/1995 Rawlings
5,497,629 A 3/1996 Rafalovich et al.
5,507,337 A 4/1996 Rafalovich et al.
5,533,355 A 7/1996 Rawlings
5,564,282 A 10/1996 Kaye
5,613,372 A 3/1997 Beal et al.
5,619,864 A 4/1997 Reedy
5,622,057 A 4/1997 Bussjager et al.
5,628,200 A 5/1997 Pendergrass
5,651,265 A 7/1997 Grenier
5,669,224 A 9/1997 Lenarduzzi
5,689,966 A 11/1997 Zess et al.
5,706,888 A 1/1998 Ambs et al.
5,729,985 A 3/1998 Yoshihara et al.
5,758,514 A 6/1998 Genung et al.
5,802,864 A 9/1998 Yarbrough et al.
5,927,088 A 7/1999 Shaw
5,937,665 A 8/1999 Kiessel et al.
5,953,926 A 9/1999 Dressler et al.
5,983,660 A 11/1999 Kiessel et al.
6,000,154 A * 12/1999 Berard ..... E02F 3/364 37/468
6,016,629 A * 1/2000 Sylvester ..... E05D 7/12 49/55
6,032,472 A 3/2000 Heinrichs et al.
6,070,423 A 6/2000 Hebert
6,082,125 A 7/2000 Savtchenko
6,123,147 A 9/2000 Pittman
6,149,066 A 11/2000 Perry et al.
6,167,715 B1 1/2001 Hebert
6,212,892 B1 4/2001 Rafalovich
6,227,003 B1 5/2001 Smolinsky
6,253,564 B1 7/2001 Yarbrough et al.
6,347,527 B1 2/2002 Bailey et al.
6,385,983 B1 5/2002 Sakki et al.
6,418,745 B1 7/2002 Ratliff
6,434,960 B1 8/2002 Rousseau
6,474,087 B1 11/2002 Lifson
6,536,221 B2 3/2003 James
6,615,602 B2 9/2003 Wilkinson
6,644,047 B2 11/2003 Taira et al.
6,655,164 B2 12/2003 Rogstam
6,662,864 B2 12/2003 Burk et al.
6,668,572 B1 12/2003 Seo et al.
6,694,750 B1 2/2004 Lifson et al.
6,729,151 B1 5/2004 Thompson
6,751,972 B1 6/2004 Jungwirth
6,804,975 B2 10/2004 Park
6,817,205 B1 11/2004 Lifson et al.
6,826,921 B1 12/2004 Uselton
6,857,285 B2 2/2005 Hebert
6,892,553 B1 5/2005 Lifson et al.
6,915,656 B2 7/2005 Ratliff
6,931,879 B1 8/2005 Wiggs
6,938,438 B2 9/2005 Lifson et al.
6,941,770 B1 9/2005 Taras et al.
7,000,423 B2 2/2006 Lifson et al.

(56) References Cited

U.S. PATENT DOCUMENTS 7,028,492 B2 4/2006 Taras et al.
7,059,151 B2 6/2006 Taras et al.
7,114,349 B2 10/2006 Lifson et al.
7,150,160 B2 12/2006 Herbert
7,155,922 B2 1/2007 Harmon et al.
7,185,505 B2 3/2007 Kamimura
RE39,597 E 5/2007 Rousseau
7,210,303 B2 5/2007 Zhang et al.
7,228,696 B2 6/2007 Ambs et al.
7,228,707 B2 6/2007 Lifson et al.
7,234,311 B2 6/2007 Lifson et al.
7,254,955 B2 8/2007 Otake et al.
7,263,848 B2 9/2007 Bhatti
7,272,948 B2 9/2007 Taras et al.
7,275,384 B2 10/2007 Taras et al.
7,275,385 B2 10/2007 Abel et al.
7,290,399 B2 11/2007 Taras et al.
7,325,414 B2 2/2008 Taras et al.
7,454,919 B2 11/2008 Ookoshi et al.
7,484,374 B2 2/2009 Pham et al.
7,617,697 B2 11/2009 McCaughan
7,654,104 B2 2/2010 Groll et al.
7,716,943 B2 5/2010 Seefeldt
7,752,855 B2 7/2010 Matsuoka et al.
7,770,405 B1 8/2010 Dillon
7,823,404 B2 11/2010 Hanson
7,845,190 B2 12/2010 Pearson
7,854,137 B2 12/2010 Lifson et al.
7,856,834 B2 12/2010 Haley
7,878,010 B2 2/2011 Nishimura et al.
7,913,501 B2 3/2011 Ellis et al.
7,937,960 B2 5/2011 Matsui
7,946,121 B2 5/2011 Yamaguchi et al.
7,954,333 B2 6/2011 Yoshimi
7,958,737 B2 6/2011 Lifson et al.
7,975,495 B2 7/2011 Voorhis et al.
7,975,506 B2 7/2011 James et al.
7,980,086 B2 7/2011 Kotani et al.
7,980,087 B2 7/2011 Anderson et al.
7,997,092 B2 8/2011 Lifson et al.
7,997,093 B2 8/2011 Kasahara
8,033,123 B2 10/2011 Kasahara et al.
8,037,713 B2 10/2011 Haley et al.
8,069,682 B2 12/2011 Yoshimi et al.
8,074,459 B2 12/2011 Murakami et al.
8,079,228 B2 12/2011 Lifson et al.
8,079,229 B2 12/2011 Lifson et al.
8,082,751 B2 12/2011 Wiggs
8,136,364 B2 3/2012 Lifson et al.
8,156,757 B2 4/2012 Doty et al.
8,191,376 B2 6/2012 Fox et al.
8,215,121 B2 7/2012 Yoshimi et al.
8,220,531 B2 7/2012 Murakami et al.
8,286,438 B2 10/2012 McCahill
8,381,538 B2 2/2013 Lifson et al.
8,397,522 B2 3/2013 Springer et al.
8,402,779 B2 3/2013 Nishimura et al.
8,418,482 B2 4/2013 Bush et al.
8,418,486 B2 4/2013 Taras et al.
8,424,326 B2 4/2013 Mitra et al.
8,459,052 B2 6/2013 Bush et al.
8,528,359 B2 9/2013 Lifson et al.
8,555,703 B2 10/2013 Yonemori et al.
8,561,425 B2 10/2013 Mitra et al.
8,650,893 B2 2/2014 Hanson
8,695,404 B2 4/2014 Kadle et al.
8,701,432 B1 4/2014 Olson
8,726,682 B1 5/2014 Olson
8,733,429 B2 5/2014 Harrison et al.
8,756,943 B2 6/2014 Chen et al.
8,769,982 B2 7/2014 Ignatiev et al.
8,910,419 B1 * 12/2014 Oberst ..... A01G 31/06 47/60
8,919,139 B2 12/2014 Yamada et al.
8,959,950 B2 2/2015 Doty et al.
8,984,903 B2 3/2015 Itoh et al.
9,052,125 B1 6/2015 Dostal
9,297,565 B2 3/2016 Hung
9,303,908 B2 4/2016 Kasahara
9,383,026 B2 7/2016 Eggleston
9,459,032 B2 10/2016 Nishimura et al.
9,551,514 B2 1/2017 Tartakovsky
9,562,700 B2 2/2017 Watanabe
9,599,377 B2 3/2017 Kato
9,625,195 B2 4/2017 Hiraki et al.
9,791,195 B2 10/2017 Okada et al.
9,797,611 B2 10/2017 Gault
9,909,785 B2 3/2018 Kato
9,909,792 B2 3/2018 Oya
9,920,960 B2 3/2018 Gerber et al.
10,072,856 B1 9/2018 Akin et al.
10,118,462 B2 11/2018 Kohigashi et al.
10,119,738 B2 11/2018 Hammond et al.
10,126,012 B2 11/2018 Ikawa et al.
10,132,511 B2 11/2018 Tartakovsky
10,151,663 B2 12/2018 Scancarello
10,234,164 B2 3/2019 Takeuchi et al.
10,345,004 B1 7/2019 Hern et al.
10,408,484 B2 9/2019 Honda et al.
10,465,961 B2 11/2019 Kujak
10,480,807 B2 11/2019 Goel et al.
10,488,065 B2 11/2019 Chen et al.
10,488,072 B2 11/2019 Yajima et al.
10,508,847 B2 12/2019 Yajima et al.
10,514,176 B2 12/2019 Weinert
10,527,310 B2 1/2020 Nagaoka et al.
10,670,282 B2 6/2020 Yamada et al.
10,677,679 B2 6/2020 Gupte et al.
10,684,052 B2 6/2020 Walser et al.
10,731,884 B2 8/2020 Blanton
10,753,631 B2 8/2020 Ikawa et al.
10,753,661 B2 8/2020 Hammond et al.
10,767,882 B2 9/2020 Kowald et al.
10,816,232 B2 10/2020 Crawford et al.
10,866,002 B2 12/2020 Taras et al.
10,866,004 B2 12/2020 Shiohama et al.
10,871,314 B2 12/2020 Taras et al.
10,914,482 B2 2/2021 Yamamoto et al.
10,928,092 B2 2/2021 Yajima et al.
10,935,260 B2 3/2021 Taras et al.
10,935,454 B2 3/2021 Kester
10,941,953 B2 3/2021 Goel et al.
10,996,131 B2 5/2021 Mcquade et al.
11,015,828 B2 5/2021 Sakae et al.
11,015,852 B2 5/2021 Sakae et al.
11,022,354 B2 6/2021 Yamada et al.
11,041,647 B2 6/2021 Weinert
11,041,666 B2 6/2021 Sakae et al.
11,060,746 B2 7/2021 Maddox et al.
11,060,775 B2 7/2021 Delgoshaei
11,079,149 B2 8/2021 Papas et al.
11,092,566 B2 8/2021 Chen et al.
11,098,915 B2 8/2021 Crawford
11,098,937 B2 8/2021 Uehara et al.
11,125,457 B1 9/2021 Alfano et al.
11,131,470 B2 9/2021 Minamida et al.
11,231,197 B2 1/2022 Mcquade et al.
11,248,816 B2 2/2022 Ikawa et al.
11,268,718 B2 3/2022 Minamida et al.
11,274,866 B2 3/2022 Yamada et al.
11,274,871 B2 3/2022 Sakae et al.
11,280,523 B2 3/2022 Sakae et al.
11,287,153 B2 3/2022 Delgoshaei
11,293,674 B2 4/2022 Yamada et al.
11,326,798 B2 5/2022 Green et al.
11,365,897 B2 6/2022 Blanton
11,408,624 B2 8/2022 Hovardas et al.
11,415,345 B2 8/2022 Yajima
11,428,435 B2 8/2022 Eskew et al.
11,441,803 B2 9/2022 Goel et al.
11,629,866 B2 4/2023 Blanton et al.
11,761,666 B2 9/2023 Atchison et al.
11,933,523 B2 3/2024 Snider et al.
11,965,672 B2 * 4/2024 Locke ..... F24F 3/153

(56) References Cited

U.S. PATENT DOCUMENTS

2002/0078705 A1* 6/2002 Schlosser ..... F25D 23/006 62/340
2003/0061822 A1 4/2003 Rafalovich
2003/0221436 A1 12/2003 Xu
2003/0221445 A1 12/2003 Smolinsky
2004/0140082 A1 7/2004 Hua
2005/0125083 A1 6/2005 Kiko
2006/0010908 A1 1/2006 Taras et al.
2006/0218949 A1 10/2006 Ellis et al.
2006/0225445 A1 10/2006 Lifson et al.
2007/0017243 A1 1/2007 Kidwell et al.
2007/0074536 A1 4/2007 Bai
2007/0146229 A1* 6/2007 Lin ..... H01Q 1/125 343/882
2007/0251256 A1 11/2007 Pham et al.
2007/0289319 A1 12/2007 Kim et al.
2007/0295477 A1 12/2007 Mueller et al.
2008/0016895 A1 1/2008 Kim et al.
2008/0041072 A1 2/2008 Seefeldt
2008/0173034 A1 7/2008 Shaw
2008/0196418 A1 8/2008 Lifson et al.
2008/0197206 A1 8/2008 Murakami et al.
2008/0209930 A1 9/2008 Taras et al.
2008/0256975 A1 10/2008 Lifson et al.
2008/0282718 A1 11/2008 Beagle
2008/0286118 A1 11/2008 Gu et al.
2008/0289795 A1 11/2008 Zhang et al.
2008/0296396 A1 12/2008 Corroy et al.
2008/0302113 A1 12/2008 Yin et al.
2008/0302118 A1 12/2008 Chen et al.
2008/0302129 A1 12/2008 Mosemann et al.
2008/0307813 A1 12/2008 Lifson et al.
2008/0309210 A1* 12/2008 Luisi ..... B29C 51/08 312/406.2
2009/0000611 A1 1/2009 Kaiser
2009/0031739 A1 2/2009 Kasahara et al.
2009/0044550 A1 2/2009 Nishimura et al.
2009/0095000 A1 4/2009 Yoshimi et al.
2009/0100849 A1 4/2009 Nishimura et al.
2009/0107656 A1 4/2009 Marois
2009/0208331 A1 8/2009 Haley et al.
2009/0294097 A1 12/2009 Rini et al.
2009/0314014 A1 12/2009 Ericsson
2009/0314017 A1 12/2009 Nishimura et al.
2010/0005821 A1 1/2010 McCahill
2010/0005831 A1 1/2010 Vaisman et al.
2010/0024470 A1 2/2010 Lifson et al.
2010/0038052 A1 2/2010 Johnson et al.
2010/0058781 A1 3/2010 Lifson et al.
2010/0064710 A1 3/2010 Slaughter
2010/0064722 A1 3/2010 Taras
2010/0077788 A1 4/2010 Lewis
2010/0114384 A1 5/2010 Maxwell
2010/0132399 A1 6/2010 Mitra et al.
2010/0199715 A1 8/2010 Lifson et al.
2010/0251750 A1 10/2010 Lifson et al.
2010/0281894 A1 11/2010 Huff
2010/0287969 A1 11/2010 Ueda et al.
2010/0326100 A1 12/2010 Taras et al.
2011/0023515 A1 2/2011 Kopko et al.
2011/0036119 A1 2/2011 Fujimoto et al.
2011/0041523 A1 2/2011 Taras et al.
2011/0061413 A1 3/2011 Setoguchi
2011/0079032 A1 4/2011 Taras et al.
2011/0088426 A1 4/2011 Lochtefeld
2011/0094248 A1 4/2011 Taras et al.
2011/0094259 A1 4/2011 Lifson et al.
2011/0107780 A1 5/2011 Yamaguchi et al.
2011/0132007 A1 6/2011 Weyna et al.
2011/0174014 A1 7/2011 Scarcella et al.
2011/0192176 A1 8/2011 Kim et al.
2011/0203299 A1 8/2011 Jing et al.
2011/0209490 A1 9/2011 Mijanovic et al.
2011/0259025 A1 10/2011 Noh et al.
2011/0289950 A1 12/2011 Kim et al.
2011/0289952 A1 12/2011 Kim et al.
2012/0011866 A1 1/2012 Scarcella et al.
2012/0067965 A1 3/2012 Rajasekaran et al.
2012/0103005 A1 5/2012 Kopko et al.
2012/0139491 A1* 6/2012 Eberhard ..... B60L 58/22 320/118
2012/0198867 A1 8/2012 Ng et al.
2012/0205077 A1 8/2012 Zinger et al.
2012/0247134 A1 10/2012 Gurin
2012/0291460 A1 11/2012 Aoyagi
2013/0014451 A1 1/2013 Russell et al.
2013/0031934 A1 2/2013 Huff et al.
2013/0092329 A1* 4/2013 Eastland ..... A47H 5/02 248/329
2013/0098085 A1 4/2013 Judge et al.
2013/0104574 A1 5/2013 Dempsey et al.
2013/0160985 A1 6/2013 Chen et al.
2013/0180266 A1 7/2013 Bois
2013/0186116 A1 7/2013 Sami
2013/0269378 A1 10/2013 Wong
2013/0305756 A1 11/2013 Gomes et al.
2014/0013782 A1 1/2014 Kopko et al.
2014/0013788 A1 1/2014 Kopko et al.
2014/0033753 A1 2/2014 Lu et al.
2014/0033755 A1 2/2014 Wong
2014/0053585 A1 2/2014 Huff
2014/0060101 A1 3/2014 Styles et al.
2014/0123689 A1 5/2014 Ellis et al.
2014/0245770 A1 9/2014 Chen et al.
2014/0260392 A1 9/2014 Hawkins et al.
2015/0052937 A1 2/2015 Hung
2015/0059373 A1 3/2015 Maiello et al.
2015/0068740 A1 3/2015 Broder
2015/0204586 A1 7/2015 Burg et al.
2015/0252653 A1 9/2015 Shelton
2015/0285539 A1 10/2015 Kopko
2015/0330689 A1 11/2015 Kato et al.
2015/0338139 A1 11/2015 Xu et al.
2016/0076950 A1 3/2016 Jacquet
2016/0238276 A1* 8/2016 Andrew ..... B01D 46/4263
2016/0265819 A1 9/2016 Durrani et al.
2017/0010029 A9 1/2017 Reytblat et al.
2017/0227250 A1 8/2017 Karamanos
2017/0336092 A1 11/2017 Ikawa et al.
2017/0370622 A1 12/2017 Shin et al.
2018/0010829 A1 1/2018 Taras et al.
2018/0128506 A1 5/2018 Taras et al.
2018/0313555 A1 11/2018 Henderson
2018/0328600 A1* 11/2018 Swanson ..... F25B 1/005
2018/0334794 A1* 11/2018 Janabi ..... E04B 1/34321
2019/0032981 A1 1/2019 Hammond et al.
2019/0170600 A1 6/2019 Tice et al.
2019/0170603 A1 6/2019 Gupte et al.
2019/0178509 A1 6/2019 Taras et al.
2019/0346158 A1* 11/2019 Kamada ..... F25C 5/182
2019/0351731 A1* 11/2019 Jeong ..... B60H 1/0055
2019/0353361 A1 11/2019 Attari
2020/0041187 A1* 2/2020 Huckaby ..... F25C 5/182
2020/0072510 A1 3/2020 Brown
2020/0263891 A1 8/2020 Noor et al.
2020/0355411 A1* 11/2020 Inoue ..... F28D 1/0417
2020/0378667 A1 12/2020 Hammond et al.
2021/0018234 A1 1/2021 Lingrey et al.
2021/0041115 A1* 2/2021 Yoshioka ..... F28D 1/053
2021/0071920 A1 3/2021 Yamada et al.
2021/0095872 A1 4/2021 Taras et al.
2021/0131696 A1 5/2021 She et al.
2021/0131706 A1 5/2021 Yamada et al.
2021/0131709 A1 5/2021 Taras et al.
2021/0180807 A1 6/2021 Taras et al.
2021/0207831 A1 7/2021 Lord et al.
2021/0231330 A1 7/2021 Stephens et al.
2021/0270501 A1 9/2021 Brown et al.
2021/0293418 A1* 9/2021 Fuse ..... F24F 13/20
2021/0293430 A1 9/2021 Yamada
2021/0293446 A1 9/2021 Fard
2021/0302051 A1 9/2021 Yamada et al.
2021/0318012 A1 10/2021 Yamada et al.
2021/0325081 A1 10/2021 Kagawa et al.

(56) References Cited

U.S. PATENT DOCUMENTS

| | | | | |
|---|---|---|---|---|
| 2021/0341170 | A1 | 11/2021 | Hikawa et al. | |
| 2021/0348820 | A1 | 11/2021 | Kobayashi et al. | |
| 2021/0356154 | A1 | 11/2021 | Kobayashi et al. | |
| 2022/0090833 | A1 | 3/2022 | Yajima | |
| 2022/0099346 | A1 | 3/2022 | Alfano et al. | |
| 2022/0128277 | A1 | 4/2022 | Fukuyama et al. | |
| 2022/0186989 | A1 | 6/2022 | Yamaguchi et al. | |
| 2022/0243939 | A1 | 8/2022 | Notaro et al. | |
| 2022/0243940 | A1 | 8/2022 | Notaro et al. | |
| 2022/0243952 | A1 | 8/2022 | Kojima | |
| 2022/0247846 | A1* | 8/2022 | Lim | G06F 1/1681 |
| 2022/0268492 | A1 | 8/2022 | Yajima | |
| 2022/0348052 | A1* | 11/2022 | Fox | B60H 1/245 |
| 2022/0380648 | A1* | 12/2022 | Kumakura | F25B 5/02 |
| 2023/0020557 | A1 | 1/2023 | Kaji et al. | |
| 2023/0052745 | A1 | 2/2023 | Kitagawa et al. | |
| 2023/0072254 | A1 | 3/2023 | Lamont et al. | |
| 2023/0094980 | A1 | 3/2023 | Birnkrant et al. | |
| 2023/0097829 | A1 | 3/2023 | Ohkubo et al. | |
| 2023/0097844 | A1 | 3/2023 | Birnkrant | |
| 2023/0106462 | A1 | 4/2023 | Hovardas et al. | |
| 2023/0160587 | A1 | 5/2023 | Delgoshaei et al. | |
| 2023/0184618 | A1 | 6/2023 | Gupte et al. | |
| 2023/0194137 | A1 | 6/2023 | Fan et al. | |
| 2023/0205237 | A1 | 6/2023 | Karamanos et al. | |
| 2023/0213252 | A1 | 7/2023 | Mcquade | |
| 2023/0213254 | A1 | 7/2023 | Ma | |
| 2023/0221025 | A1 | 7/2023 | Nakano et al. | |
| 2023/0221026 | A1 | 7/2023 | Blanton | |
| 2023/0235907 | A1 | 7/2023 | Dewald et al. | |
| 2023/0243534 | A1 | 8/2023 | Song et al. | |
| 2023/0243539 | A1 | 8/2023 | Buda | |
| 2023/0250981 | A1 | 8/2023 | Notaro et al. | |
| 2023/0266026 | A1 | 8/2023 | Notaro et al. | |
| 2024/0003584 | A1 | 1/2024 | Willhite et al. | |

FOREIGN PATENT DOCUMENTS

| | | | | |
|---|---|---|---|---|
| CN | 1987397 | A | 6/2007 | |
| CN | 201944952 | U | 8/2011 | |
| CN | 102353126 | A | 2/2012 | |
| CN | 203231582 | U | 10/2013 | |
| CN | 103471275 | A | 12/2013 | |
| CN | 203396155 | U | 1/2014 | |
| CN | 203432025 | U | 2/2014 | |
| CN | 115435444 | A | 12/2022 | |
| CN | 115468229 | A | 12/2022 | |
| CN | 115493250 | A | 12/2022 | |
| CN | 115523604 | A | 12/2022 | |
| CN | 115638523 | A | 1/2023 | |
| CN | 115711454 | A | 2/2023 | |
| CN | 218511135 | U | 2/2023 | |
| CN | 115751508 | A | 3/2023 | |
| CN | 115751603 | A | 3/2023 | |
| CN | 115854484 | A | 3/2023 | |
| CN | 115854488 | A | 3/2023 | |
| CN | 218672483 | U | 3/2023 | |
| CN | 115930357 | A | 4/2023 | |
| CN | 115978709 | A | 4/2023 | |
| CN | 115978710 | A | 4/2023 | |
| CN | 116007066 | A | 4/2023 | |
| CN | 116025999 | A | 4/2023 | |
| CN | 218915295 | U | 4/2023 | |
| CN | 116085938 | A | 5/2023 | |
| CN | 116085939 | A | 5/2023 | |
| CN | 116123663 | A | 5/2023 | |
| CN | 116221902 | A | 6/2023 | |
| CN | 116241979 | A | 6/2023 | |
| CN | 116242010 | A | 6/2023 | |
| CN | 116294062 | A | 6/2023 | |
| CN | 116294111 | A | 6/2023 | |
| CN | 116336607 | A | 6/2023 | |
| CN | 219415010 | U | 7/2023 | |
| CN | 116538638 | A | 8/2023 | |
| CN | 116558042 | A | 8/2023 | |
| CN | 116608539 | A | 8/2023 | |
| CN | 219693510 | U | 9/2023 | |
| DE | 102007050446 | A1 | 4/2009 | |
| DE | 202022106612 | U1 | 3/2023 | |
| EP | 134015 | | 3/1985 | |
| EP | 1736720 | A2 | 12/2006 | |
| EP | 1983275 | A1 | 10/2008 | |
| EP | 2108897 | B1 * | 6/2017 | F24F 1/0007 |
| EP | 3358279 | B1 | 6/2020 | |
| EP | 3447403 | B1 | 6/2021 | |
| EP | 4036486 | A1 | 8/2022 | |
| EP | 4180727 | A1 | 5/2023 | |
| EP | 4194769 | A1 | 6/2023 | |
| ES | 2946857 | A1 | 7/2023 | |
| IN | 201917005053 | A | 4/2019 | |
| IN | 201917012216 | A | 7/2019 | |
| IN | 201917018373 | A | 7/2019 | |
| IN | 202117017393 | A | 1/2022 | |
| IN | 202117017768 | A | 1/2022 | |
| IN | 202117018393 | A | 1/2022 | |
| IN | 202118001637 | A | 1/2022 | |
| JP | 2000046417 | | 2/2000 | |
| JP | 2000274786 | | 10/2000 | |
| JP | 2000314563 | | 11/2000 | |
| JP | 2001248931 | | 9/2001 | |
| JP | 3610812 | B2 | 1/2005 | |
| JP | 3744330 | B2 | 2/2006 | |
| JP | 2010101515 | A | 5/2010 | |
| JP | 2010101606 | A | 5/2010 | |
| JP | 2010133601 | A | 6/2010 | |
| JP | 2010230181 | A | 10/2010 | |
| JP | 2015094574 | A | 5/2015 | |
| JP | 2015175531 | A | 10/2015 | |
| JP | 2017075760 | A | 4/2017 | |
| JP | 2020051737 | A | 4/2020 | |
| JP | 2021103053 | A | 7/2021 | |
| JP | 2022039608 | A | 3/2022 | |
| JP | 2022176373 | A | 11/2022 | |
| JP | 2023025165 | A | 2/2023 | |
| JP | 2023060225 | A | 4/2023 | |
| JP | 2023076482 | A | 6/2023 | |
| JP | 2023116473 | A | 8/2023 | |
| KR | 100963221 | B1 | 6/2010 | |
| KR | 20190090972 | A | 8/2019 | |
| KR | 102551281 | B1 | 7/2023 | |
| KR | 102551284 | B1 | 7/2023 | |
| KR | 102551286 | B1 | 7/2023 | |
| KR | 102569930 | B1 | 8/2023 | |
| WO | 9600370 | | 1/1996 | |
| WO | 2001/90663 | | 11/2001 | |
| WO | 2006/033782 | | 3/2006 | |
| WO | 2007007576 | A1 | 1/2007 | |
| WO | 2008/045086 | | 4/2008 | |
| WO | 2008/048252 | | 4/2008 | |
| WO | 2010/005918 | | 1/2010 | |
| WO | 2010004716 | A1 | 1/2010 | |
| WO | 2010/054498 | | 5/2010 | |
| WO | 2010/104709 | | 9/2010 | |
| WO | 2013/142760 | | 9/2013 | |
| WO | 2014/031559 | A1 | 2/2014 | |
| WO | 2014/031708 | A1 | 2/2014 | |
| WO | 2016158092 | A1 | 10/2016 | |
| WO | 2016159152 | A1 | 10/2016 | |
| WO | 2017138820 | A1 | 8/2017 | |
| WO | 2018135850 | A1 | 7/2018 | |
| WO | 2020067039 | A1 | 4/2020 | |
| WO | 2020158653 | A1 | 8/2020 | |
| WO | 2020179826 | A1 | 9/2020 | |
| WO | 2021050617 | A1 | 3/2021 | |
| WO | 2021050618 | A1 | 3/2021 | |
| WO | 2021050886 | A1 | 3/2021 | |
| WO | 2021054199 | A1 | 3/2021 | |
| WO | 2021106957 | A1 | 6/2021 | |
| WO | 2021125354 | A1 | 6/2021 | |
| WO | 2021172516 | A1 | 9/2021 | |
| WO | 2021215528 | A1 | 10/2021 | |
| WO | 2021234857 | A1 | 11/2021 | |
| WO | 2022064784 | A1 | 3/2022 | |
| WO | 2022168305 | A1 | 8/2022 | |

(56) References Cited

FOREIGN PATENT DOCUMENTS

| | | | |
|---|---|---|---|
| WO | 2023059724 | A1 | 4/2023 |
| WO | 2023069273 | A1 | 4/2023 |
| WO | 2023084127 | A1 | 5/2023 |
| WO | 2023127329 | A1 | 7/2023 |
| WO | 2023127345 | A1 | 7/2023 |
| WO | 2023140145 | A1 | 7/2023 |
| WO | 2023157565 | A1 | 8/2023 |
| WO | 2023157568 | A1 | 8/2023 |
| WO | 2023161248 | A1 | 8/2023 |
| WO | 2023161249 | A1 | 8/2023 |

OTHER PUBLICATIONS

"Economized Vapor Injection (EVI) Compressors," Emerson Climate Technologies Application Engineering Bulletin AE4-1327 R2, Revised Sep. 2006 (9 pages).
"Enhanced Vapour Injection (EVI) for ZH*KVE Scroll Compressors," Emerson Climate Technologies—Technical Information, C7.4.3/1107-0512/E, May 2012 (10 pages).
"Heat Pump Mechanics" http://www.geo4va.vt.edu/A3/A3.htm#A3sec3c (Accessed Apr. 20, 2011) (19 pages).
"Heat pumps in residential and commercial buildings" http://www.heatpumpcentre.org/en/aboutheatpumps/heatpumpsinresidential/Sidor/default.aspx (Accessed Apr. 20, 2011) (2 pages).
B.P. Rasmussen et al., "Model-Driven System Identification of Transcritical Vapor Compression Systems," IEEE Transactions on Control Systems Technology, May 2005, pp. 444-451, vol. 13 (8 pages).
Ekaterina Vi Nogradova, "Economizers in Chiller Systems," Bachelor's Thesis, Mikkelin Ammattikorkeakoulu, Nov. 2012 (50 pages).
Haraldsson et al., "Measurement of Performance and Evaluation of a Heat Pump—with Scroll Compressor EVI and Economizer," Lunds Institute of Technology, 2006 (4 pages).
Honeywell, VFF1, VFF2, VFF3, VFF6 Resilient Seat Butterfly Valves with Flanged Connections Jan. 2013, p. 1, 1st col. last paragraph. (Year: 2013) (20 pages).
International Preliminary Report on Patentability issued in International Application No. PCT/US2013/033433 on Sep. 23, 2014 (7 Pages).
International Search Report and Written Opinion issued in International Application No. PCT/US2013/033433 on Aug. 9, 2013 (11 Pages).
John P. Elson et al., "Scroll Technology: An Overview of Past, Present and Future Developments," International Compressor Engineering Conference, 2008, Paper 1871 (9 pages).
Korean Intellectual Property Office, International Search Report in International Application No. PCT/US2009/049734 (Jan. 20, 2010) (2 pages).
Korean Intellectual Property Office, International Search Report in International Application No. PCT/US2010/026010 (Sep. 28, 2010) (2 pages).
Lund et al., "Geothermal (Ground-Source Heat Pumps—A World Overview," GHC Bulletin, Sep. 2004 (edited and updated version of the article from Renewal Energy World, (Jul.-Aug. 2003), vol. 6 No. 4) (10 pages).
Michael F. Taras, "Reheat Which Concept is Best," Ashrae Journal: 35-40 (Dec. 2004) (7 pages).
Murphy et al., "Air-Source Integrated Heat Pump for Net-Zero-Energy Houses Technology Status Report," *Oak Ridge National Laboratory*, ORNL-TM-2007-112 (Jul. 2007) (93 pages).
Murphy et al., "Ground-Source Integrated Heat Pump for Net-Zero-Energy Houses Technology Status Report," *Oak Ridge National Laboratory*, ORNL-TM-2007-177 (Dec. 2007) (78 pages).
Third Party Submission dated Nov. 10, 2014 filed in U.S. Appl. No. 13/848,342 (13 Pages).
Tolga N. Aynur, "Variable Refrigerant Flow Systems: A Review, Energy and Buildings," Jan. 2010, pp. 1106-1112, vol. 42 (7 pages).
Wei Yang et al., "The Design Method of U-Bend Geothermal Heat Exchanger of DX-GCHP in Cooling Model," IEEE, 2011, pp. 3635-3637 (English Abstract) (3 pages).
Amir Rafati et al., "Fault Detection and Efficiency Assessment for HVAC Systems Using Non-Intrusive Load Monitoring: A Review," Energies 15.1 (2022): 341. (16 pages).
Milan Jain et al., "Beyond control: Enabling smart thermostats for leakage detection," Proceedings of the ACM on Interactive, Mobile, Wearable and Ubiquitous Technologies 3.1 (2019): 1-21. (21 pages).
Shen Tian, et al., "A study on a real-time leak detection method for pressurized liquid refrigerant pipeline based on pressure and flow rate," Applied Thermal Engineering 95 (2016): 462-470. (17 pages).
J. Navarro-Esbri et al., "A vapour compression chiller fault detection technique based on adaptative algorithms. Application to online refrigerant leakage detection," International Journal of Refrigeration 29.5 (2006): 716-723. (8 pages).
Animesh Pal et al., "Environmental Assessment and Characteristics of Next Generation Refrigerants," Kyushu University Institutional Repository, (2018): 58-66. (10 pages).
Matthew Wiggins, Ph.D et al., "HVAC Fault Detection," ASHRAE Journal 54.2 (2012): 78-80. (3 pages).
Shunsuke Kimura, "Development of a Remote Refrigerant Leakage Detection System for VRFs and Chillers," Purdue University—International Refrigeration and Air Conditioning Conference Paper 2304, 2022. (10 pages).
Rohit Chintala et al., "Automated fault detection of residential air-conditioning systems using thermostat drive cycles," Energy and Buildings 236 (2021): 110691. (28 pages).
Xudong Wang et al., "A2L Refrigerants Leaks and Ignitions Testing under Whole Room Scale," Purdue University—International Refrigeration and Air Conditioning Conference Paper 1849, 2018. (11 pages).
International Preliminary Report on Patentability mailed Sep. 9, 2022 for PCT Application No. PCT/US2021/020017 (7 pages).
International Search Report and Written Opinion mailed May 19, 2021 for PCT Application No. PCT/US2021/020017 (7 pages).
Taras, Michael F., "Comparison of Reheat Strategies for Constant Volume Rooftop Units", Carrier Corporation, Mar. 2008, 10p.
Baldini, Luca et al., "Decentralized cooling and dehumidification with a 3 stage LowEx heat exchanger for free reheating", Elsevier, Energy and Buildings, v76, Jun. 2014, pp. 270-277.
Bobelin, Damien et al., "Experimental Results of a Newly Developed Very High Temperature Industrial Heat Pump (140C) Equipped with Scroll Compressors and Workng With a New Bland Refrigerant", Purdue University, Purdufe e-Pubs, International Refrigeration and Air Conditioning Conference, School of Mechanical Engineering, 2012, 11p.
Han, Xing et al., "A novel system of the isothermal dehumidification in a room air-conditioner", Elsevier, Energy and Buildings, v57, 2013, pp. 14-19.
Mayhew, Baldwin, "Dehumidification using CHW Return Based Reheat", Decarb Healthcare, A Guidebook for Decarbonizing Healthcare, Sep. 30, 2023, 60p.
Johnson Controls, "Premier 25 Ton to 80 Ton Rooftop Units R-410A Start-Up and Operation Guide", Form No. 5881421-JSG-A-02222, issued Feb. 2, 2022, 170p.

* cited by examiner

CEILING-MOUNTABLE HEAT PUMP SYSTEM

TECHNICAL FIELD

The instant disclosure relates generally to heat pumps and, more particularly but without limitation, to heat pump systems for commercial and multi-unit residential applications.

BACKGROUND

Typically, heating, ventilation, and air conditioning (HVAC) systems provide comfortable air temperatures and/or improved air quality for occupants within a building or structure. Multiple HVAC systems are typically required for use in connection with commercial and multi-unit residential buildings. For instance, a multi-level building, such as a high rise building, may include a separate HVAC system for each of a plurality of housing units within the building. Oftentimes, those HVAC systems consume a relatively large amount of physical space and are arranged in a manner that are difficult to service.

For instance, one type of HVAC system for residential high rise buildings incorporates a floor-mounted vertical heat pump that is housed within a dedicated closet of a respective residential unit. The closet may consume an undesirable amount of valuable floor space within the unit and/or make it difficult for a service provider to access the heat pump for servicing.

Another type of HVAC system for residential high rise buildings is a split system. Such a system may have a condensing unit that is installed along a floor or wall of a unit and a fan coil unit that is installed to hang from a ceiling of the unit to limit the amount of floor space consumed by the HVAC system. However, the condensing unit may still require an undesirable amount of floor space within the unit. The height of the fan coil unit may require the ceiling of the floor to be lowered or cause the height of each floor to be increased, thereby consuming valuable vertical space within the corresponding building and requiring additional building materials to enclose the heat pump system. Additionally, the arrangement of the fan coil unit suspended from the ceiling may make it difficult for a service provider to access and service internal components of the fan coil unit.

Customers of HVAC systems, and particularly heat pump systems for residential high rise buildings, hotel rooms, and the like, want the smallest HVAC system possible at the lowest cost while delivering equal or better performance than predecessor systems. A challenge exists, however, to reduce the height of known systems while also being capable of delivering equal or better heating and cooling performance than predecessor systems. Consequently, there exists a need for an apparatus that solves these and other problems.

SUMMARY

Disclosed are various embodiments of a low-height heat pump system and methods of assembling the same.

One embodiment of the instant disclosure includes a heat pump system that includes a low-height cabinet configured to be mounted to a ceiling. The low-height cabinet includes a frame and a plurality of panels that define a compressor compartment, a blower compartment, and a plenum compartment. The frame includes one or more dividers that separate the blower compartment, the plenum compartment, and the compressor compartment from each other. The heat pump system also includes a compressor installed horizontally in the compressor compartment, a heat exchanger installed vertically in the compressor compartment, a blower assembly installed in the blower compartment, and an air coil installed in the blower compartment.

The frame of the heat pump system may include side rails, end rails, cross rails, side panels, end panels, bottom panels, and a top panel.

The frame of the heat pump system may include a first divider that separates the blower compartment from the plenum compartment.

Further, the frame of the heat pump system may include a second divider that separates the compressor compartment from the blower compartment and the plenum compartment.

The frame of the heat pump system may include an end panel and a side panel that partially form the plenum compartment. Each of the end panel and the side panel includes one or more knockout panels that are removable to enable ductwork to fluidly connect to the plenum compartment.

The plurality of panels of the heat pump system may include a first bottom panel that partially forms the blower compartment and is detachable from the frame to facilitate a technician in accessing the blower compartment from below the low-height cabinet when the low-height cabinet is mounted to the ceiling.

Further, the heat pump system may include a drain pan that is installed below the air coil in the blower compartment. The drain pan is configured to be removable from the blower compartment when the low-height cabinet is mounted to the ceiling.

Further, the blower assembly may include a blower panel, one or more blowers, and a blower motor. The one or more blowers and the blower motor are mounted to the blower panel.

Also the blower assembly may include slider brackets to which the blower panel is slidably mounted. The blower panel is configured to be slidably lowered at least partially out of the blower compartment when the first bottom panel is detached from the frame to facilitate the technician in accessing the one or more blowers and the blower motor from below the low-height cabinet when the low-height cabinet is mounted to the ceiling.

Additionally, the blower assembly may include a latch coupled to the blower panel. The latch is configured to engage the frame to secure the blower assembly in a retracted position in the blower compartment. The latch is configured to disengage from the frame to enable the blower assembly to lower into an extended position.

Moreover, the latch may be a spring-loaded latch.

The plurality of panels of the heat pump system may include an end panel, a plurality of side panels, and a plurality of bottom panels that partially form the compressor compartment. Each of the end panel, the plurality of side panels, and the plurality of bottom panels is detachable from the frame to facilitate a technician in accessing the compressor compartment when the low-height cabinet is mounted to the ceiling.

The air coil may be sized to fit in a low height of the low-height cabinet and provide heat exchange capable of controlling a temperature of a space The heat exchanger of the heat pump system may be a brazed-plate heat exchanger that lies upright within a low height of the low-height cabinet and provide heat exchange capable of controlling a temperature of a space.

Further, the compressor of the heat pump system may be a horizontal rotary compressor installed horizontally in the compressor compartment to enable the compressor to fit in a low height of the low-height cabinet.

The low-height cabinet of the heat pump system may include a control panel, an electronics housing, and a cover panel. The electronics housing and the cover panel partially define an electronics compartment of the low-height cabinet. The control panel is coupled to the cover panel.

Further, the cover panel may include a pin and the electronics housing may define a curved slot configured to receive the pin. The pin is configured to slide in the curved slot to enable the control panel to be rotated from a first position at which the control panel is oriented to be accessed horizontally and a second position at which the control panel is oriented to be accessed horizontally from below the low-height control panel.

Further, the heat pump system may include a disconnect switchbox that includes switch extending outward from a bottom side of the low-height cabinet to enable a technician to engage the switch before accessing an interior of the low-height cabinet.

The plurality of panels of the heat pump system may include a top panel extending along a top side of the low-height cabinet. The top includes opposing flanges. Each of the opposing flanges defines mount holes such that one of the mount holes is located at each corner of the top panel.

Further, the heat pump system may include a plurality of grommet assemblies configured to provide low-height hanger mounts for the low-height cabinet. Each of the plurality of grommet assemblies are configured to extend through a respective one of the mount holes and couple to a corresponding one of the opposing flanges to mount the low-height cabinet to respective hanger rods.

The low-height cabinet of the heat pump system may have a height of about 9 inches.

In another embodiment of the instant disclosure, a heat pump system includes a low-height cabinet configured to be mounted to a ceiling. The low-height cabinet includes a frame and a plurality of panels that define a compressor compartment, a blower compartment, and a plenum compartment. The frame includes one or more dividers that separate the blower compartment, the plenum compartment, and the compressor compartment from each other. The heat pump system also includes a horizontal rotary compressor positioned horizontally in the compressor compartment to enable the compressor to fit in a low height of the low-height cabinet. The heat pump system also includes a brazed-plate heat exchanger positioned in the compressor compartment of the low-height cabinet. The brazed-plate heat exchanger lies upright within the low height of the low-height cabinet and provides heat exchange capable of controlling a temperature of a space. The heat pump system also includes a blower assembly positioned in the blower compartment and an air coil positioned in the blower compartment. The air coil has a height and a length where the height is configured to lie within the low height of the low-height cabinet and the length is longer than the height.

In another embodiment, a method for assembling a heat pump system with a low-height cabinet includes assembling a base of a frame together in an upside-down orientation by attaching a plurality of rails together. The plurality of rails includes side rails, end rails, and cross rails. The method also includes attaching a plurality of bottom panels to the base of the frame when the base of the frame is in the upside-down orientation and repositioning the base of the frame and the plurality of bottom panels in a right-side up orientation to enable subsequent assembly of the heat pump system in the right-side up orientation. The method also includes attaching a plurality of dividers of the frame to the base of the frame to form and separate a plenum compartment a blower compartment, and a compressor compartment in the low-height cabinet. The method also includes installing a compressor horizontally in the compressor compartment of the low-height cabinet, installing a heat exchanger installed in the compressor compartment of the low-height cabinet, installing a blower assembly in the blower compartment of the low-height cabinet, and installing an air coil in the blower compartment of the low-height cabinet.

The method may also include attaching compressor cross rails to the base of the frame when the frame is in the right-side up orientation.

Further, the method may also include installing the compressor in the compressor compartment includes attaching the compressor to the compressor cross rails.

The compressor may be installed horizontally in the compressor compartment is a horizontal rotary compressor.

Installing the heat exchanger in the compressor compartment may include attaching the heat exchanger to the frame.

The heat exchanger installed vertically in the compressor compartment may be a brazed-plate heat exchanger.

The method may also include attaching an expansion valve and a filter drier to the heat exchanger.

Further, the method may also include connecting refrigerant piping and a reversing valve to the heat exchanger, the expansion valve, and the filter drier.

Also, the method may also include connecting additional refrigerant piping to and between the air coil and the expansion valve.

The method may also include, when the base of the frame is in the upside-down orientation, attaching a drain pan to the base of the frame in the blower compartment.

Further, the method may also include installing the air coil in the blower compartment includes positioning the air coil above the drain pan and attaching the air coil to the frame.

The method may also include comprising attaching an electronics housing to the base of the frame to form an electronics compartment of the low-height cabinet.

Further, the method may also include rotatably and slidably coupling a cover panel to the electronics housing by positioning a pin of the cover panel in a curved slot defined the electronics housing. A control panel is coupled to the cover panel.

The method may also include attaching a disconnect switchbox to an inner surface of a first bottom panel of the plurality of bottom panels. The first bottom panel defines an opening through which a switch of the disconnect switchbox is to extend.

Installing the blower assembly in the blower compartment may include vertically attaching a set of slider brackets of the blower assembly to the frame of the low-height cabinet in the blower compartment and slidably mounting a blower panel of the blower assembly to the set of slider brackets, wherein one or more blowers and a blower motor are attached to the blower panel.

The method may include attaching one or more corner posts to the base of the frame.

Further, the method may include connecting an inlet water leg to and between an inlet port of the heat exchanger and an inlet opening defined by a first corner post of the one or more corner posts and connecting an outlet water leg to and between an outlet port of the heat exchanger and an outlet opening defined by the first corner post.

Further, the method may include attaching one or more discharge panels to the frame adjacent the plenum compartment. Each of the one or more discharge panels includes one or more knockout panels that are removable to enable ductwork to be fluidly connected to the plenum compartment.

Further, the method may include attaching a top panel to at least one of the one or more posts or the plurality of dividers of the frame. The top panel includes flanges configured to provide low-height hanger mounts for the low-height cabinet.

Further, the method may include attaching a plurality of side and end panels to the frame to enclose the blower compartment and the compressor compartment.

In another embodiment, a freeze-protection system for a heat pump includes a refrigerant circuit including a first circuit portion, a second circuit portion, a third circuit portion, a fourth circuit portion, a fifth circuit portion, and a sixth portion. The freeze-protection system also includes a reversing valve that includes a first reversing port connected to the fifth circuit portion, a second reversing port connected to the second circuit portion, a third reversing port connected to the sixth circuit portion, and a fourth reversing port connected to the first circuit portion. The freeze-protection system also includes a source heat exchanger that includes an inlet port configured to receive water from a source, an outlet port configured to return the water to the source, a third source port connected to the second circuit portion, and a fourth source port connected to the third circuit portion. The freeze-protection system also includes a compressor connected to the sixth circuit portion and the first circuit portion between the third reversing port and the fourth reversing port, a load heat exchanger connected to the fourth circuit portion and the fifth circuit portion between the fourth source port and the first reversing port, a thermostat, and a controller. The controller is configured to receive a signal from the thermostat to run the compressor, monitor for a low flow rate event and a low temperature event in response to receiving the signal from the thermostat, and set the heat pump in a lockout mode to prevent the compressor from running in response to detecting at least one of the low flow rate event or the low temperature event.

The controller of the freeze-protection system may be configured to run the compressor in response to not detecting both the low flow rate event and the low temperature event.

The controller of the freeze-protection system may be configured to monitor for the low flow rate event and the low temperature event simultaneously.

The freeze-protection system may further include a flow switch positioned adjacent the outlet port of the source heat exchanger. The flow switch is configured to monitor a water flow rate of the water returning to the source.

To monitor for the low flow rate event, the controller may be configured to determine whether a monitored flow rate of the water returning to the source has been less than a predefined flow rate threshold continuously for at least a first predefined duration.

Further, in response to determining that the monitored flow rate has been less than the predefined flow rate threshold continuously for at least the first predefined duration, the controller may be configured to disable the compressor and determine whether the monitored flow rate has been less than the predefined flow rate threshold continuously for at least a second predefined duration. The second predefined duration is greater than the first predefined duration.

Also, the controller of the freeze-protection system may be configured to detect the low flow rate event in response to determining that the monitored flow rate has been less than the predefined flow rate threshold continuously for at least the second predefined duration.

Additionally, in response to detecting the low flow rate event, the controller of the freeze-protection system may be configured to disable a water pump or a motorized water valve fluidly connected to the inlet port of the source heat exchanger.

Upon detecting the low flow rate event, the controller may be configured to remove the heat pump from the lockout mode in response to identifying that power for the heat pump has been cycled and a monitored flow rate of the water returning to the source has increased to be greater than a predefined flow rate threshold.

The freeze-protection system may also include an expansion valve connected to the third circuit portion and the fourth circuit portion between the fourth source port and the load heat exchanger.

Further, the freeze-protection system may also include a first temperature sensor positioned adjacent the inlet port of the source heat exchanger and configured to collect a water temperature measurement of the water flowing from the source and a second temperature sensor positioned along the third circuit portion and configured to collect a refrigerant temperature measurement of refrigerant flowing between the source heat exchanger and the expansion valve.

Also, the controller may be configured to detect the low temperature event in response to detecting that the water temperature measurement is less than a first predetermined temperature threshold and detecting that the refrigerant temperature measurement is less than a second predetermined temperature threshold.

Additionally, in response to detecting the low temperature event, the controller may be configured to disable a water pump or a motorized water valve fluidly connected to the inlet port of the source heat exchanger.

Upon detecting the low temperature event, the controller may be configured to remove the heat pump from the lockout mode in response to identifying that power for the heat pump has been cycled.

In another embodiment, a freeze-protection method for a heat pump includes receiving, via a controller, a signal from a thermostat to run a compressor and monitoring, via the controller, for a low flow rate event in response to receiving the signal from the thermostat. The freeze-protection method also includes monitoring, via the controller, for a low temperature event in response to receiving the signal from the thermostat and setting, via the controller, the heat pump in a lockout mode to prevent the compressor from running in response to detecting at least one of the low flow rate event or the low temperature event.

The freeze-protection method may include running the compressor in response to not detecting both the low flow rate event and the low temperature event.

The freeze-protection method may include monitoring for the low flow rate event and monitoring for the low temperature event occur simultaneously.

The freeze-protection method may include monitoring, via a flow switch, a water flow rate of water returning to a source from a source heat exchanger. The flow switch is positioned adjacent an outlet port of the source heat exchanger.

Monitoring for the low flow rate event may include determining, via the controller, whether a monitored flow rate of water returning to a source from a source heat exchanger has been less than a predefined flow rate threshold continuously for at least a first predefined duration.

Further, the freeze-protection method may include, in response to determining that the monitored flow rate has been less than the predefined flow rate threshold continuously for at least the first predefined duration, disabling a compressor and determining whether the monitored flow rate has been less than the predefined flow rate threshold continuously for at least a second predefined duration. The second predefined duration is greater than the first predefined duration.

Also, the low flow rate event may be detected in response to determining, via the controller, that the monitored flow rate has been less than the predefined flow rate threshold continuously for at least the second predefined duration.

Additionally, the freeze-protection method may include disabling a water pump or a motorized water valve fluidly connected to an inlet port of the source heat exchanger in response to detecting the low flow rate event.

The freeze-protection method may include, upon detecting the low flow rate event, removing the heat pump from the lockout mode in response to the controller identifying that power for the heat pump has been cycled and a monitored flow rate of water returning to a source from a source heat exchanger has increased to be greater than a predefined flow rate threshold.

The freeze-protection method may include collecting, via a first temperature sensor, a water temperature measurement of water flowing from a source to an inlet port of a source heat exchanger and collecting, via a second temperature sensor, a refrigerant temperature measurement of refrigerant flowing between a source heat exchanger and an expansion valve.

Further, the low temperature event may be detected in response to detecting that the water temperature measurement is less than a first predetermined temperature threshold and detecting that the refrigerant temperature measurement is less than a second predetermined temperature threshold.

Also, the freeze-protection method may include disabling a water pump or a motorized water valve fluidly connected to the inlet port of the source heat exchanger in response to detecting the low temperature event.

The freeze-protection method may include, upon detecting the low temperature event, removing, via the controller, the heat pump from the lockout mode in response to identifying that power for the heat pump has been cycled.

BRIEF DESCRIPTION OF THE DRAWINGS

FIG. 100 is another partial perspective view of the top corner of FIG. 10A with the grommet assembly of FIG. 10A secured to a bolt for mounting and/or hanging the system of FIG. 1.

DETAILED DESCRIPTION

Figure 1:
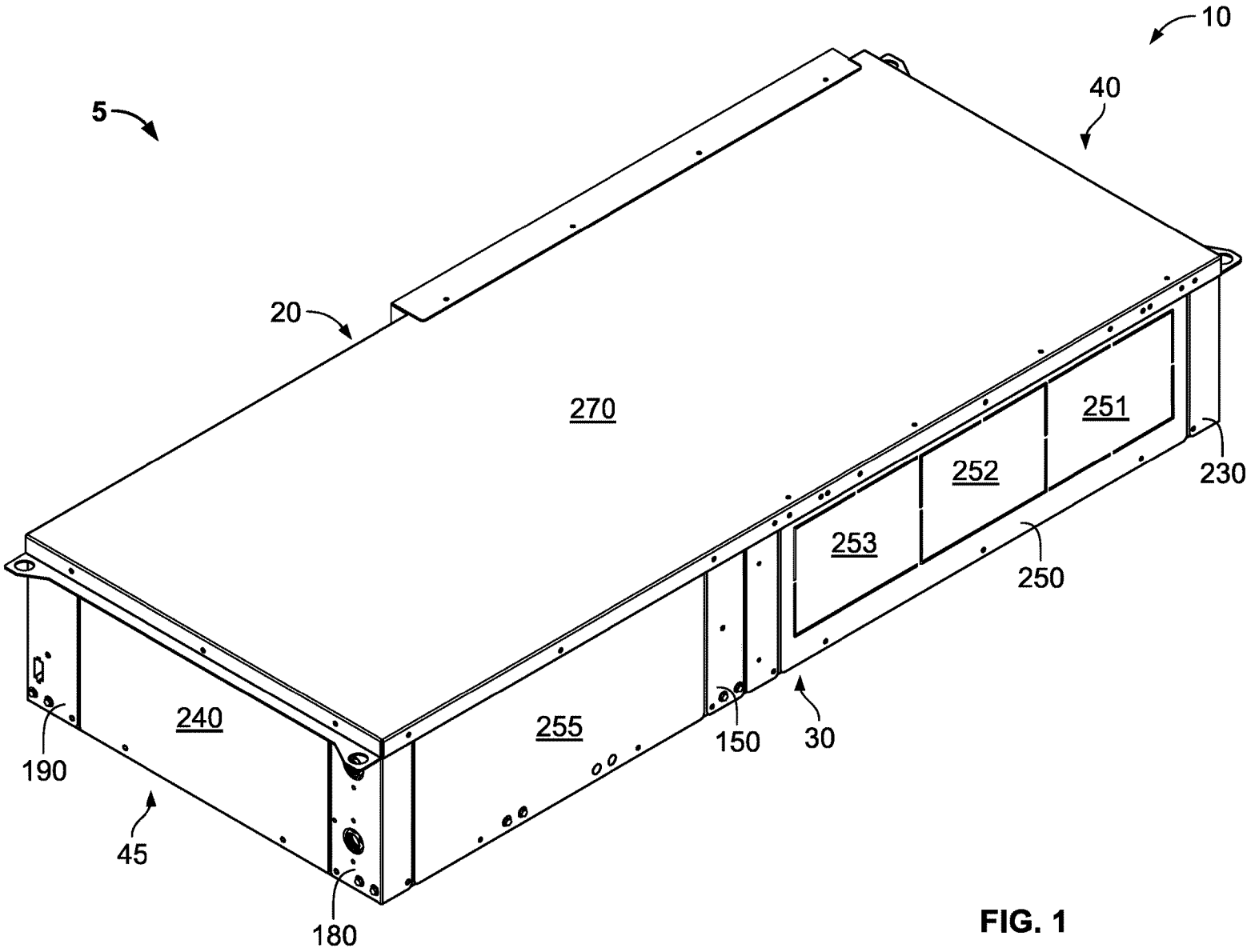
FIG. 1 is a perspective view an embodiment of a low-height heat pump system of the instant disclosure.

Although the figures and the instant disclosure describe one or more embodiments of a heat pump system, one of ordinary skill in the art would appreciate that the teachings of the instant disclosure would not be limited to these embodiments. It should be appreciated that any of the features of an embodiment discussed with reference to the figures herein may be combined with or substituted for features discussed in connection with other embodiments in this disclosure.

The instant disclosure provides an improved heat pump system comprising uniquely configured heat pump system components together with an improved enclosure that enable (i) easy and efficient assembly of the system at the factory, (ii) installation in locations that are extremely limited in height, such as the ceiling space in a housing unit, a hotel room, or a commercial office unit, for example, that separates vertically adjoining rooms or units, (iii) field configurable options for connecting to existing HVAC system components, and (iv) easy component serviceability while the system is installed. Embodiments of the improved enclosure (also interchangeably called a "cabinet," a "cabinet system," a "cabinet enclosure," or a "cabinet assembly" for purposes of this disclosure) provide for a low-height heat pump system, such as a 9-inch-tall system measured from the bottom of the cabinet to the top of the cabinet. The reduced height of the cabinet and uniquely configured heat pump components housed therein enables the cabinet to be installed in shallow ceiling spaces, such as in a furred ceiling area at an entry of a hotel room, a condominium, or an apartment, etc. In turn, the reduced height of the cabinet suspended from or otherwise mounted to the ceiling reduces the total height of the corresponding floor, thereby reducing the height of each floor within a building. In some instances, the height savings for each floor that results from the cabinet of the instant disclosure may enable in an additional floor to be added for every predetermined (e.g., ten) floors in a high-rise building. Additionally, embodiments of the disclosed cabinet and the uniquely configured heat pump components housed therein increase the size of the available floor space for the corresponding unit by removing the need to dedicate a portion of the floor space, such as a dedicated closet, for the heat pump system. Embodiments of the disclosed cabinet and the uniquely configured heat pump components housed therein also are capable of being retrofitted into older buildings with reduced floor heights and minimal available floor space for a new HVAC system.

Embodiments of the low-height cabinet system disclosed herein include uniquely configured cabinet components and heat pump components therein that enable a technician to easily install the cabinet in a shallow ceiling space. Embodiments of the disclosed cabinet include integrated low-profile hanger features that facilitate the cabinet in being installed in shallow spaces. Embodiments of the disclosed cabinet are configured to house various components of a water source heat pump in a novel, compact arrangement to reduce the amount of height consumed by the HVAC system and its cabinet enclosure. For example, embodiments of the instant disclosure may be about 50 inches long, about 20 inches wide, and a maximum of about 9 inches in height. To achieve the reduced height of 9 inches, embodiments of the low-height cabinet system of the instant disclosure include a refrigerant-to-air load heat exchanger with horizontally-oriented heat exchange tubes with heat exchange passes stacked vertically above one another to a height that enables the heat exchanger to fit within the 9 inch cabinet enclosure. With the maximum height being fixed, the horizontal length of the heat exchange tubes and the number of horizontal passes are defined by the desired heat exchange between air passing over the tubes and the refrigerant conveyed within the tubes. In addition, embodiments of the instant disclosure include the use of a horizontally-oriented compressor and a relatively small brazed-plate source heat exchanger, both enabling the reduced height of 9 inches. One of ordinary skill would appreciate that the use of a brazed-pate heat exchanger introduces the risk of damage from freezing of water or other source liquid therein, and the use of a relatively small brazed-plate heat exchanger as disclosed herein only enhances that risk due to the relatively small voids or volumes of water therein that may more easily and/or more quickly freeze under the same conditions. Consequently, the use of a brazed-plate heat exchanger as disclosed herein provides unexpected advantages for helping solve the problem of achieving a low height of 9 inches. Embodiments of the disclosed cabinet also include an integrated air-discharge plenum that unexpectedly provides fan/motor sound attenuation while also allowing the integration of such components or features inside the cabinet as opposed to, for example, having a plenum entirely separate from and outside the cabinet. Additionally, embodiments of the disclosed cabinet are formed of lightweight components, such as rail frames formed of thin-gauge steel, to facilitate the cabinet in easily being installed in a ceiling space or suspended from a ceiling. Further, the components provide rigidity to the cabinet that reduces vibrations and/or lowers acoustic signatures without incorporating additional noise-insulating materials.

Embodiments of the cabinet disclosed herein include features that enable a technician to easily access and service components housed in the cabinet from underneath, for example, without having to dismount the cabinet from its installed position in or near the ceiling. In addition, embodiments of the disclosed cabinet include a plurality of side and/or bottom panel air duct connection ports that can be configured in the field at the time of installation of the unit to facilitate connection of HVAC system air ducts to the heat pump system at the time of installation. Embodiments of the disclosed cabinet include a plurality of removable side and/or bottom panels to provide the technician with multiple points of access to internal components of the cabinet, thereby facilitating the technician in servicing various internal components from below the cabinet that is installed to or suspended from the ceiling. Embodiments of the disclosed cabinet include other features, such as a removable drain pan for a load heat exchanger, such as a refrigerant-to-air heat exchanger (also called an "air coil") and/or a retractable and removable slide deck to which one or more fans or air blowers and a corresponding drive motor are mounted, to enable servicing of the one or more fans and/or motor(s) and to further facilitate the technician in accessing various internal components of the cabinet when the cabinet remains in its installed condition.

Embodiments of the disclosed cabinet also include safety features, such as a bottom-mounted electrical disconnect switch, to increase the safety of the technician servicing the heat pump system. Other safety features are also disclosed herein. For example, embodiments of the disclosed heat pump system include a freeze-protection system and method that restricts operation of the compressor of the heat pump system to prevent damage to heat pump components when tasked with operating when, for example, the source water is near or below freezing temperatures. Additionally, embodiments of the freeze-protection system disclosed herein may be implemented in other heat pump systems to protect system components from freezing and damage.

Additionally, embodiments of the cabinet disclosed herein have a reduced part count and an easy fabrication and assembly process, thereby reducing manufacturing costs for the cabinet. For example, embodiments of assembly methods disclosed herein enable components of the cabinet to be assembled from the bottom up, where upon completion of the assembly enables components housed therein to be accessible and serviceable from underneath the cabinet when installed. Embodiments of the disclosed cabinet are configured to be modular to facilitate a streamlined process for assembling differently-oriented cabinets. For example, the modularity of the cabinet components enables the same parts to be used for a cabinet that is assembled in a right configuration, a left configuration, and a split configuration. In turn, required inventory is reduced, material utilization is optimized, and manufacturing efficiency is increased. The modularity of the cabinet components also enables the cabinet to be configured for a diverse set of environments.

Figure 4:
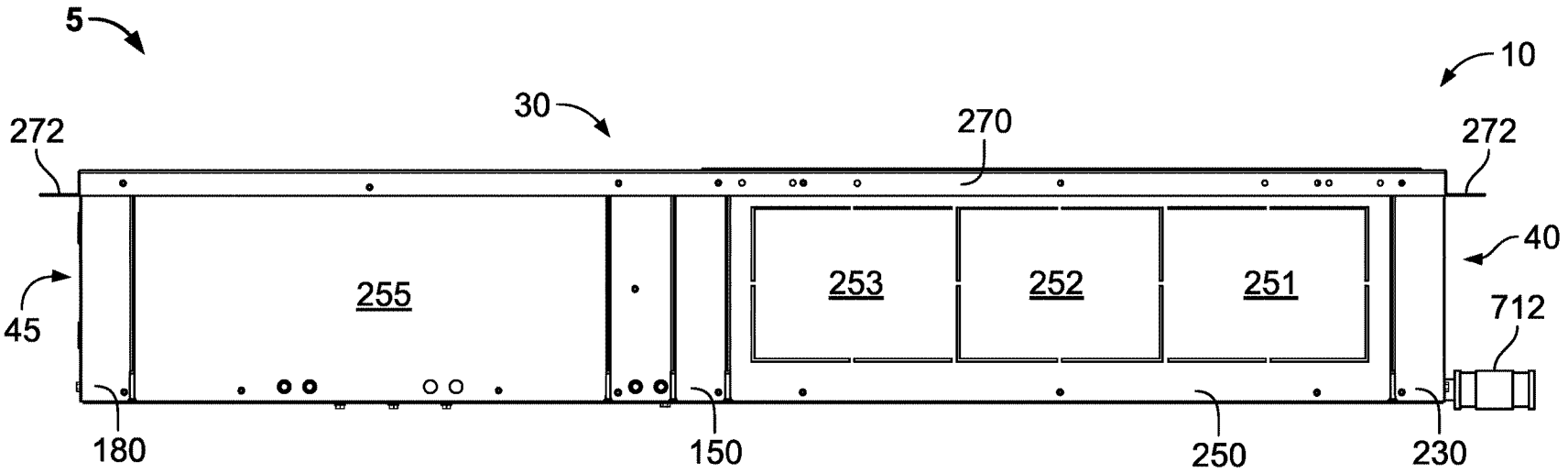
FIG. 4 is a first side view of the system of FIG. 1.
Figure 5:
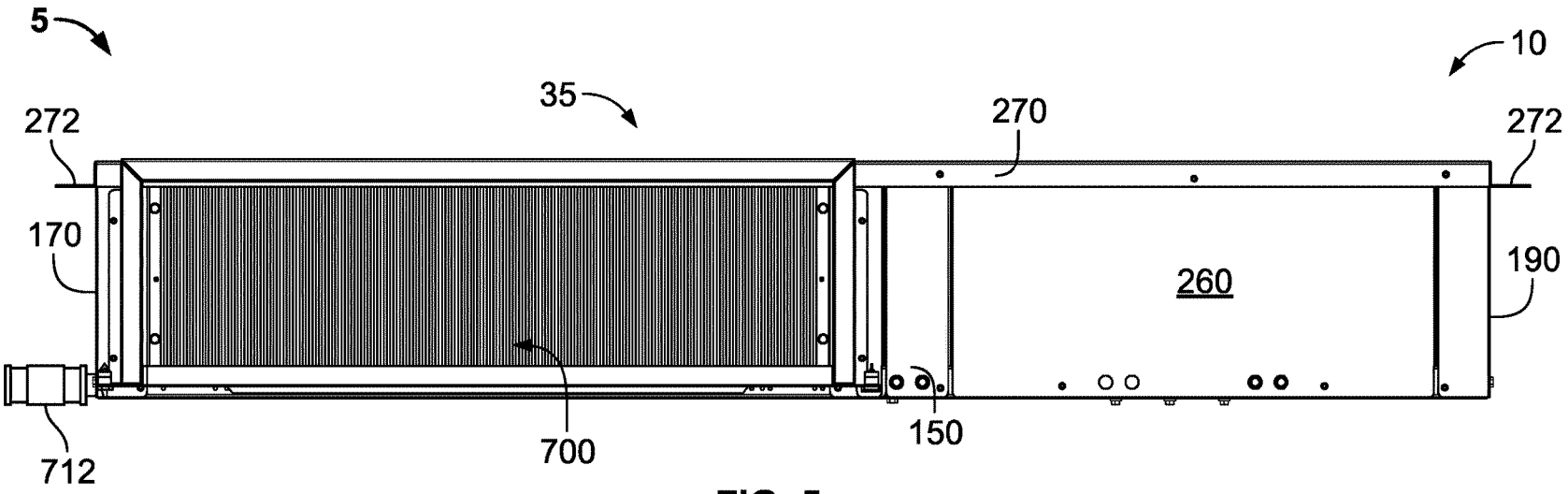
FIG. 5 is a second side view of the system of FIG. 1.
Figure 6:
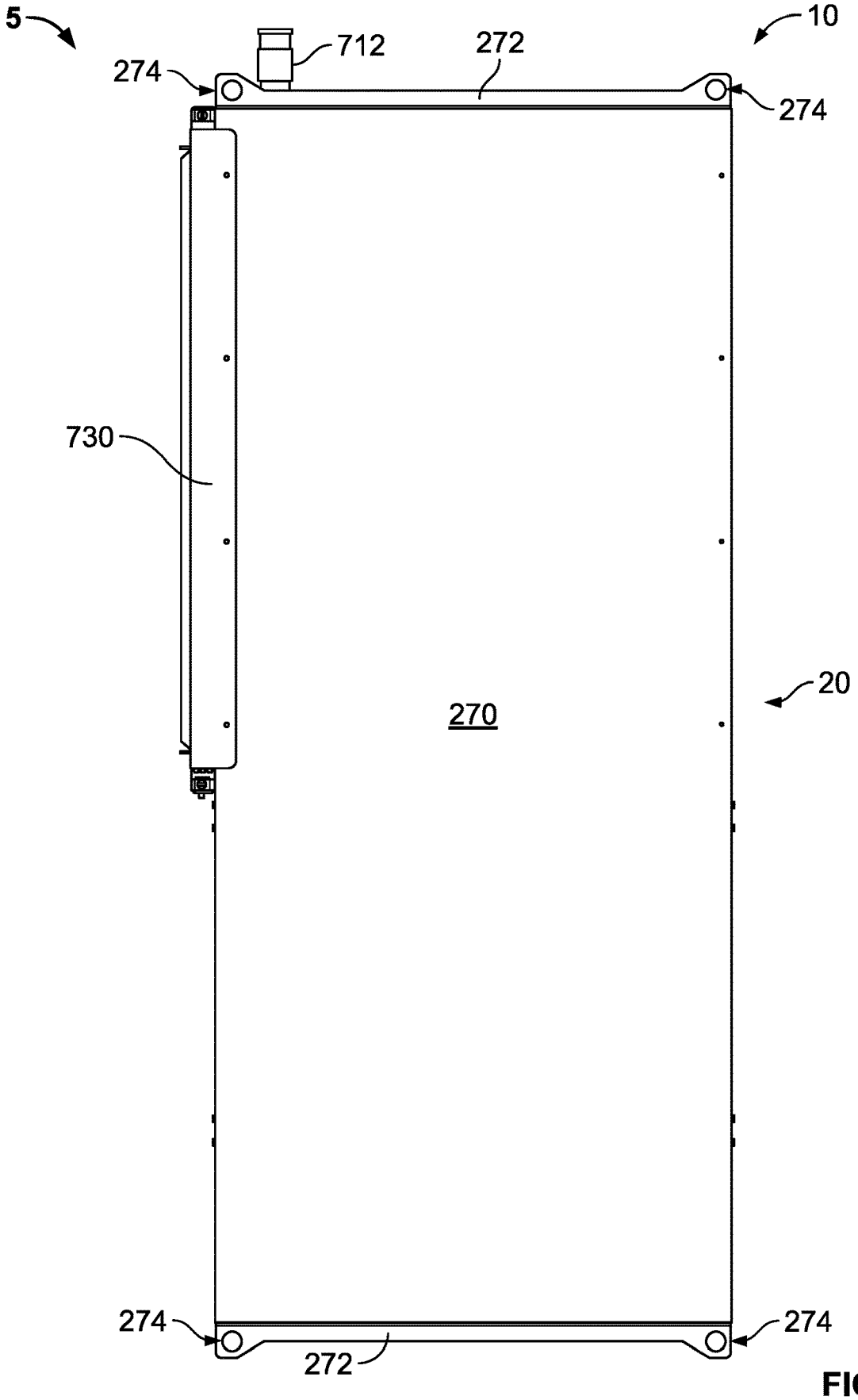
FIG. 6 is a top view of the system of FIG. 1.
Figure 7:
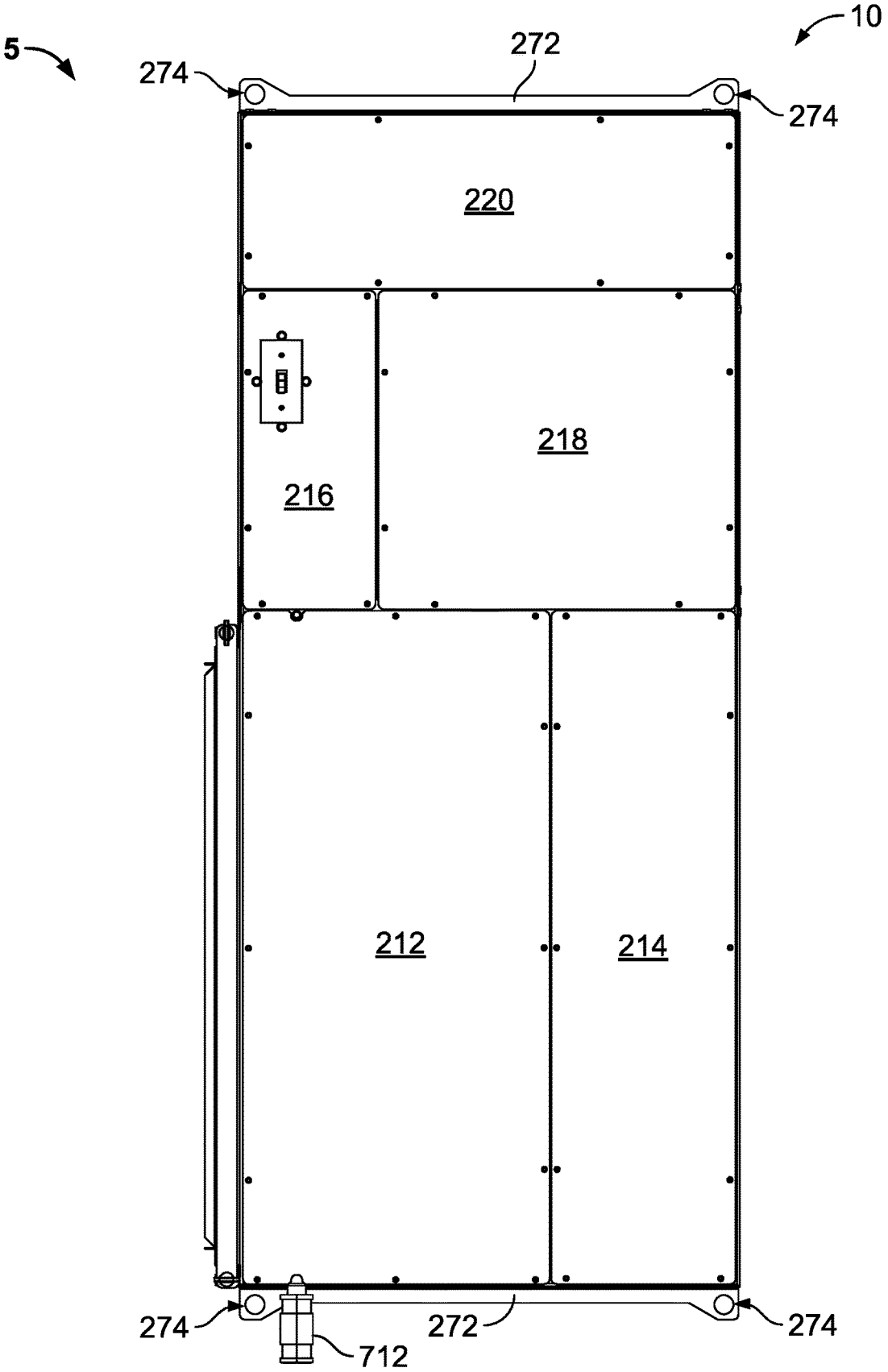
FIG. 7 is a bottom view of the system of FIG. 1.

Turning now to the drawings, FIGS. 1-10 illustrate various external views of an exemplary low-height heat pump system 5 of the instant disclosure, and particularly low-height heat pump cabinet assembly 10 that is configured to house uniquely configured heat pump components therein. In the illustrated example, the cabinet 10 has a low height of 9 inches, a length of 53 inches, and a depth of 22.5 inches. FIGS. 1 and 8-10 depict various perspective views of the cabinet 10, FIGS. 2-5 illustrate various elevation views of the cabinet 10, and FIGS. 6-7 depict representative top and bottom plan views, respectively, of the cabinet 10. The cabinet 10 includes a top side 20, a bottom side 25 opposite the top side 20, a first side 30, a second side 35 opposite the first side 30, a first end 40, and a second end 45 opposite the first end 40. In the illustrated example, the cabinet 10 includes a plurality of panels defining outer surfaces of the cabinet 10.

Figure 2:
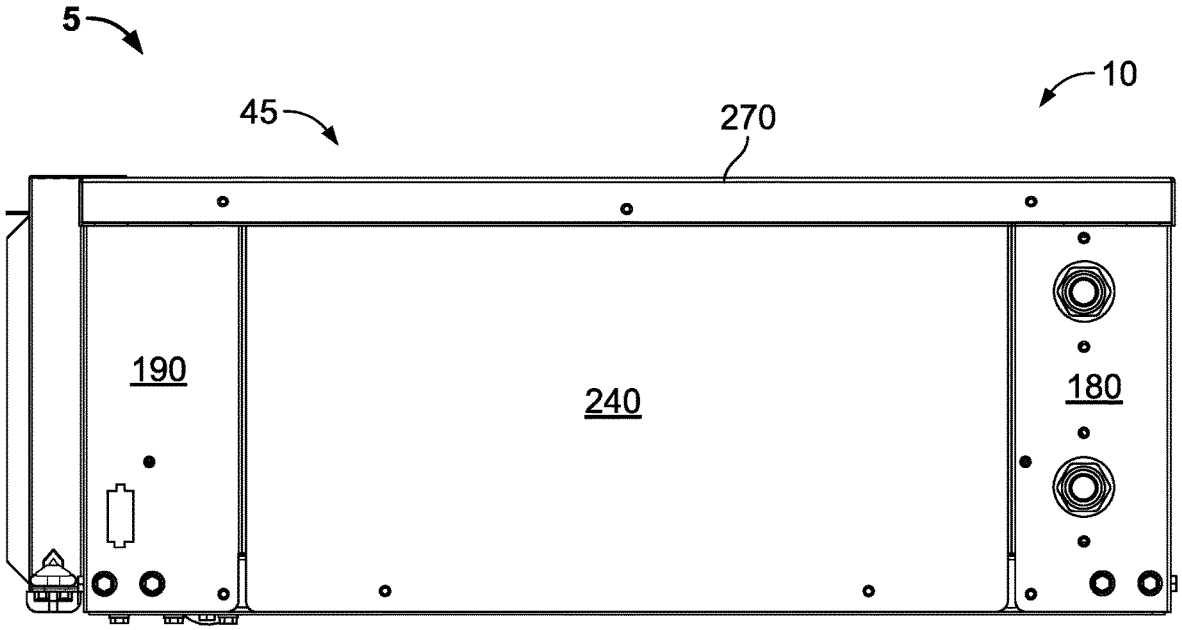
FIG. 2 is a first end view of the system of FIG. 1.

As shown in FIG. 2, an end panel 240 (also referred to as a "front panel," a "side panel," and an "access panel") and portions of corner posts 180, 190 form the second end 45 of the cabinet 10.

Figure 3:
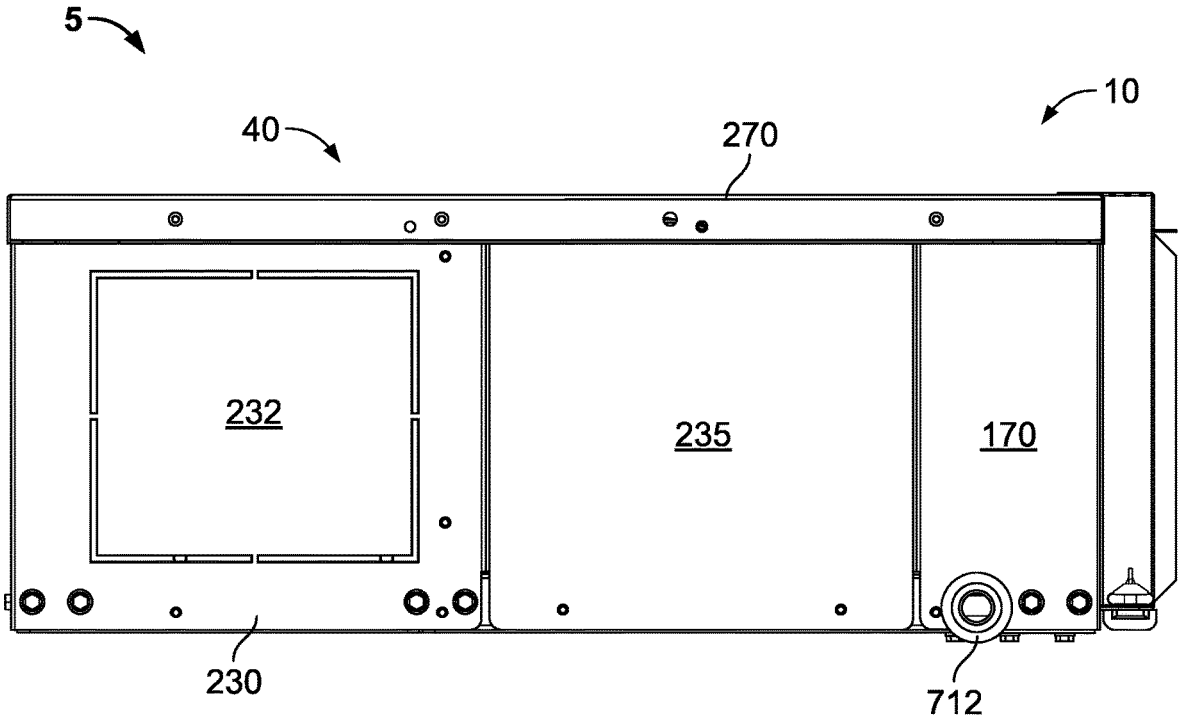
FIG. 3 is a second end view of the system of FIG. 1.

As shown in FIG. 3, end panels 230, 235 and a portion of a corner post 170 form the first end 40 of the cabinet 10. The end panel 230 (also referred to as a "back panel," a "side panel," and a "discharge panel") includes a duct panel 232 (also referred to as a "knockout panel") that is removable from the end panel 230. The duct panel 232 is configured to be decoupled from the end panel 230 to enable ductwork of an HVAC system to fluidly connect to the cabinet 10 via a corresponding opening formed where the duct panel 232 was removed from the end panel 230. For example, the duct panel 232 includes one or more flanges extending from its edges to facilitate the duct panel 232 in being coupled to and decoupled from the end panel 230. Additionally, an outlet 712 of a drain pan 710 (FIG. 11) extends outwardly from the corner post 170. The end panel 235 (also referred to as a "side panel" and an "access panel") is positioned next to the end panel 230 in a side-by-side manner.

As shown in FIG. 4, side panels 250, 255, a portion of the end panel 230, a portion of a corner post 180, and a portion of a divider 150 form the first side 30 of the cabinet 10. The side panel 250 (also referred to as a "discharge panel") is positioned adjacent the first end 40, and the side panel 255 is positioned adjacent the second end 45. The side panel 250 includes a plurality of duct panels 251, 252, 253 (also referred to as a "knockout panels") that are arranged in a side-by-side manner. The side panel 255 (also referred to as an "access panel") is positioned next to the side panel 250 in a side-by-side manner.

Each of the duct panels 251, 252, 253 are removable from the side panel 250 to form an opening for ductwork connecting to the cabinet 10. For example, each of the duct panels 251, 252, 253 includes one or more flanges extending from its edges to facilitate the coupling to and decoupling from the side panel 250. Ductwork of the HVAC system may fluidly connect to the cabinet 10 via an opening formed by the removal of one or more of the duct panels 251, 252, 253 in addition to or as an alternative to ductwork connecting to the cabinet 10 via the end panel 230. For example, ductwork of the HVAC system may connect to the cabinet 10 via only the end panel 230, via only the side panel 250, and/or simultaneously via both the end panel 230 and the side panel 250. In the illustrated example, each of the duct panels 251, 252, 253 are equally sized. In other examples, the duct panels 251, 252, 253 are differently sized with respect to each other to facilitate differently-sized ducts in connecting to the cabinet 10. For example, the duct panel 251 having a first surface area may be removed to enable a first-sized duct to connect to the cabinet 10, or the duct panel 252 having a second surface area may be removed to enable a second-sized duct to connect to the cabinet 10. Additionally, or alternatively, different combinations of the duct panels 251, 252, 253 may be removed to facilitate differently sized ducts in connecting to the cabinet 10. For example, one of duct panels 251, 252, 253 may be removed to enable a relatively small duct to connect to the cabinet 10. Two adjacent ones of the duct panels 251, 252, 253 may be removed together to enable a moderately-sized duct to connect to the cabinet 10. All three of the duct panels 251, 252, 253 may be removed together to enable a relatively large duct to connect to the cabinet 10, for example, to facilitate proper air velocity and static pressure.

As shown in FIG. 5, a side panel 260, a portion of the corner posts 170, 190, and a portion of the divider 150 form the second side 35 of the cabinet 10. The side panel 260 (also referred to as an "access panel") is positioned adjacent the second end 45 of the cabinet 10. An opening is defined along the second side 35 adjacent the first end 40 of the cabinet 10 between the top side 20 and the bottom side 25. The opening exposes a refrigerant-to-air load heat exchanger, such as an air coil 700 housed within the cabinet 10, to air outside of the cabinet 10. In the illustrated example, a filter rack 730 is installed upstream of the air coil 700 and is configured to house a replaceable 1" or a 2" filter, for example.

Figure 9:
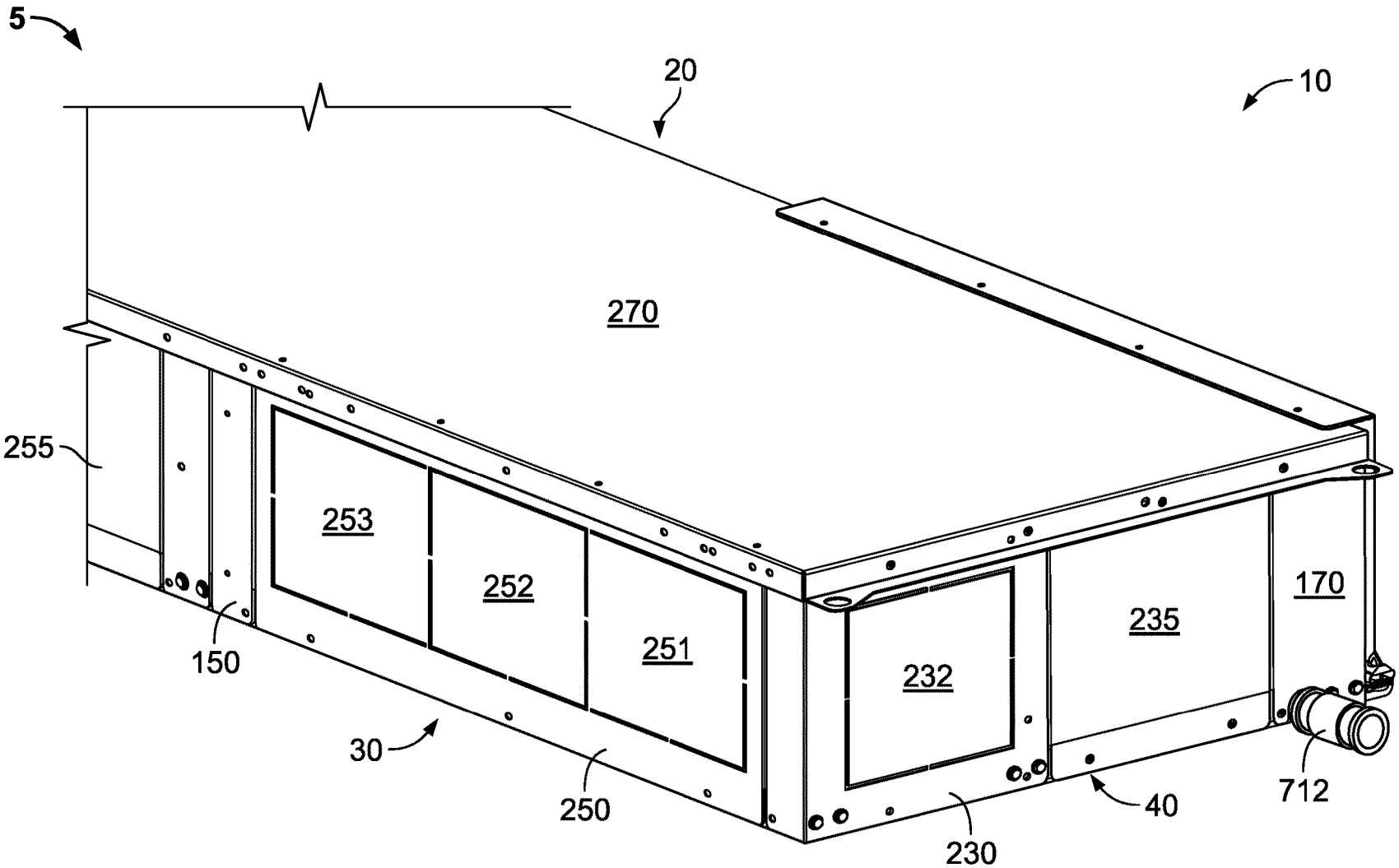
FIG. 9 is another perspective view of the system of FIG. 1.

As shown in FIG. 6, a top panel 270 forms the top side 20 of the cabinet 10. In the illustrated example, the top panel 270 extends the entire length and width of the top side 20. As shown in FIGS. 1, 6, and 9, the top panel 270 includes flanges 272 that extend from opposing ends. One of the flanges 272 extends between the first and second sides 30, 35 and outwardly from the first end 40 of the cabinet 10. The other of the flanges 272 extends between the first and second sides 30, 35 and outwardly from the second end 45 of the cabinet 10. Additionally, each of the flanges 272 defines two mount holes 274 at opposing ends of the flange 272 such that one of the mount holes 274 is located at each corner of the top panel 270. The mount holes 274 are configured to facilitate the cabinet 10 in being suspended from or otherwise mounted to a ceiling by a technician without additional brackets.

Figure 10A:
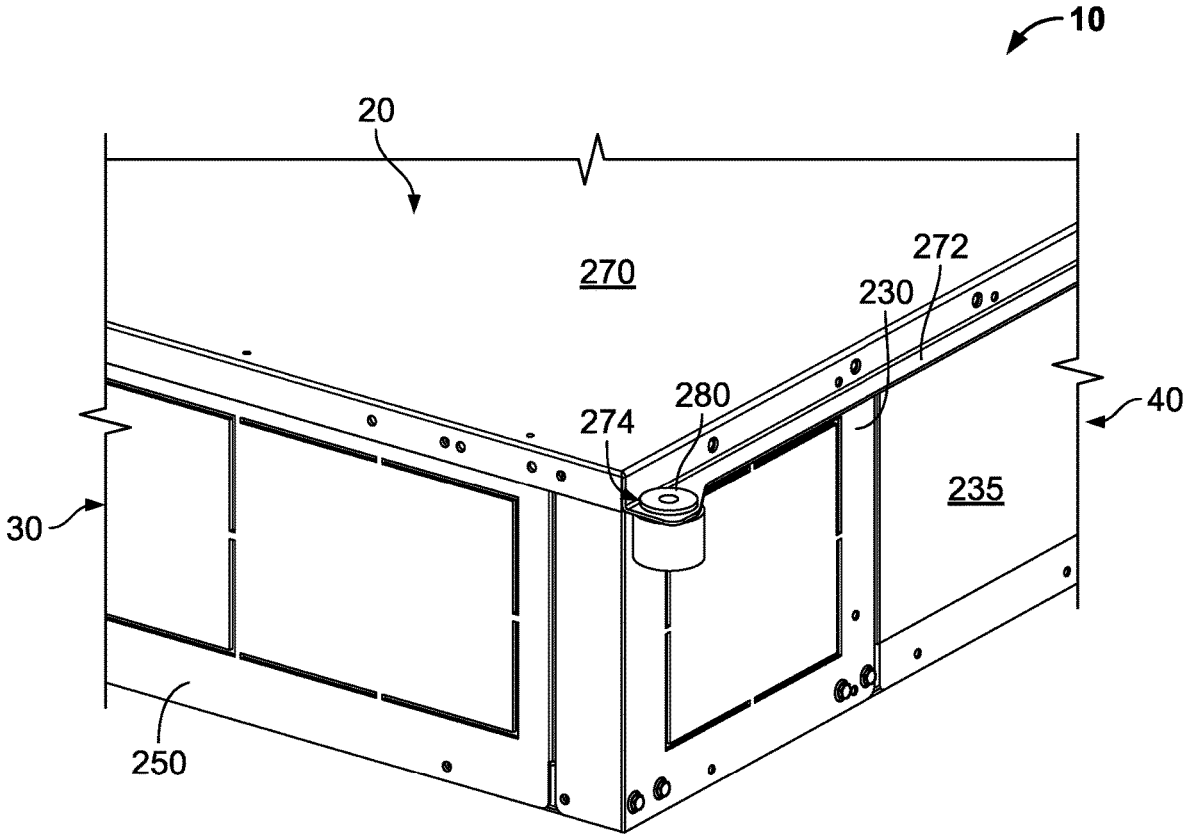
FIG. 10A is a partial perspective view of a top corner of the system of FIG. 1 that depicts a grommet assembly for mounting and/or hanging the system in a designated location.
Figure 10B:
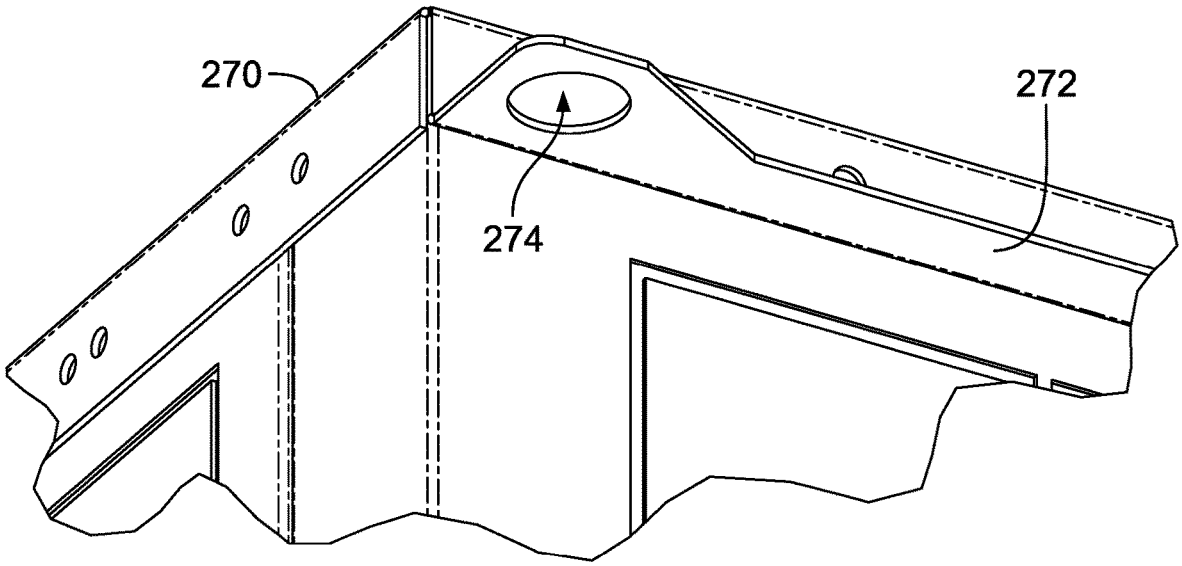
FIG. 10B is another partial perspective view of the top corner of FIG. 10A without the grommet assembly.
Figure 10C:
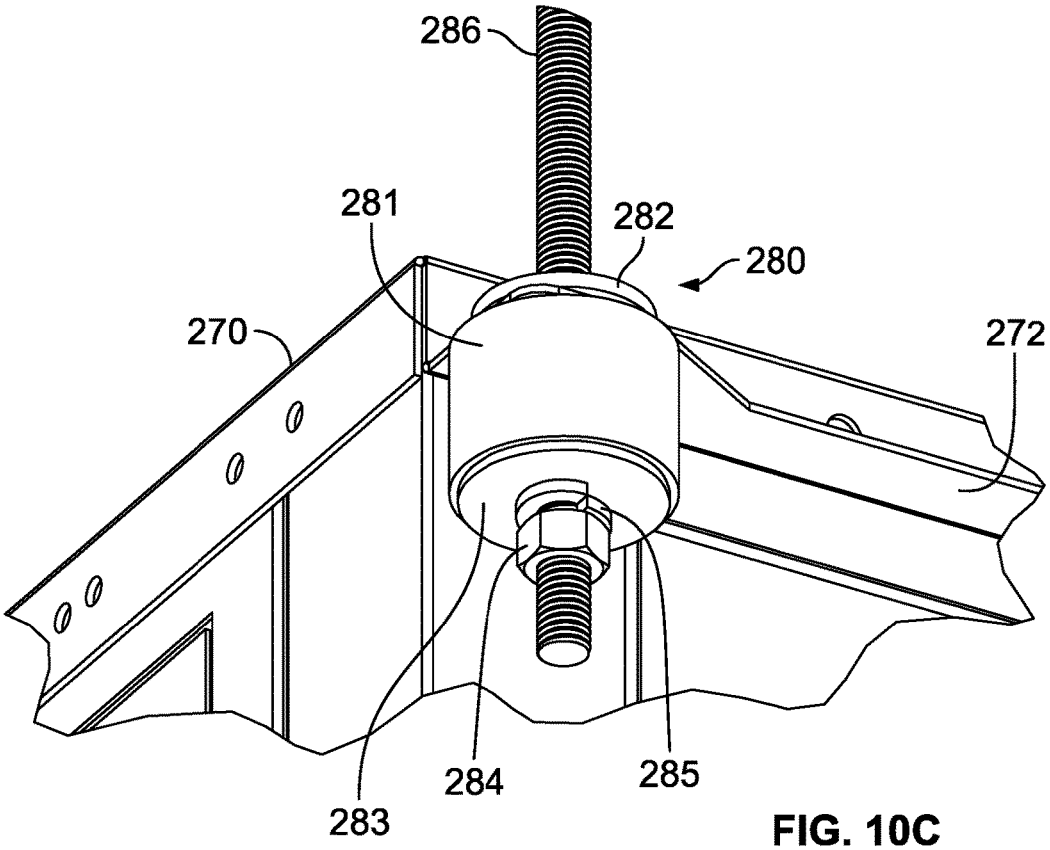
FIG. 10D is a side view of the top corner of FIG. 10A with the grommet assembly of FIG. 10A secured to the bolt of FIG. 100.
Figure 10D:
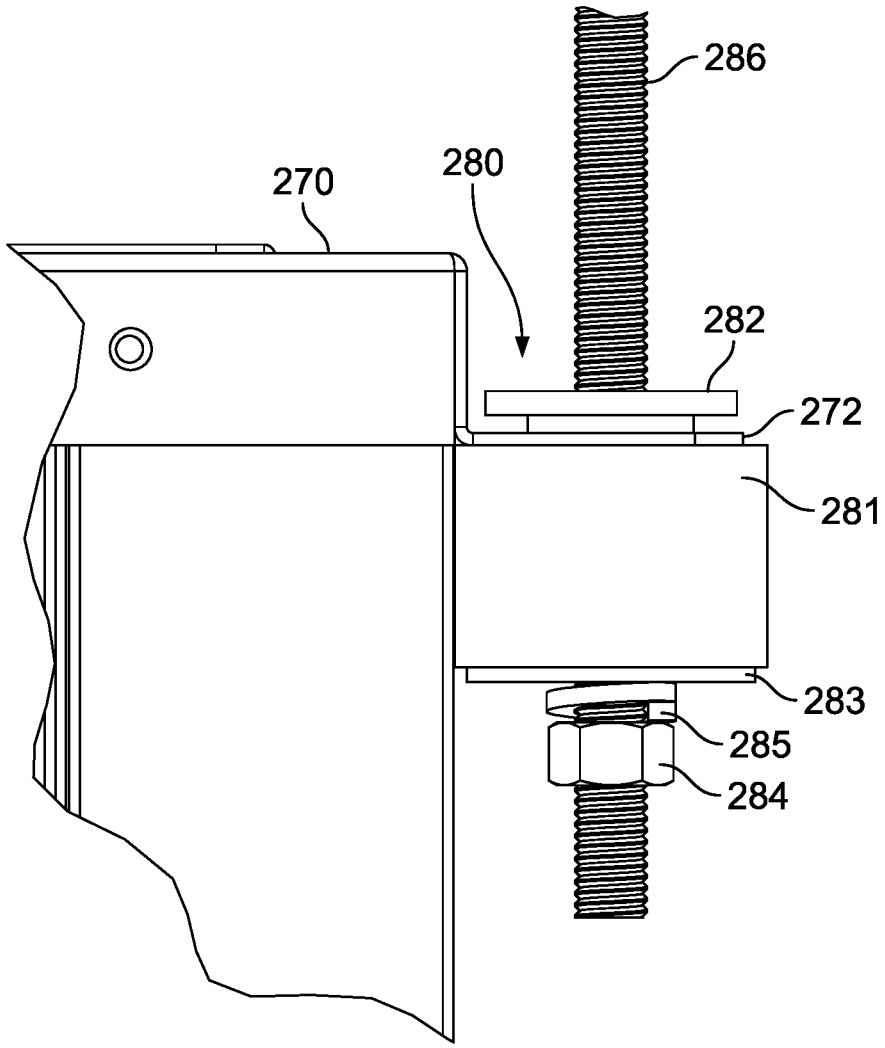

As shown in FIGS. 10A and 10C-10D, the cabinet 10 also includes a plurality of low-profile hanger mounts comprising grommet assemblies 280 that further facilitate the cabinet 10 in being secured to or suspended from the ceiling. The grommet assemblies 280 are located at the corners of the cabinet 10 and configured to prevent potential operational vibrations of the cabinet 10 from migrating to the building structure to which the cabinet 10 is installed. The grommet assemblies 280 are compact and do not extend beyond the top panel 270 to facilitate the cabinet 10 in being installed in shallow ceiling spaces, such as in a furred ceiling areas. Each of the grommet assemblies 280 extends through a respective one of the mount holes 274 and secured through a respective one of the flanges 272. Each of the grommet assemblies 280 includes a grommet 281 (e.g., rubber grommets), a washer 283, a nut 284, a lock washer 285, and a hanger rod 286. The grommet 281 includes a top cap 282 that extends through the mount hole 274 and is positioned adjacent a top surface of the flange 272. The remaining portion of the grommet 281 is positioned below a bottom surface of the flange 272. In the illustrated example, the grommet 281 contacts the bottom surface of the flange 272. The hanger rod 286 extends through the grommet 281 and the mount hole 274. The washer 283 engages a bottom of the grommet 281, the lock washer 285 engages the washer 283, and the nut 284 threadably receives the hanger rod 286. The nut 284 is threaded onto the hanger rod 286 until the nut 284 securely fastens the flange 272 of the cabinet 10 to the bolt 286.

Figure 8:
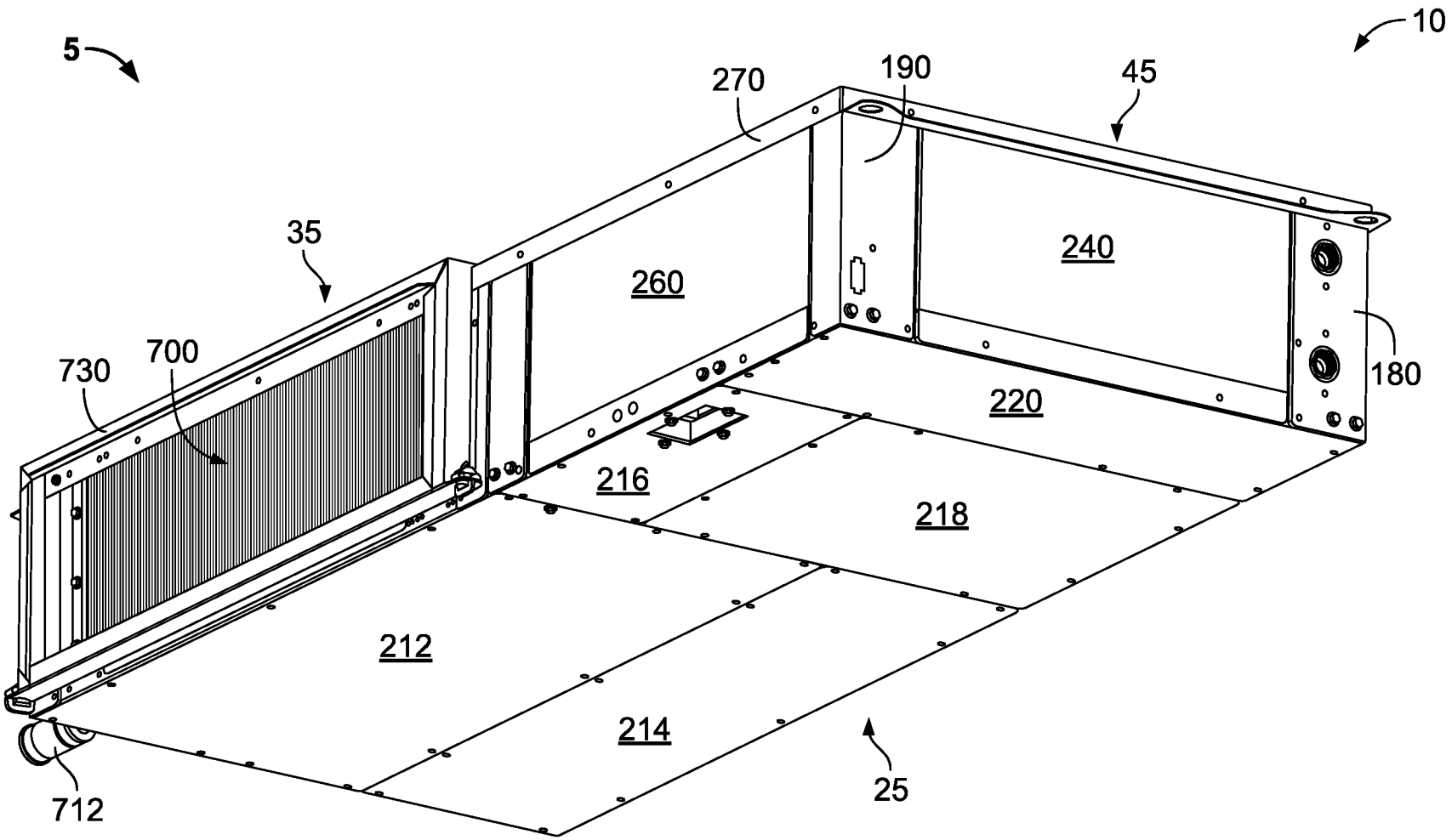
FIG. 8 is a bottom perspective view of the system of FIG. 1.

As shown in FIGS. 7 and 8, the bottom side 25 of the cabinet 10 is formed by a plurality of bottom panels 212, 214, 216, 218, 220 that are arranged next to each other. Each of the bottom panels 212, 214, 216, 218, 220 are configured to be removed from a frame 100 (FIG. 11) of the cabinet 10 to enable a technician to easily access different components housed within the cabinet 10 from a position below the cabinet 10. For example, the bottom panel 212 is configured to be decoupled from the frame 100 to enable a technician to access components that are housed adjacent the bottom panel 212, the bottom panel 214 is configured to be decoupled from the frame 100 to enable a technician to access components that are housed adjacent the bottom panel 214, etc. In the illustrated example, the bottom panel 212 is configured to be decoupled from the frame 100 to provide access to a plenum compartment 50 (FIG. 25) of the cabinet 10. The bottom panel 214 is configured to be decoupled from the frame 100 to provide access to a blower compartment 60 (FIG. 25) of the cabinet 10. The bottom panel 216 and/or the bottom panel 218 is configured to be decoupled from the frame 100 to provide access to a compressor compartment 70 (FIG. 17) of the cabinet 10. The bottom panel 220 is configured to be decoupled from the frame 100 to provide access to an electronics compartment 80 (FIG. 27) of the cabinet 10.

Figure 11:
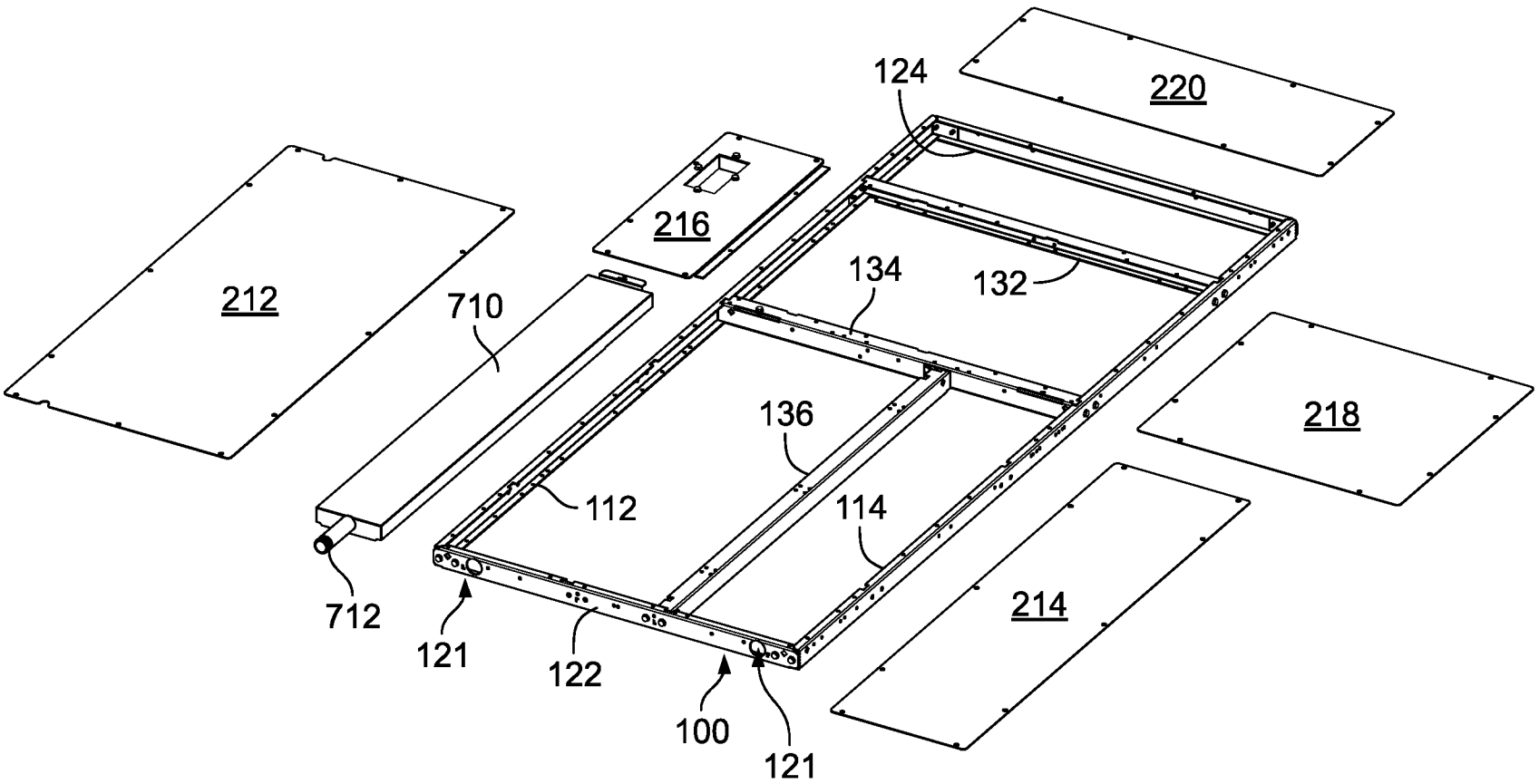
FIG. 11 depicts a step of an example method of the instant disclosure for assembling the system of FIG. 1.

FIGS. 11-28 depict various steps of an example assembly process for the heat pump system 5 of the instant disclosure. Initially, as shown in FIG. 11, a base of the frame 100 of the cabinet 10 is assembled together in an upside-down configuration at a workstation. For example, side rails 112, 114 and end rails 122, 124 of the frame 100 are coupled together (e.g., via fasteners) to form a rectangular shape and an outer frame of the cabinet 10. The frame 100 also includes cross rails 132, 134, 136 that are each coupled to one or more of the side rails 112, 114 and/or end rails 122, 124. The cross rails 132, 134 extend perpendicularly between and couple (e.g., via fasteners) to the end rails 122,124. The cross rail 136 extends perpendicularly between and couple (e.g., via fasteners) to the end rails 122 and the cross rails 134.

Subsequently, a drain pan 710 and the bottom panels 212, 214, 216, 218, 220 are then coupled to the frame 100 in an upside-down configuration such that the bottom side 25 is facing upward. The drain pan 710 for the air coil 700 extends between and is coupled to the end rail 122 and the cross rail 134. The drain pan 710 is configured to be easily decoupled from the frame 100 to facilitate a technician in cleaning, maintaining, and/or repairing the drain pan 710. An outlet 712 of the drain pan 710 is positioned to extend through one of two holes 121 of the end rail 122, and an opposing end of the drain pan 710 is fastened to the cross rail 134. For example, an end of the drain pan 710 includes a flange that is coupled to the cross rail 134 (e.g., via a fastener). In some examples, the outlet 712 on the opposing end of the drain pan 710 is a flexible drain coupling that is decouplable from the drain pan 710 to facilitate in the disassembly, removal, and/or servicing of the drain pan 710 with hand tools.

Additionally, the bottom panel 212 is coupled to the side rail 112, the end rail 122, and/or the cross rails 134, 136 via one or more fasteners (e.g., threaded fasteners) in a manner such that the bottom panel 212 covers the drain pan 710 in the upside-down orientation. The bottom panel 214 is coupled to the side rail 114, the end rail 122, and/or the cross rails 134, 136 via one or more fasteners (e.g., threaded fasteners). The bottom panel 216 is coupled to the side rail 112 and/or the cross rails 132, 134 via one or more fasteners (e.g., threaded fasteners), and the bottom panel 218 is coupled to the side rail 114 and/or the cross rails 132, 134 via one or more fasteners (e.g., threaded fasteners). The bottom panel 220 is coupled to the side rails 112, 114, the end rail 124, and/or the cross rail 132 via one or more fasteners (e.g., threaded fasteners).

Figure 12:
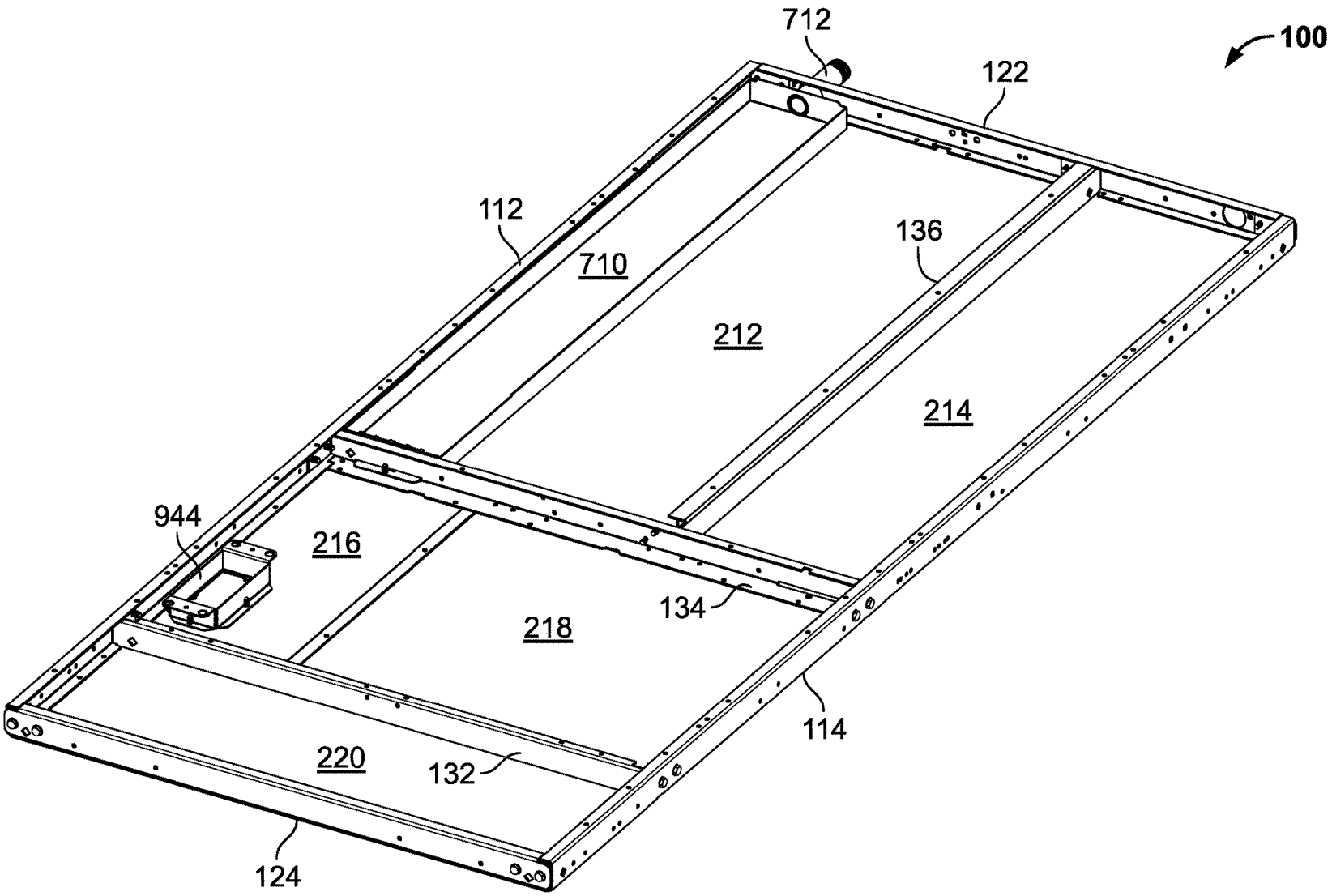
FIG. 12 depicts another step of the method for assembling the system of FIG. 1.

The base of the frame 100, the drain pan 710, and the bottom panels 212, 214, 216, 218, 220 are then rotated right-side up and transported to an assembly line for further assembly of the cabinet 10. FIG. 12 depicts the assembled components of the cabinet 10 after being rotated right-side up. The remaining components of the cabinet 10 are assembled to the frame 100 in a right-side up orientation to enable the cabinet 10 to be assembled in a configuration that subsequently enables a technician to easily access those components from below the cabinet 10 by quickly removing one or more of the bottom panels 212, 214, 216, 218, 220 from the frame 100.

Figure 13:
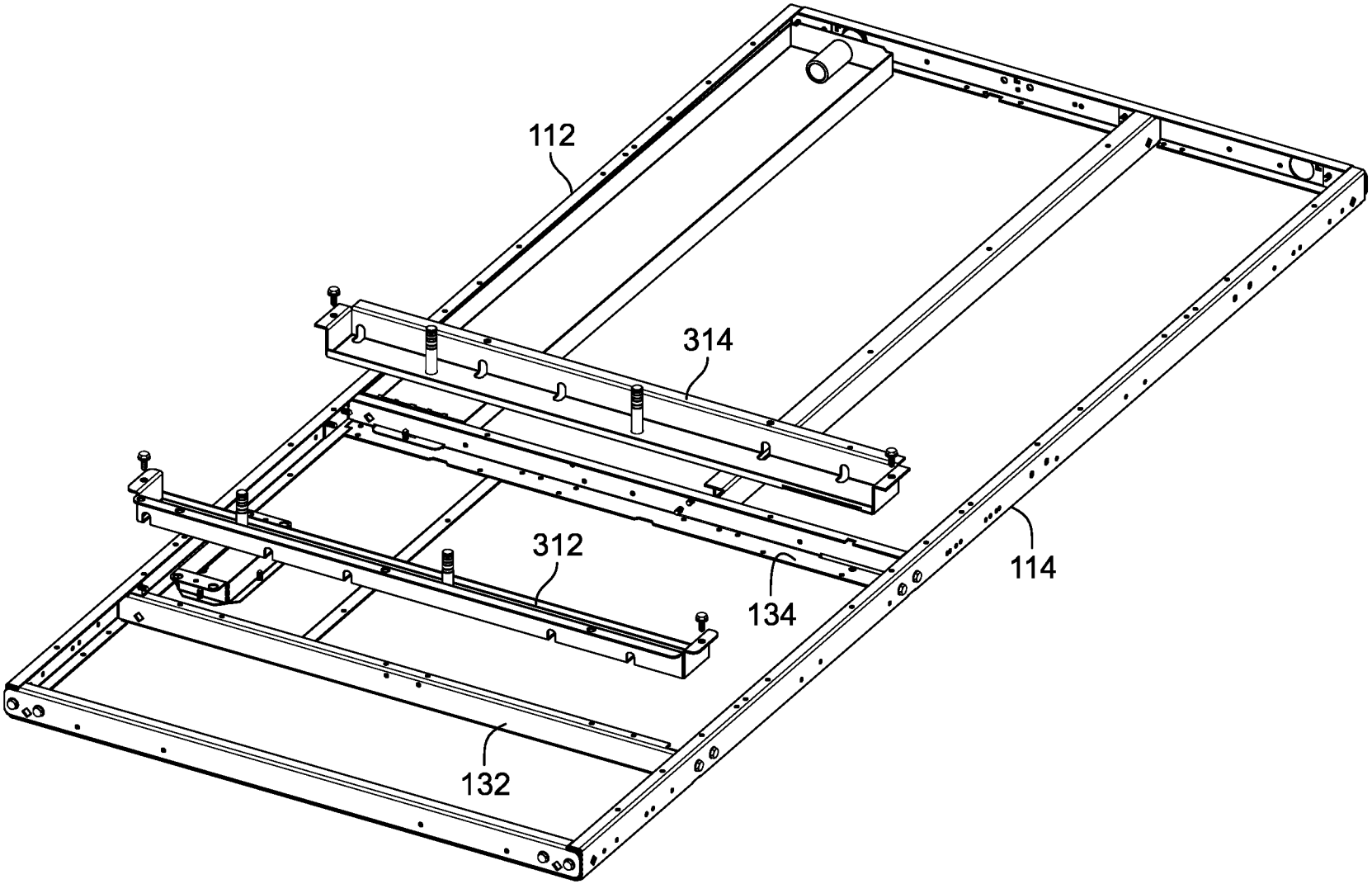
FIG. 13 depicts yet another step of the method for assembling the system of FIG. 1.
Figure 14A:
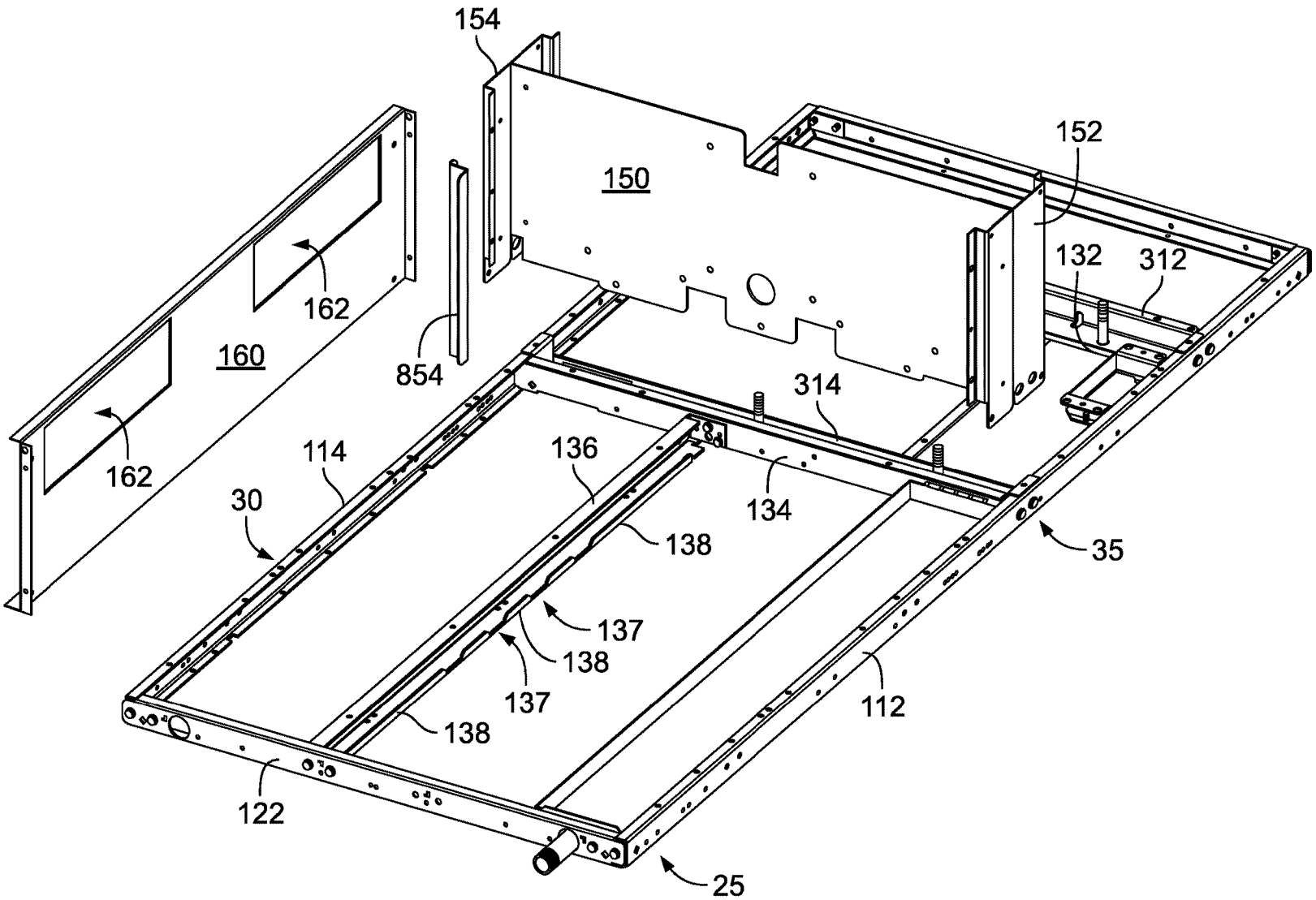
FIG. 14A depicts yet another step of the method for assembling the system of FIG. 1.

FIG. 13 depicts compressor cross rails 312, 314 of the cabinet 10 that are positioned to rest on the cross rails 132, 134, respectively. As shown in FIG. 14A, the compressor cross rail 312 extends between and is coupled to the side rails 112, 114. Each end of the compressor cross rail 312 is coupled to one of the side rails 112, 114 via a fastener, and a middle portion of the compressor cross rail 312 rests on a surface of the of the cross rail 132. Similarly, the compressor cross rail 314 extends between and is coupled to the side rails 112, 114. Each end of the compressor cross rail 314 is coupled to one of the side rails 112, 114 via a fastener, and a middle portion of the compressor cross rail 314 rests on a surface of the of the cross rail 134.

Figure 14B:
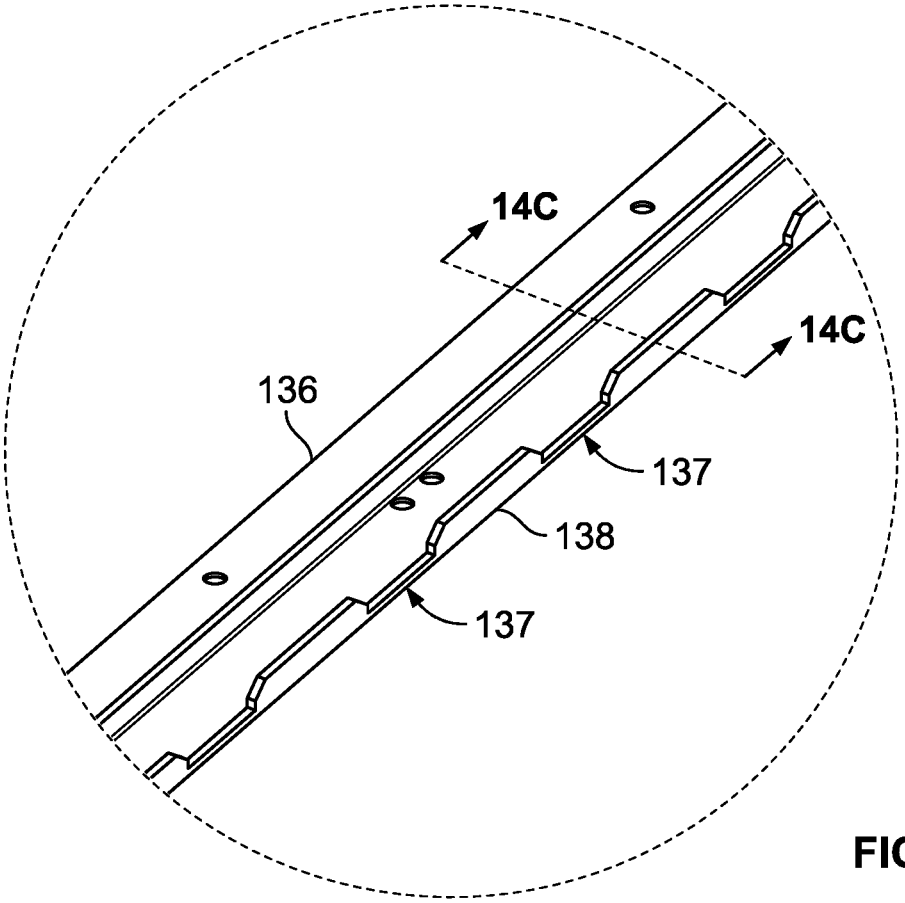
FIG. 14B is a closeup view of a cross rail of a frame of the system of FIG. 1.
Figure 14C:
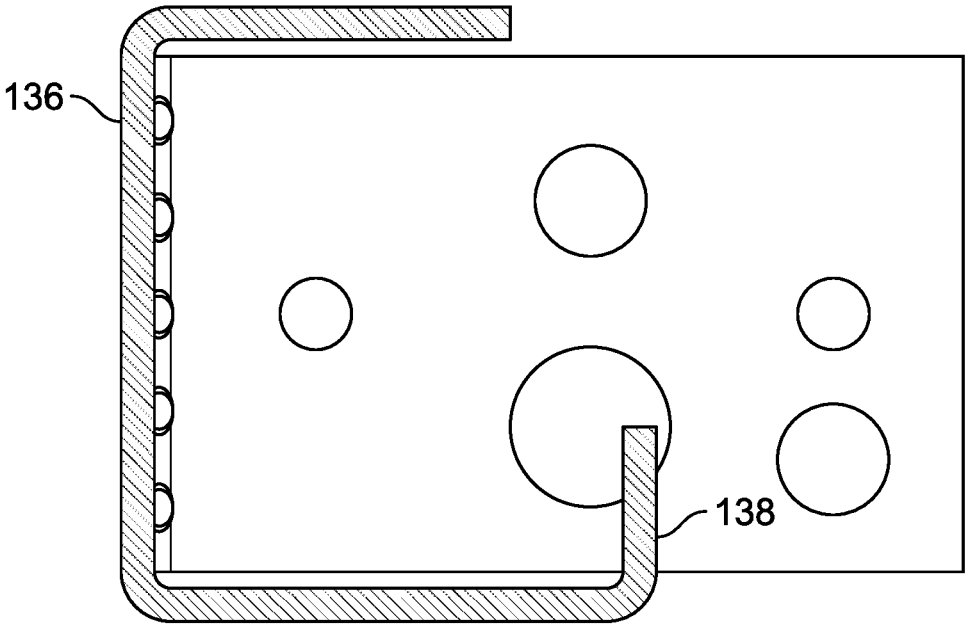
FIG. 14C is a further closeup view of the cross rail of FIG. 14B.
Figure 38A:
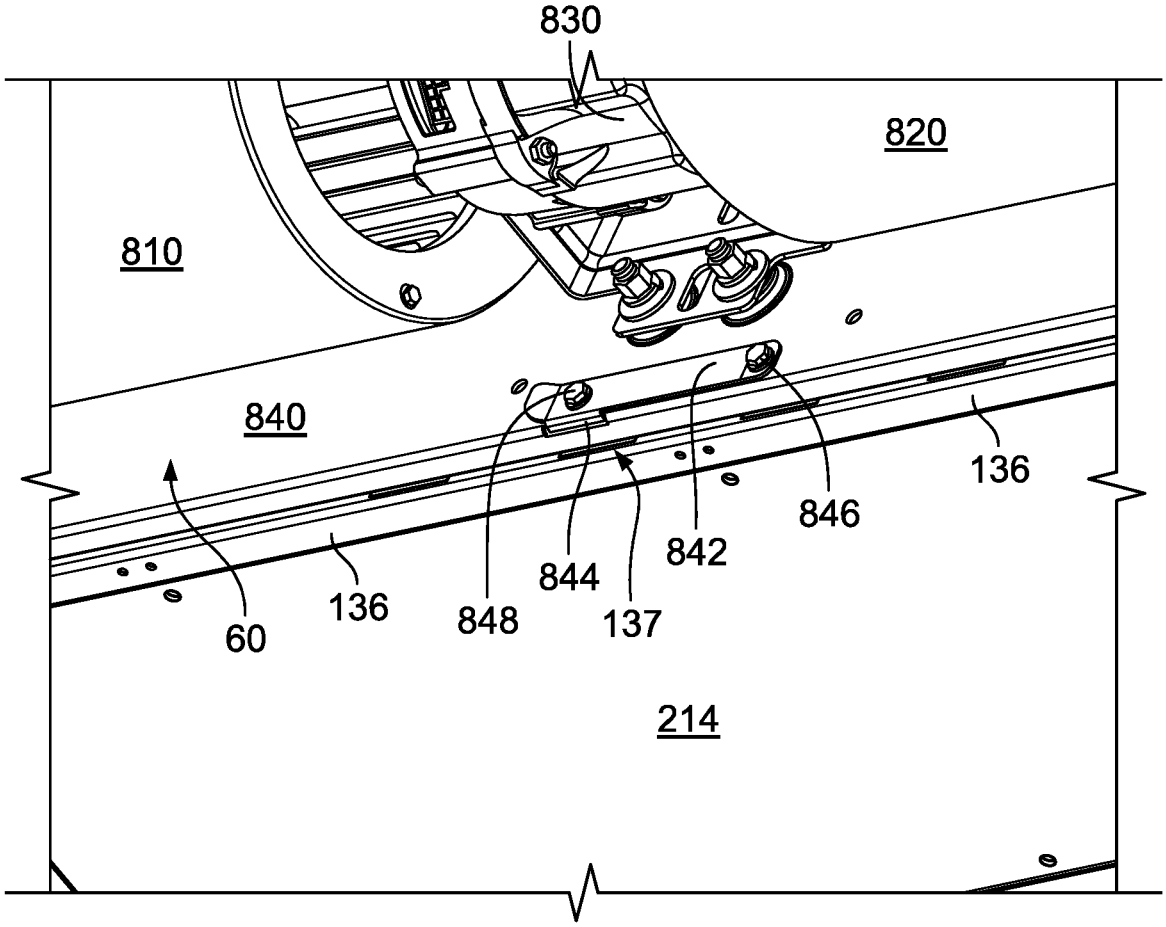
FIG. 38A is an expanded view of a blower assembly of the system of FIG. 1 having a blower panel secured within the blower-and-coil compartment of FIG. 36 via a latch in a secured position.

FIGS. 14B-14C further depict features of the cross rail 136. One or more lips 138 protrude upward from a bottom edge of the cross rail 136. Each of the lips 138 extend longitudinally along a portion of the cross rail 136 and are arranged in a side-by-side manner along the cross rail 136. Additionally, the lips 138 are longitudinally spaced apart from each other along the cross rail 136. The gaps formed between the lips 138 define blade openings 137 (to receive a lock blade 844 of a latch 842 as shown in FIG. 38A).

Figure 15:
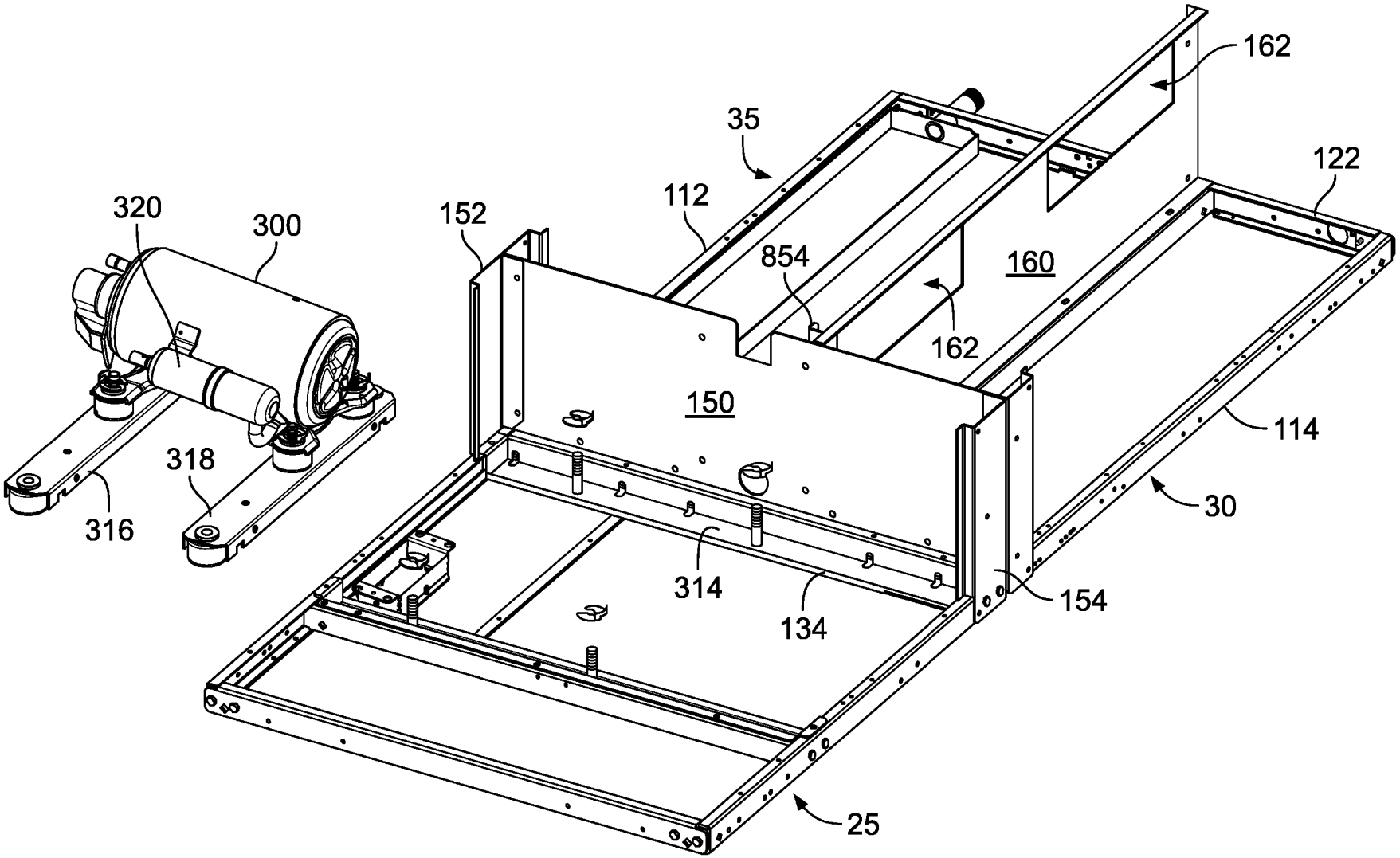
FIG. 15 depicts yet another step of the method for assembling the system of FIG. 1.

Returning to FIG. 14A, the frame 100 includes the divider 150 and a divider 160 (also referred to as a "blower mounting panel"), and the blower assembly includes a slider bracket 854. As shown in FIG. 15, the divider 150 includes mullions 152, 154 located at opposing ends of the divider 150. The divider 150 extends along the cross rail 134 between the side rails 112, 114, with the mullion 152 adjacent the side rail 112 and the mullion 154 adjacent the side rail 114. In the illustrated example, the divider 150 is coupled to the cross rail 134, the side rail 112, and/or the side rail 114 via fasteners. For example, the mullion 152 is coupled to and extends along a portion of the side rail 112, and the mullion 154 is coupled to and extends along a portion of the side rail 114. As disclosed below in greater detail, the divider 150 is configured to extend along the cross rail 134, between the first and second sides 30, 35, and between the top and bottom sides 20, 25 to separate the compressor compartment 70 from both the plenum compartment 50 and the blower compartment 60.

The divider 160 extends along the cross rail 136 between the end rail 122 and the divider 150. In the illustrated example, the divider 160 is coupled to the end rail 122, the cross rail 134, the cross rail 136, and/or the divider 150 via fasteners. As disclosed below in greater detail, the divider 160 is configured to extend along the cross rail 136, between the first end 40 and the divider 150, and between the top and bottom sides 20, 25 to separate the plenum compartment 50 from the blower compartment 60. The divider 160 also defines one or more openings 162 to fluidly connect the plenum compartment 50 to the blower compartment 60 such that the plenum receives heated or cooled air exiting the blower compartment 60. The duct panels 232, 251, 252, 253 enable the plenum compartment 50 to be accessed in multiple discharge directions for various duct configurations. The plenum compartment 50 enables air pressure to build for distribution down the installed duct paths. Additionally, the plenum compartment 50 facilitates a rapid expansion of airflow from the blowers 810, 820, which may have a relatively small area and a relatively high-velocity throat, thereby rapidly lowering the airflow velocity and corresponding noise due to a reduced turbulence. That is, the rapid decrease in velocity results in an integral acoustic attenuator of the cabinet 10.

Figure 19:
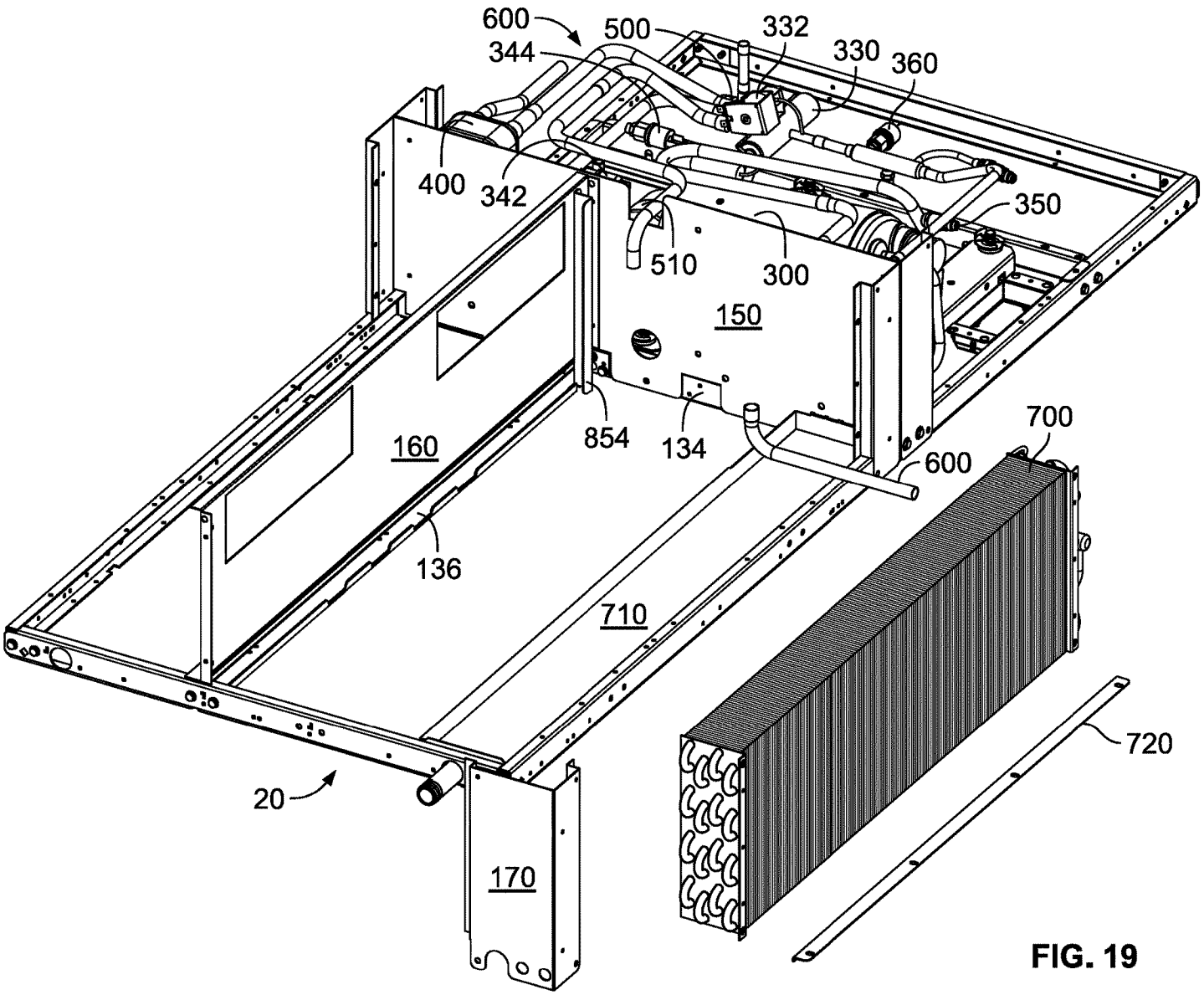
FIG. 19 depicts yet another step of the method for assembling the system of FIG. 1.

As most clearly shown in FIG. 19, the slider bracket 854 is configured to extend between the top side 20 and the bottom side 25 of the cabinet 10 along the vertical edge where the divider 160 intersects the divider 150. The slider bracket 854 is coupled to the divider 150 via fasteners.

Figure 16:
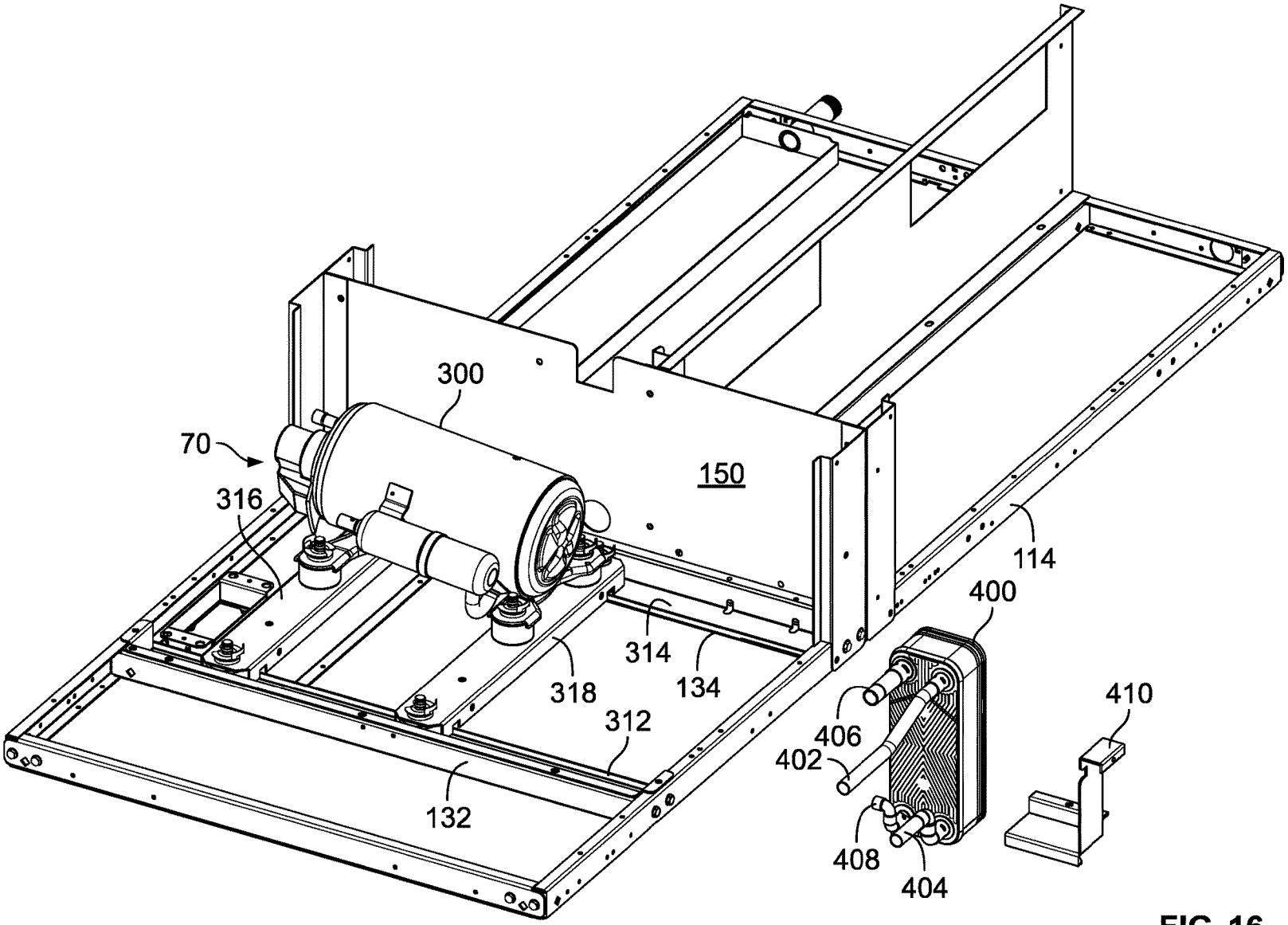
FIG. 16 depicts yet another step of the method for assembling the system of FIG. 1.

Returning to FIG. 15, heat pump system 5 includes a compressor 300 that is configured to be positioned within the compressor compartment 70 of cabinet 10 and coupled to the frame 100. The compressor 300 is coupled to compressor support rails 316, 318 that are spaced apart from and extend parallel to each other. The compressor 300 may be configured as a horizontal rotary compressor to permit the compressor to lay horizontally across support rails 316, 318 so as to minimize height of the overall heat pump system 5 , and particularly cabinet 10. As shown in FIG. 16, the compressor support rails 316, 318 are coupled to the compressor support rails 312, 314 via fasteners to couple the compressor 300 to the frame 100. When fastened together, the compressor support rails 316, 318 extend perpendicular to the compressor cross rails 312, 314. The compressor cross rails 312, 314 and the compressor support rails 316, 318 are arranged with respect to each other and the frame 100 in a manner that enables the compressor 300 to be securely fastened and supported by the frame 100 of the cabinet 10.

FIG. 16 further depicts a refrigerant-to-liquid source heat exchanger 400 of the heat pump system 5 and a support bracket 410 of the cabinet 10. In the illustrated example, the heat exchanger 400 is a brazed-plate heat exchanger, which not only possesses sufficient heat exchange capacity but is quite small so as to enable the low-height configuration of the cabinet 10. As will be discussed below, the use of a brazed-plate heat exchanger with small volumes for heat exchange may increase the chance for freezing of water or brine internally to the heat exchanger 400, which can result in significant damage to the unit. However, the risk of freezing can be minimized or eliminated using the freeze protection system and method disclosed herein. Turning again to FIG. 16, the heat exchanger 400 of this embodiment includes four ports 402, 404, 406, 408. The port 402 is an outlet port that is configured to return a liquid, such as water or brine, to a source after exchanging heat in the heat exchanger 400 with a refrigerant configured to circulate in a refrigerant circuit 650 as part of heat pump system 5. The port 404 is an inlet port that is configured to receive a liquid, such as water or brine, from a source. As disclosed in greater detail with respect to FIG. 51, the ports 406, 408 are fluidly connected to refrigerant conduit 600 of the refrigerant circuit 650 to convey refrigerant therethrough to and from various heat pump components to cool and/or heat air for a space.

Figure 17:
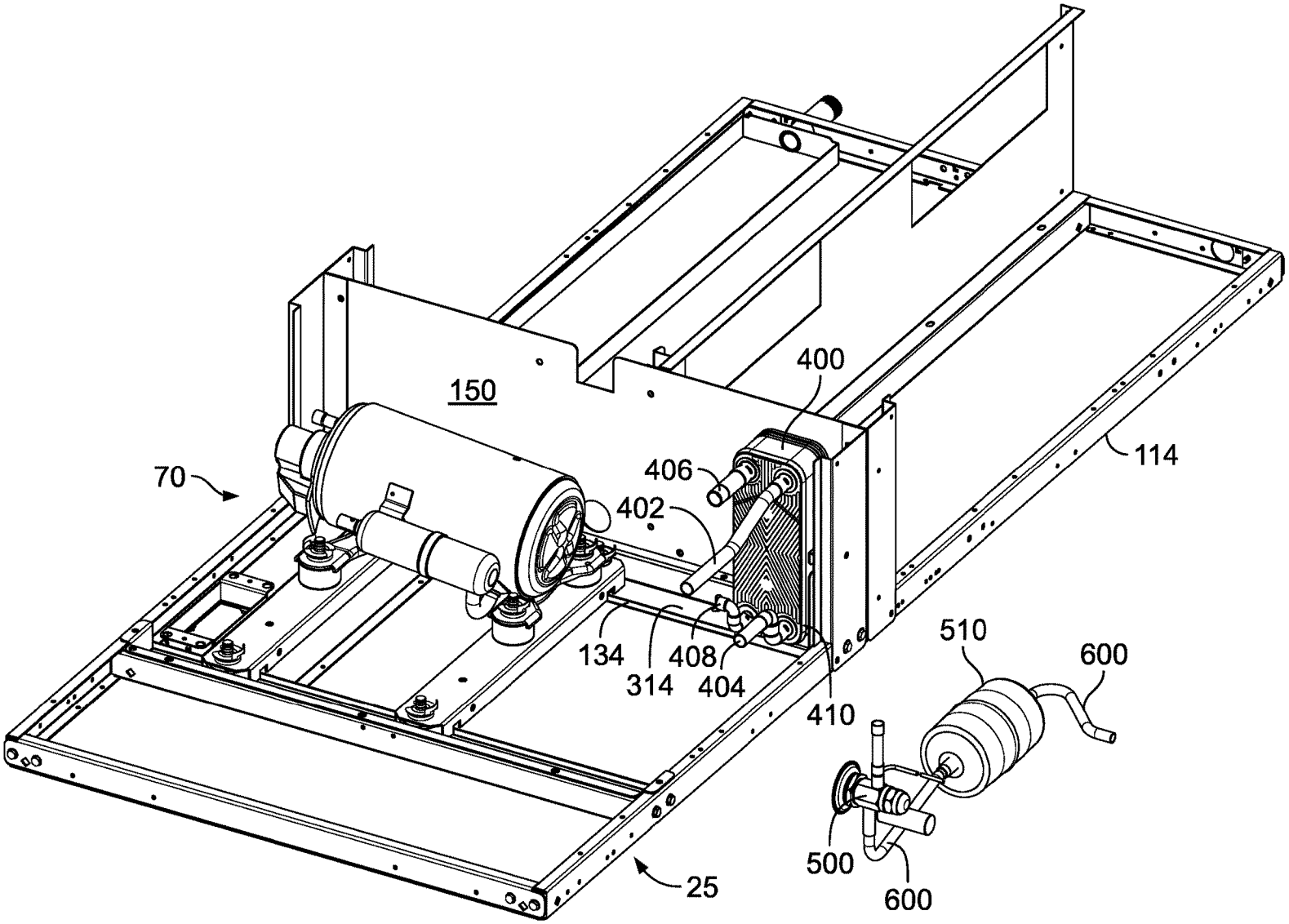
FIG. 17 depicts yet another step of the method for assembling the system of FIG. 1.

As shown in FIG. 17, the support bracket 410 is coupled to other portions of the cabinet 10 to enable the heat exchanger 400 to be secured in place. For example, the support bracket 410 is coupled to the side rail 114, the cross rail 134, the compressor cross rail 314, and/or the divider 150 (e.g., the mullion 154 of the divider 150) via fasteners. The heat exchanger 400, in turn, is coupled to the support bracket 410 via fasteners. Additionally or alternatively, the heat exchanger 400 may be coupled directly to the side rail 114, the cross rail 134, the compressor cross rail 314, and/or the divider 150 (e.g., the mullion 154 of the divider 150) via fasteners.

In the illustrated example, the heat exchanger 400 is installed vertically within the compressor compartment 70 of the cabinet 10. The inlet port 404 is positioned to be the lowest port of the heat exchanger 400 to avoid build-up of condensation within the heat exchanger 400 when the heat exchanger 400 is operating in condensing applications. The heat exchanger 400 of the illustrated example is sized to both (1) provide enough heat exchange capabilities to comfortably control the temperature of the space and (2) fit within the low-height profile of the cabinet 10.

Figure 18:
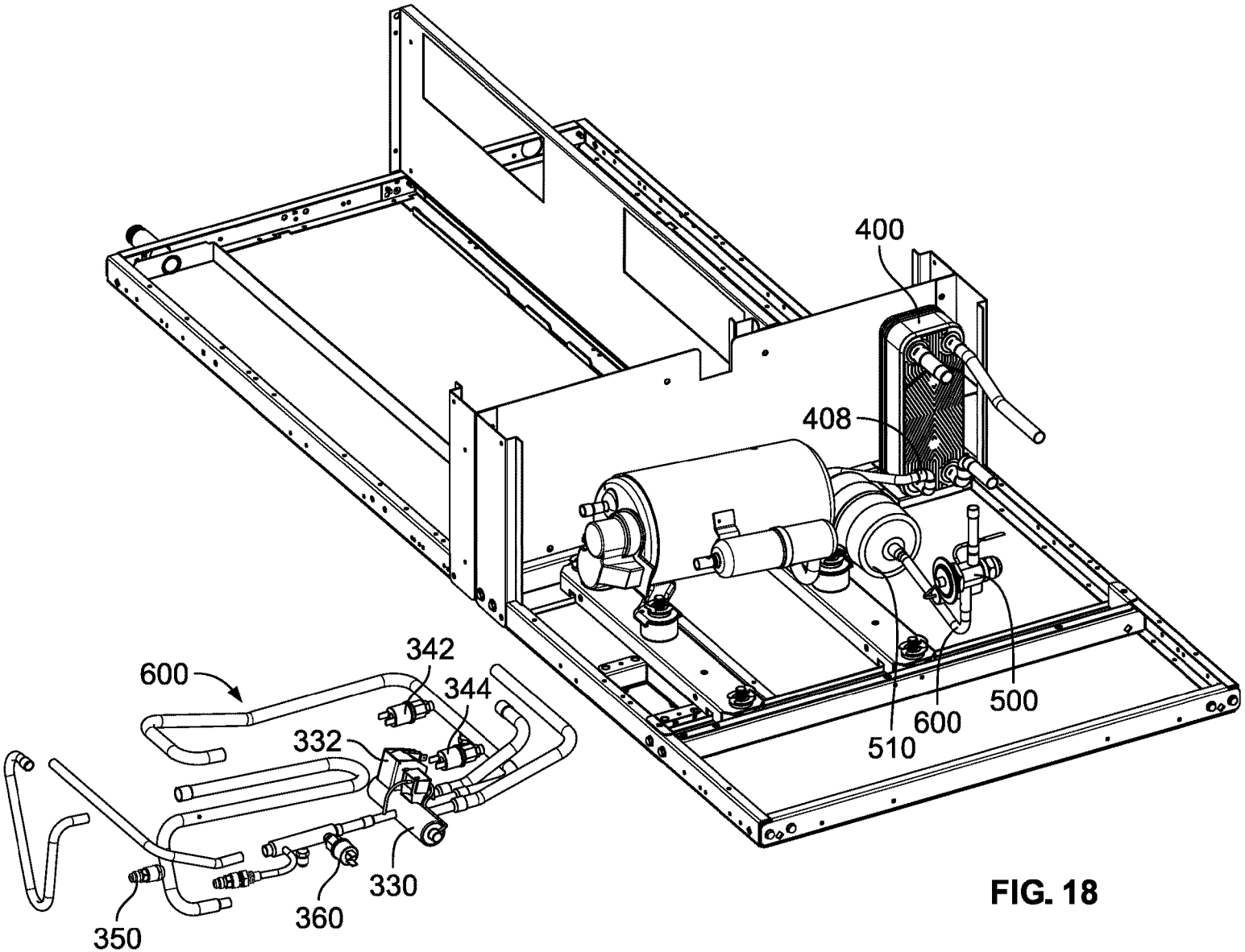
FIG. 18 depicts yet another step of the method for assembling the system of FIG. 1.

FIG. 17 further depicts an expansion valve 500 and a filter drier 510 of the heat pump system 5. The expansion valve 500 and the filter drier 510 are fluidly connected to each other via a portion of refrigerant conduit 600 of the heat pump system 5. As shown in FIG. 18, the filter drier 510 is fluidly connected to the port 408 via another portion of the refrigerant conduit 600. In other embodiments, the filter drier may be omitted or moved to a different location along refrigerant conduit 600.

FIG. 18 also depicts other portions of the refrigerant conduit 600 of heat pump system 5. A reversing valve 330, pressure switches 342, 344, a saddle seat 350, and a pressure switch 360 of the heat pump system 5 are connected to those portions of the refrigerant conduit 600. The reversing valve 330 includes a solenoid 332 that enables the reversing valve 330 to reverse the direction of fluid flow throughout portions of the heat pump system 5. As shown in FIG. 19, the portions of the refrigerant conduit 600 shown in in FIG. 19 are coupled to the compressor 300, the heat exchanger 400, the expansion valve 500, and the filter drier 510. In turn, the compressor 300, the heat exchanger 400, the expansion valve 500, the filter drier 510, the reversing valve 330, the pressure switches 342, 344, and the pressure switch 360 are fluidly connected to each other via the refrigerant conduit 600.

Figure 20:
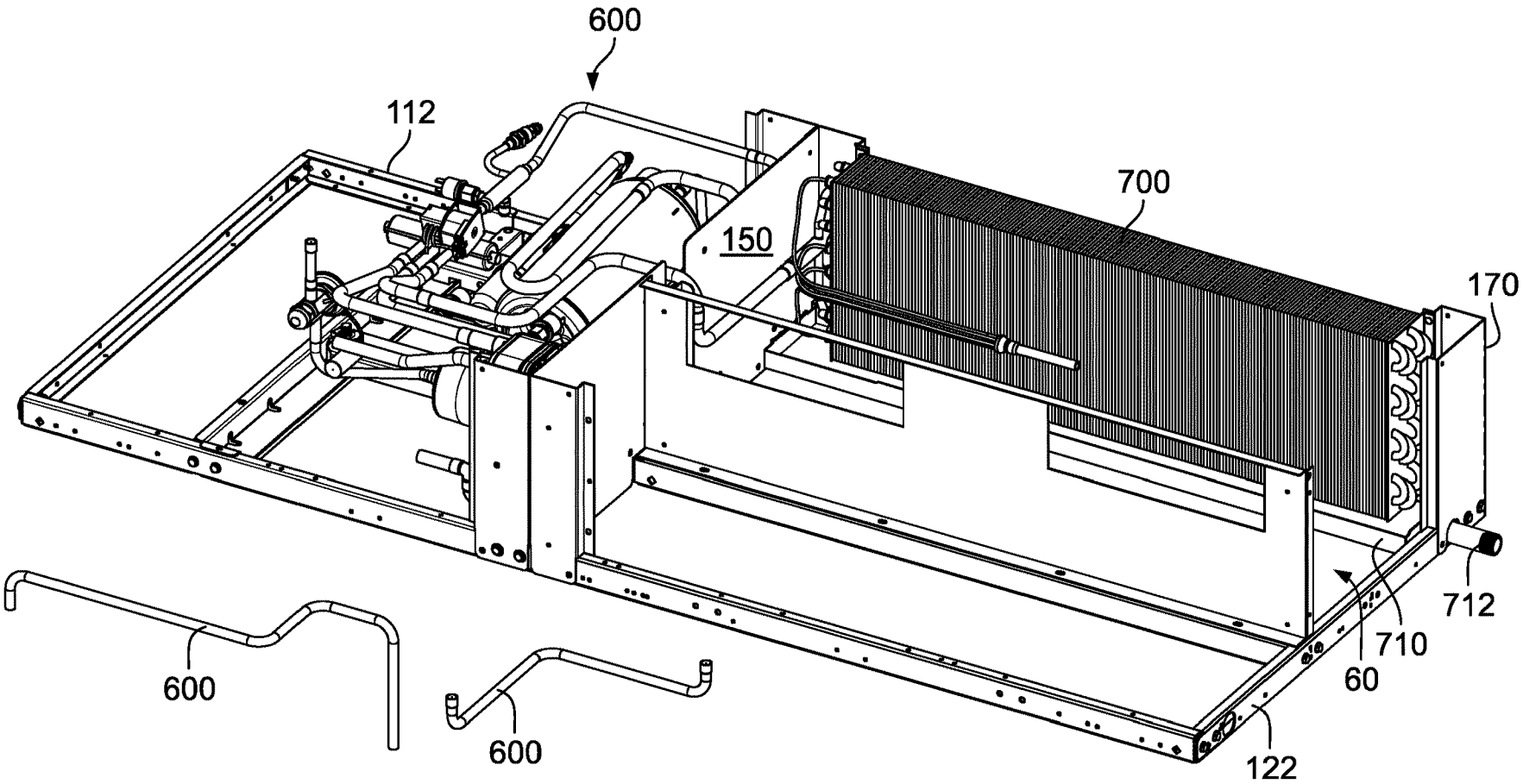
FIG. 20 depicts yet another step of the method for assembling the system of FIG. 1.

FIG. 19 further depicts the corner post 170, the air coil 700, a support bracket 720, and another portion of the refrigerant conduit 600 of the heat pump system 5. As shown in FIG. 20, the corner post 170 of the cabinet 10 is coupled to the side rail 112 and/or the end rail 122 via one or more fasteners. A bottom edge of the corner post 170 defines a hemispherical groove through which the outlet 712 of the drain pan 710 extends. In other examples, the corner post 170 may define a hole through which the outlet 712 of the drain pan 710 extends.

The support bracket 720 of the cabinet 10 is coupled to and extends along the side rail 112. The air coil 700 is positioned over the drain pan 710 such that condensation from the air coil 700 is safely collected within the drain pan 710 and removed from the cabinet 10 through the outlet 712. The air coil 700 is coupled to the side rail 112, the divider 150 (e.g., the mullion 152 of the divider 150), the corner post 170, and/or the support bracket 720 via one or more fasteners to securely position the air coil 700 in place within the blower compartment 60. The air coil 700 is fluidly connected to other components of the heat pump system 5 via the refrigerant conduit 600. FIG. 20 further depicts other portions of the refrigerant conduit 600 that is configured to fluidly connect the components of the heat pump system 5 together.

Figure 21:
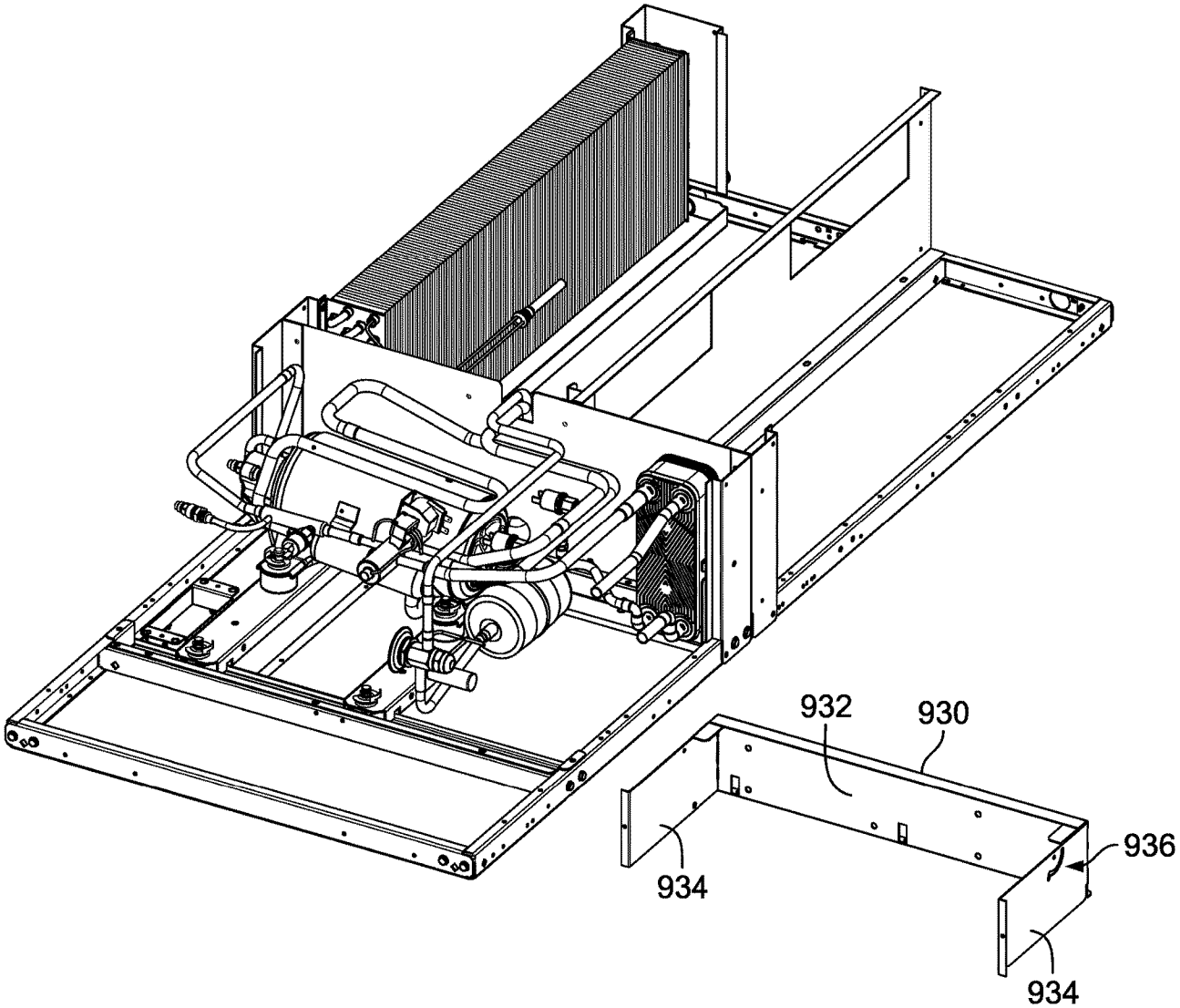
FIG. 21 depicts yet another step of the method for assembling the system of FIG. 1.
Figure 22:
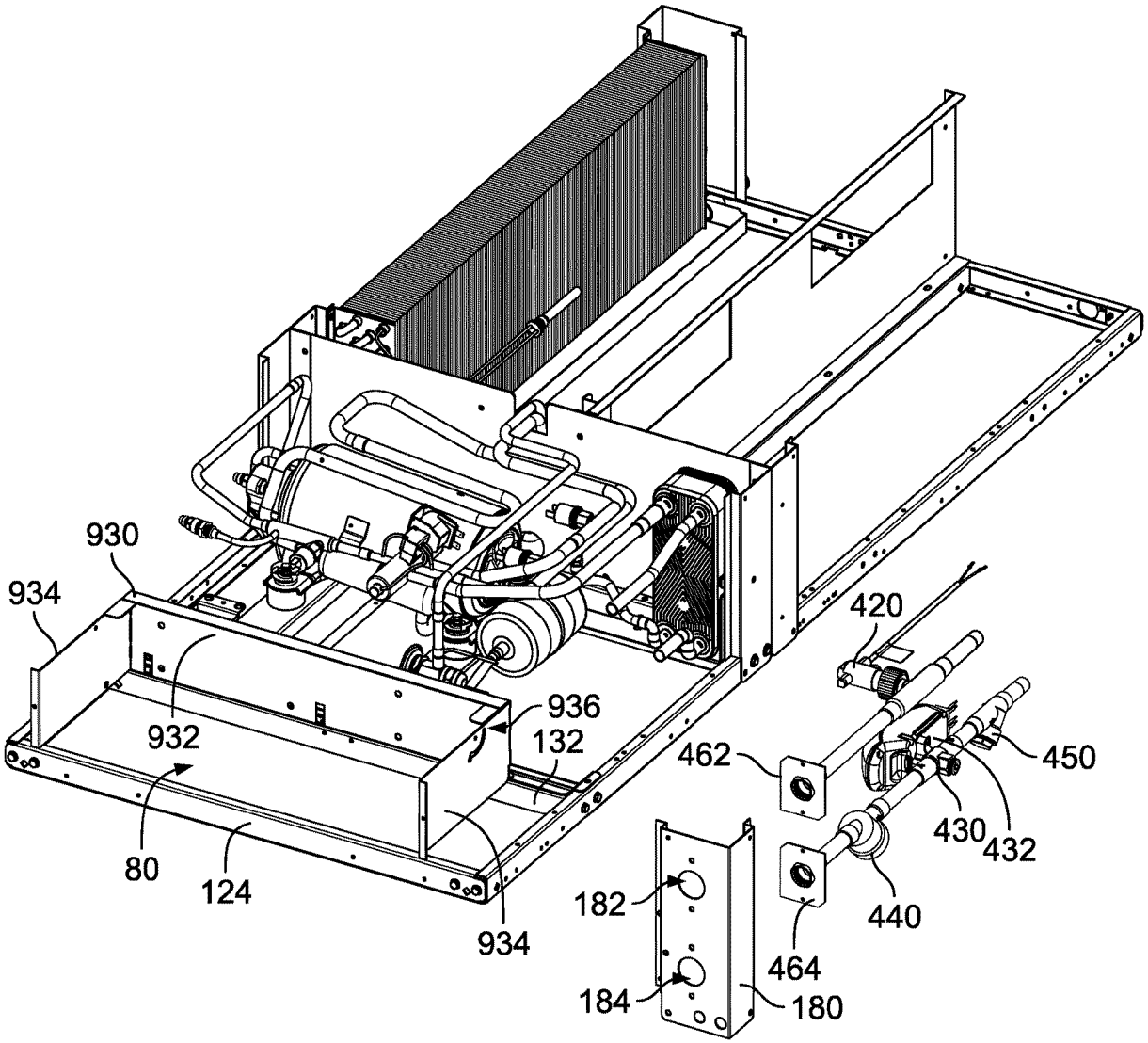
FIG. 22 depicts yet another step of the method for assembling the system of FIG. 1.

FIG. 21 depicts an electronics housing 930 of the cabinet 10 that is configured to at least partially define electronics compartment 80. In the illustrated example, the electronics housing 930 includes an integrally-formed U-shaped structure with a base panel 932 and two opposing arm panels 934. The arm panels 934 extend from and perpendicularly to the base panel 932. One of the arm panels 934 defines a curved slot 936 that, as disclosed in greater detail below, facilitates a control panel 910 in being securely positioned within and/or removed from the electronics compartment 80. As shown in FIG. 22, the base panel 932 of the electronics housing 930 is configured to extend along and coupled to (e.g., via fasteners) the cross rail 132. The arm panels 934 of the electronics housing 930 extend from the cross rail 132 and to the end rail 124. In some examples the arm panels 934 are coupled to the cross rail 132 and/or the end rail 124 via fasteners.

FIG. 22 also depicts the corner post 180 the cabinet 10. In the illustrated example, the corner post 180 defines an outlet opening 182 and an inlet opening 184. Additionally, FIG. 22 depicts a flow switch 420, a motorized valve 430 (also referred to as a "motorized water valve"), a strainer valve 440, a flow regulator valve 450, and plate fittings 462, 464 of the heat pump system 5. The motorized valve 430 includes an actuator 432 that is configured to control operation of the motorized valve 430 in a motorized manner. The flow switch 420 and the plate fitting 462 are fluidly connected to each other in series. The flow regulator valve 450, the motorized valve 430, the strainer valve 440, and the plate fitting 464 are fluidly connected to each other in series. In other examples, pump 470 may take the place the of the motorized valve 430 between the strainer valve 440 and the flow regulator valve 450.

Figure 23:
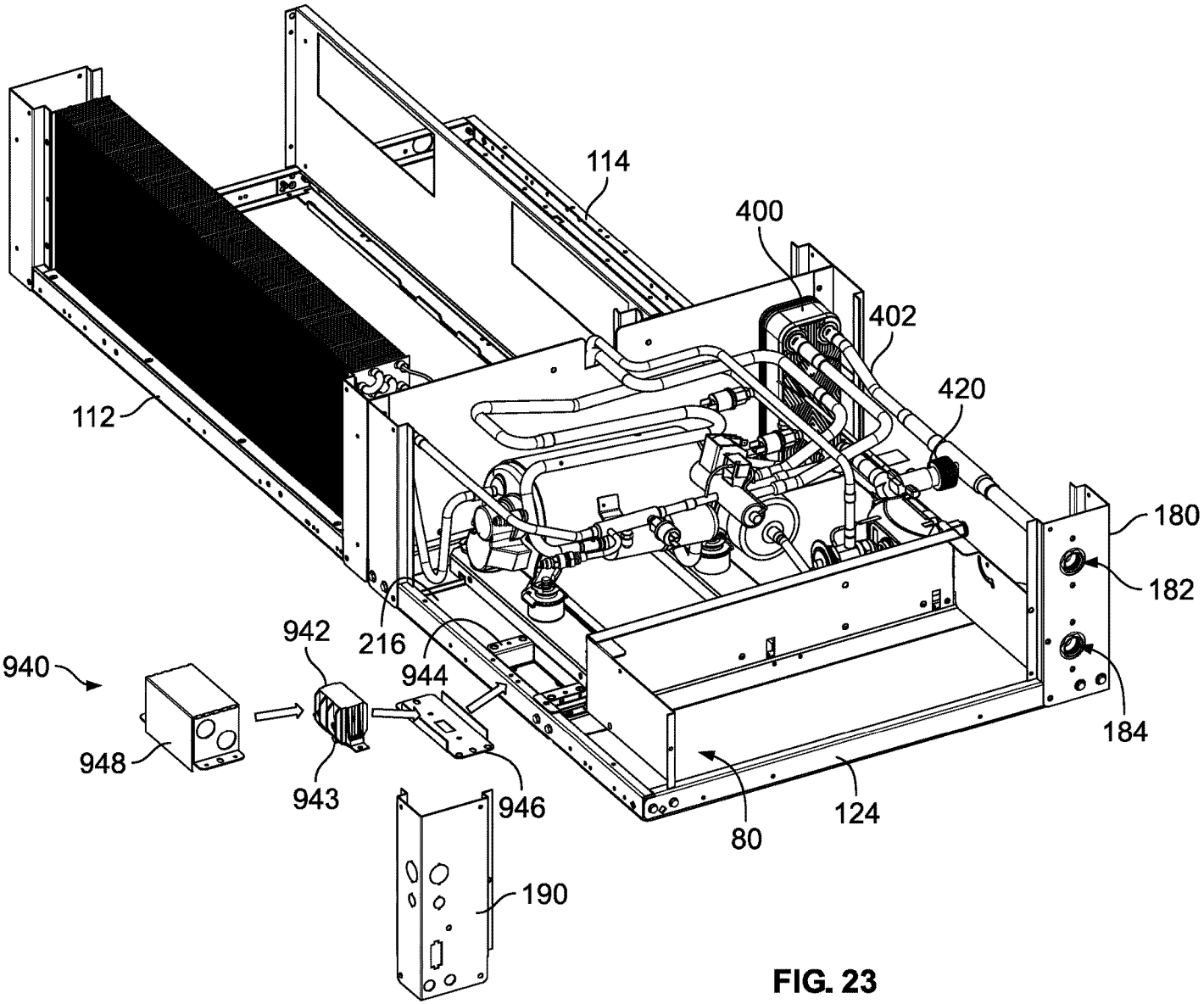
FIG. 23 depicts yet another step of the method for assembling the system of FIG. 1.

As shown in FIG. 23, the corner post 180 is coupled to the side rail 114 and/or the end rail 124 via one or more fasteners. The flow switch 420 is connected to the outlet port 402 of the heat exchanger 400. Further, the plate fitting 462 of the cabinet 10 is mounted to the corner post 180 adjacent the outlet opening 182. In turn, an outlet water leg is formed that fluidly connects the outlet port 402 to the outlet opening 182 of the cabinet 10 with the flow switch 420 positioned along the outlet water leg. The flow regulator valve 450 is connected to the inlet port 404 of the heat exchanger 400. In turn, an inlet water leg is formed that fluidly connects the inlet port 404 to the inlet opening 184 of the cabinet 10 with the flow regulator valve 450, the motorized valve 430, the strainer valve 440, and the plate fitting 464 positioned along the inlet water leg. The plate fitting 464 of the cabinet 10 is mounted to the corner post 180 adjacent the inlet opening 184 so that the inlet port 404 of the heat exchanger 400 is fluidly connected to the inlet opening 184 of the cabinet 10.

Figure 24:
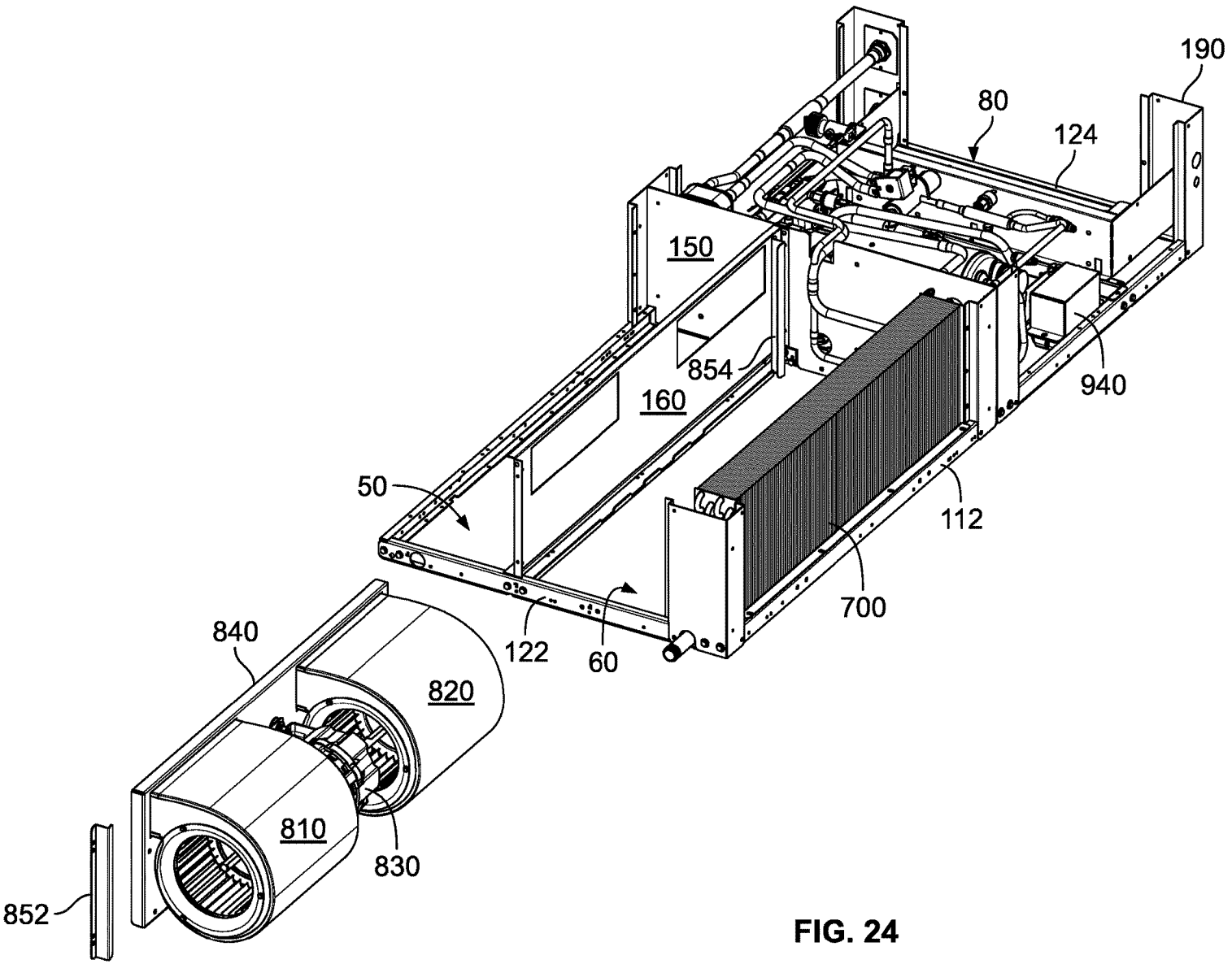
FIG. 24 depicts yet another step of the method for assembling the system of FIG. 1.

FIG. 23 further depicts another corner post 190 and a disconnect switchbox 940. The disconnect switchbox 940 includes a switch body 942, a switch 943 extending from the switch body 942, a front housing 944, a cover 946, and a rear housing 948. As shown in FIG. 24, the corner post 190 of the cabinet 10 is coupled to the side rail 112 and/or the end rail 124 via one or more fasteners. The disconnect switchbox 940 is securely coupled to the bottom panel 216 adjacent the electronics compartment 80.

As shown in FIG. 12, the front housing 944 is previously coupled to an inner surface of the bottom panel 216. To complete the assembly and installation of the disconnect switchbox 940 as shown FIG. 24, the cover 946 is positioned within the front housing 944. The switch body 942 is then positioned on the cover 946 such that the switch 943 extends through a switch opening 947 defined by the front housing 944 and the cover 946. The rear housing 948 is positioned over the front housing 944 such that the cover 946 and the switch body 942 are enclosed by the front and rear housings 944, 948. Additionally, the switch body 942, the front housing 944, the cover 946, and the rear housing 948 are coupled together via one or more fasteners. Switchbox 940 enables the switch 943 to lie within a recessed portion defined by front housing 944 (FIG. 45) so as to protect switch 943 from damage and/or unintended activation or deactivation.

Figure 25:
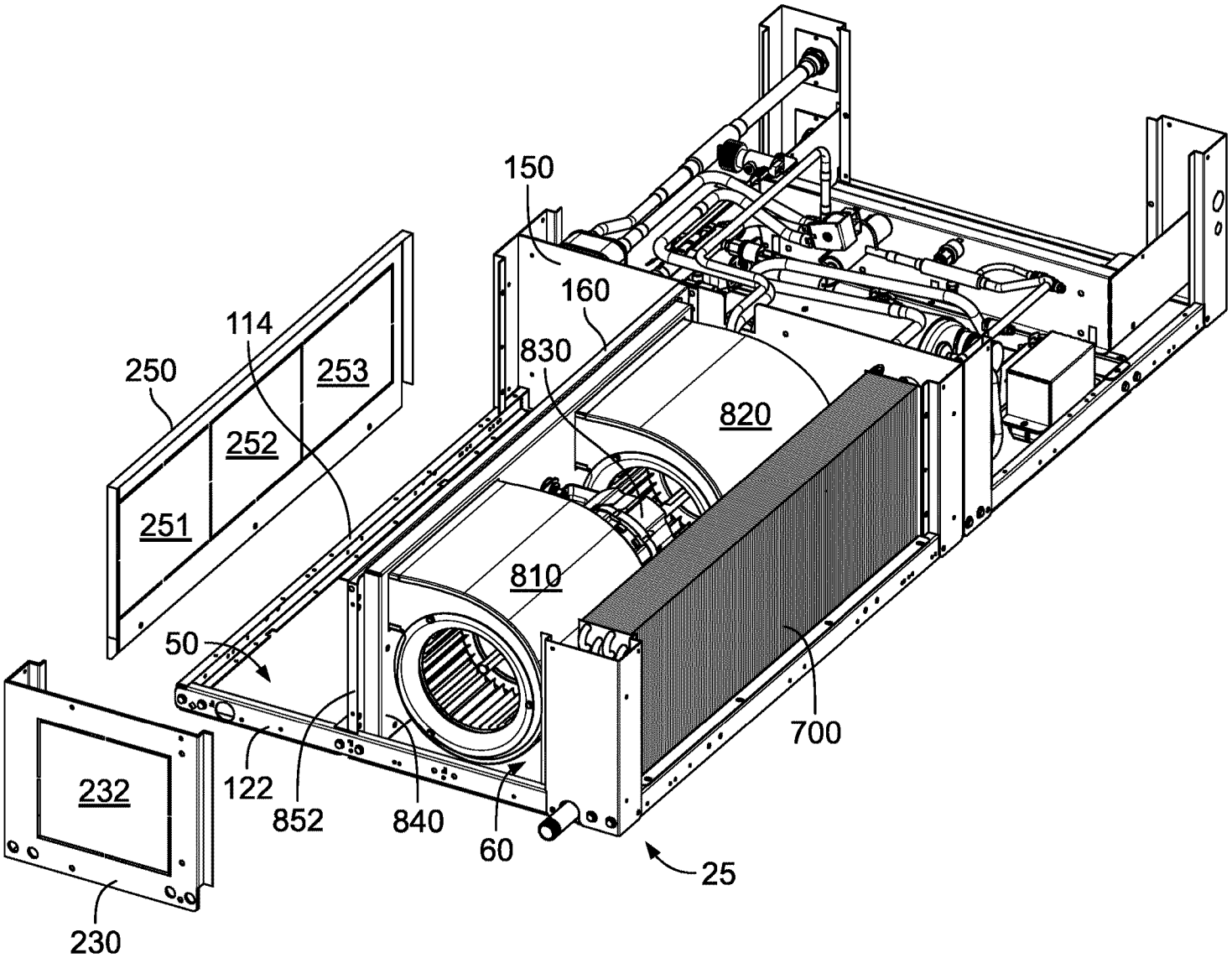
FIG. 25 depicts yet another step of the method for assembling the system of FIG. 1.

FIG. 24 further depicts a blower assembly of the heat pump system 5. The blower assembly includes blowers 810, 820, a blower motor 830, a blower panel 840, a slider bracket 852, and the slider bracket 854. The blowers 810, 820 and the blower motor 830 are mounted to the blower panel 840. As shown in FIG. 25, the blower assembly is housed within the blower compartment 60 adjacent the air coil 700. The slider bracket 852 is coupled to one end of the divider 160 adjacent the end rail 122 via one or more fasteners, and the slider bracket 854 is coupled to an opposing end of the divider 160 adjacent the divider 150 via one or more fasteners. The slider brackets 852, 854 are positioned vertically such that the slider brackets 852, 854 extend in a direction toward the bottom side 25 of the cabinet 10. The blower panel 840 is slidably mounted to the slider brackets 852, 854 such that the blower panel 840 is positioned vertically within the blower compartment 60 of the cabinet 10. As disclosed below in greater detail, the sliding configuration of the blower assembly facilitates a technician in easily accessing the blowers 810, 820 and the blower motor 830 from below when the cabinet 10 is installed to a ceiling surface.

Figure 26:
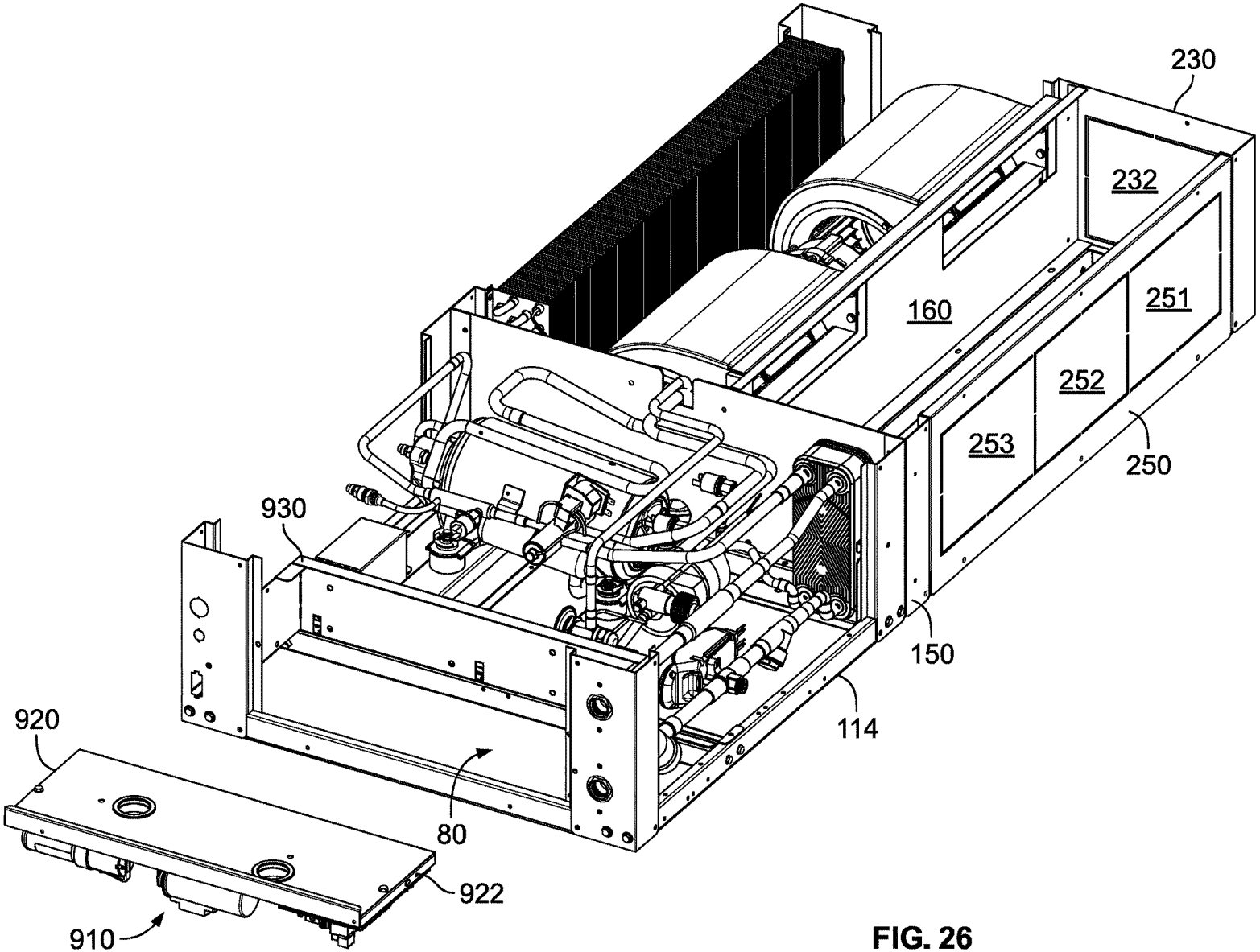
FIG. 26 depicts yet another step of the method for assembling the system of FIG. 1.

FIG. 25 further depicts the end panel 230 and the side panel 250 each of which is a discharge panel that includes one or more duct panels. The end panel 230 includes the duct panel 232, and the side panel 250 includes the duct panels 251, 252, 253. As shown in FIG. 26, the end panel 230 is coupled to the end rail 122, the side rail 114, and/or the divider 160 via one or more fasteners. The side panel 250 is coupled to the side rail 114, and/or the divider 150 (e.g., the mullion 154 of the divider 150) via one or more fasteners.

Figure 52:
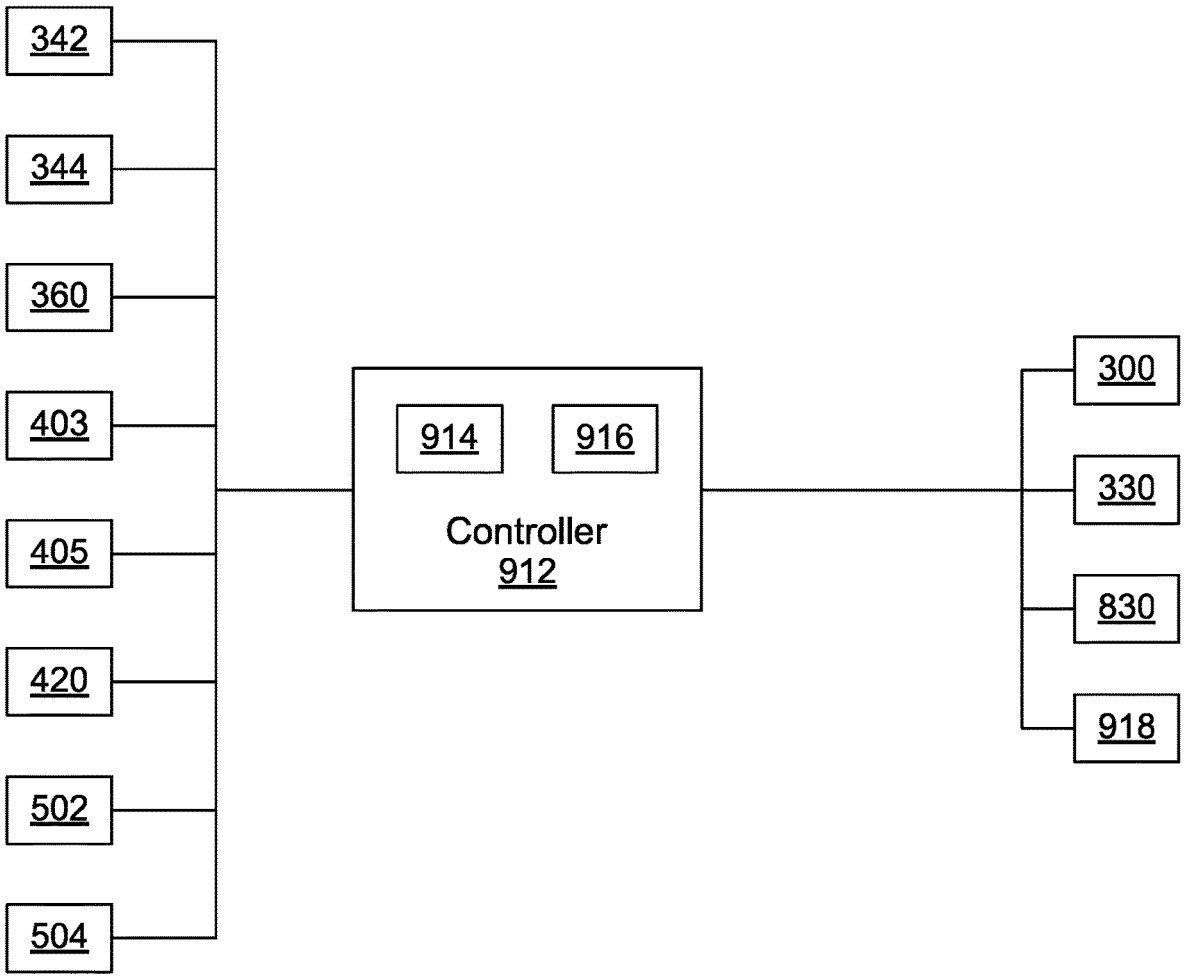
FIG. 52 is a block diagram depicting electrical components associated with one or more embodiments of the instant disclosure.

FIG. 26 further depicts a control panel 910 and a cover panel 920 of the heat pump system 5. The control panel 910 includes an electrical circuit with a plurality of electrical components that are configured to control operation of the heat pump system 5 . For example, the control panel 910 includes a controller 912 (FIG. 30) that is communicatively coupled (e.g., via wires) to a plurality of components used to control operation of the heat pump system 5. In some examples, the controller 912 is a control board. Further, in some examples, the controller 912 includes a processor 914 and memory 916 (FIG. 52). Example components communicatively connected to the controller 912 include an inlet-side water temperature sensor 403, an outlet-side water temperature sensor 405, a first low temperature sensor 502, a second low temperature sensor 504, the pressure switch 342 (also referred to as a first low pressure switch), the pressure switch 344 (also referred to as a second low pressure switch), the pressure switch 360 (also referred to as a high pressure switch), and the flow switch 420.

Figure 27:
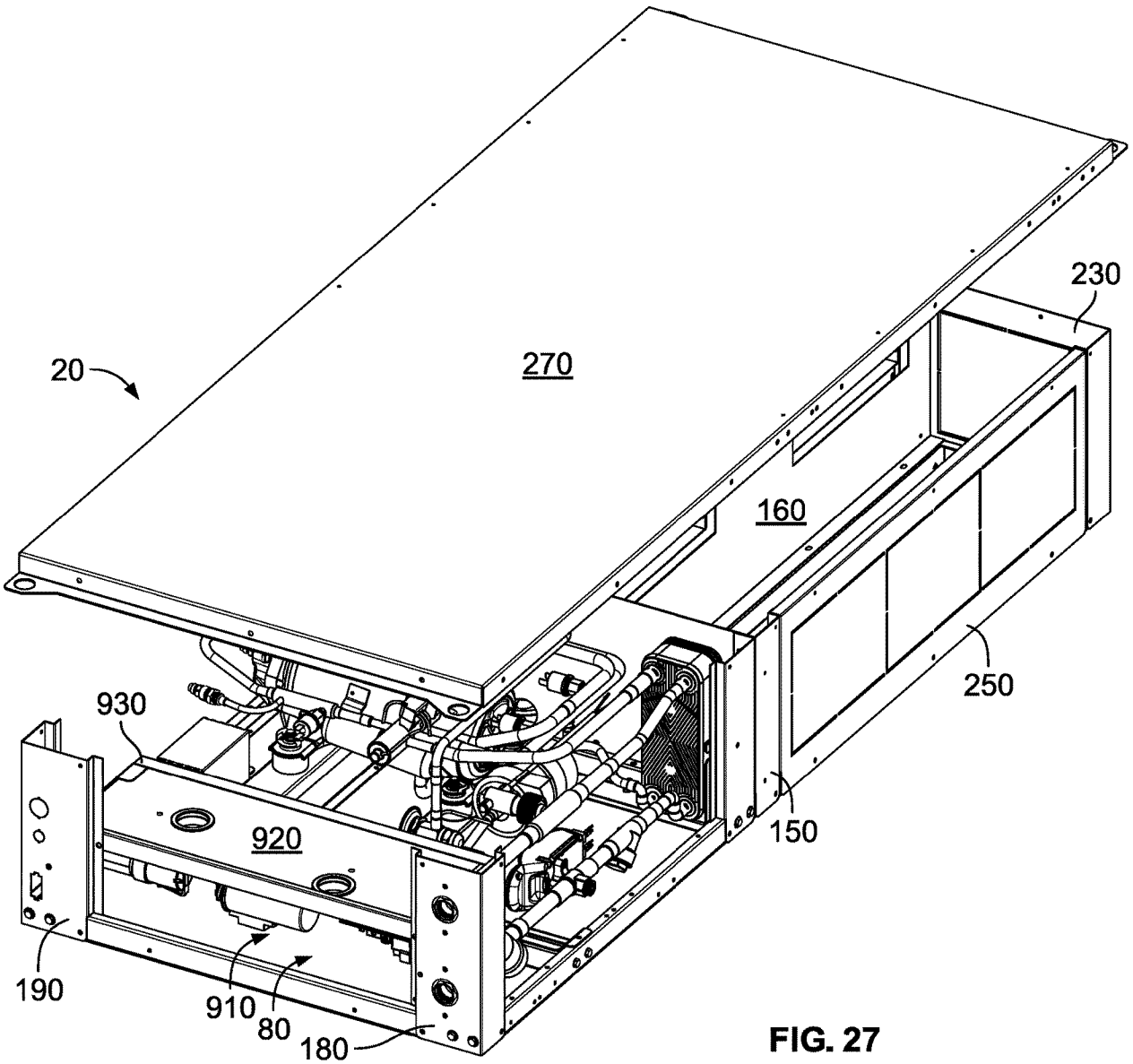
FIG. 27 depicts yet another step of the method for assembling the system of FIG. 1.

The control panel 910 is coupled to an underside of the cover panel 920 such that the cover panel 920 covers the control panel 910 when coupled to the electronics housing 930 within the electronics compartment 80 of the cabinet 10. The cover panel 920 is configured to cover fasteners (e.g., screws) that mount the electrical components to the control panel 910. The cover panel 920 includes a pin 922 that is configured to facilitate a technician in coupling the control panel 910 to the electronics housing 930 and/or decoupling the control panel 910 from the electronics housing 930. The pin 922 is configured to be slidably received by the curved slot 936 of the electronics housing 930 to facilitate the technician in securely positioning the control panel 910 within the electronics housing 930 and/or removing the control panel 910 from the electronics housing 930. FIG. 27 depicts the control panel 910 and the cover panel 920 when the cover panel 920 is coupled to the electronics housing 930 via the pin 922 and the curved slot 936.

Figure 28:
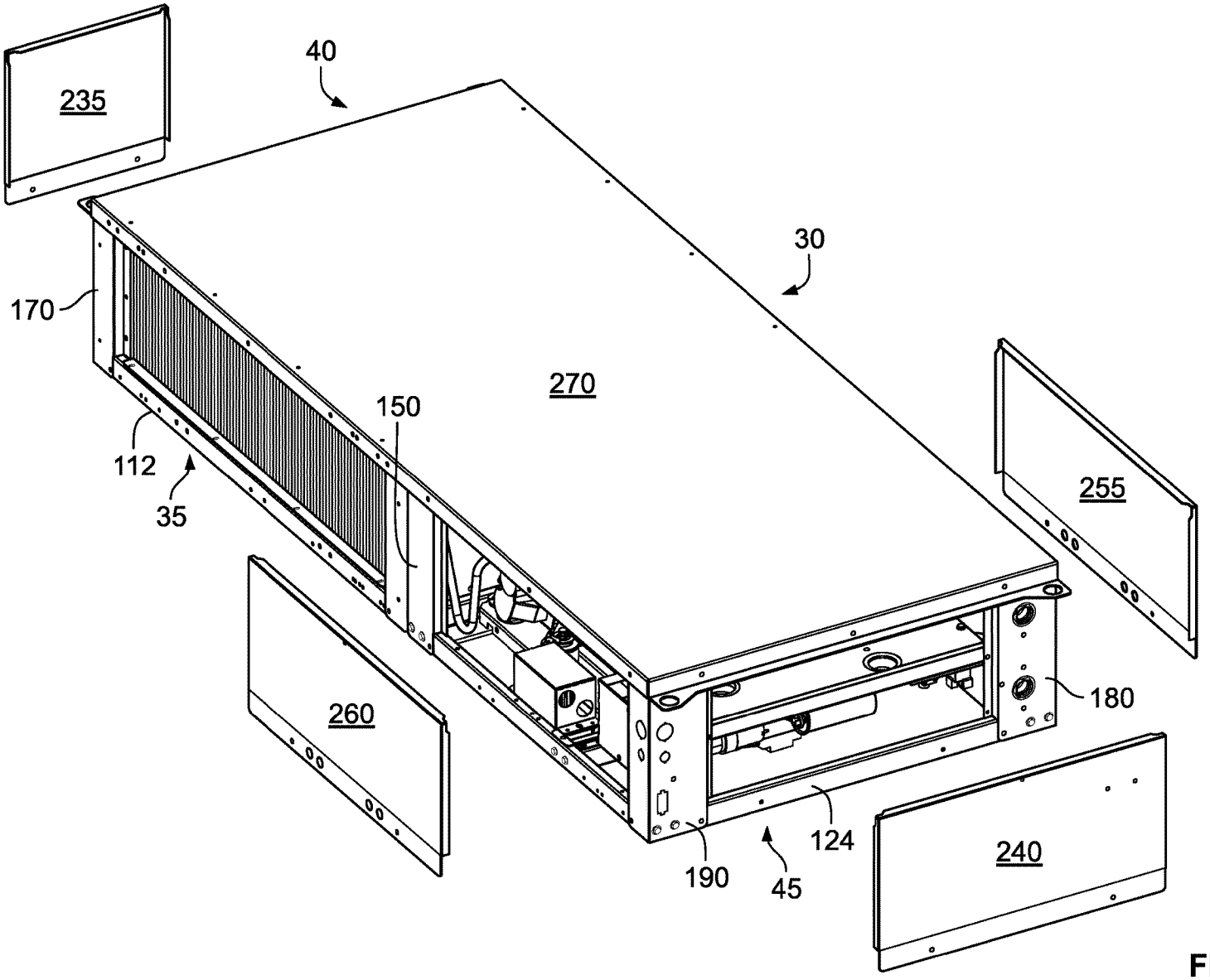
FIG. 28 depicts yet another step of the method for assembling the system of FIG. 1.

FIG. 27 further depicts the top panel 270 that is to be secured along the top side 20 of the cabinet 10. As illustrated in FIG. 28, the top panel 270 includes downwardly-extending side and end flanges that are configured to be coupled to the divider 150 (e.g., the mullions 152, 154 of the divider 150), the divider 160, the corner post 170, the corner post 180, the corner post 190, the end panel 230, and/or the side panel 250 via one or more fasteners (e.g., threaded fasteners).

FIG. 28 depicts the end panels 235, 240 and the side panels 255, 260 that are coupled to the first and second ends 40, 45 and the first and second sides 30, 35, respectively. The end panels 235, 240 and the side panels 255, 260 are access panels that are configured to facilitate a technician in easily accessing components of the heat pump system 5 housed within the cabinet 10. For example, the end panel 235 is configured to be coupled to the end rail 122, the divider 160, the corner post 170, and/or the top panel 270 via one or more fasteners (e.g., threaded fasteners). The end panel 240 is configured to be coupled to the end rail 124, the corner post 180, the corner post 190, and/or the top panel 270 via one or more fasteners (e.g., threaded fasteners). The side panel 255 is configured to be coupled to the side rail 114, the divider 150 (e.g., the mullion 154 of the divider 150), the corner post 180, and/or the top panel 270 via one or more fasteners (e.g., threaded fasteners). The side panel 260 is configured to be coupled to the side rail 112, the divider 150 (e.g., the mullion 152 of the divider 150), the corner post 190, and/or the top panel 270 via one or more fasteners (e.g., threaded fasteners). In the illustrated example, each of the end panels 235, 240 and the side panels 255, 260 includes side and top guide flanges that facilitate a technician in positioning the end panels 235, 240 and the side panels 255, 260 in place.

Figure 29A:
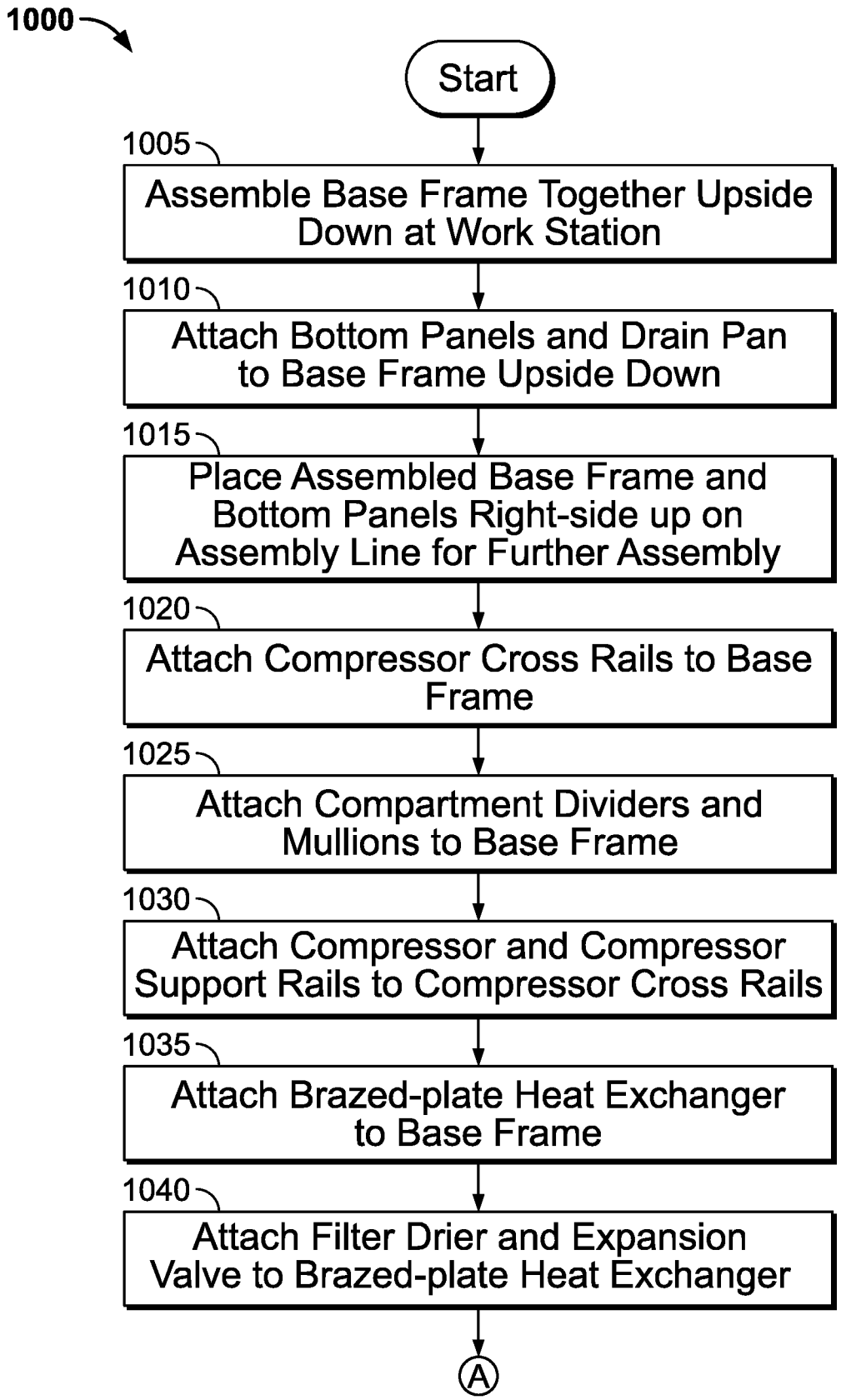
FIGS. 29A-29C depict an example flowchart of the instant disclosure for assembling the system of FIG. 1.
Figure 29B:
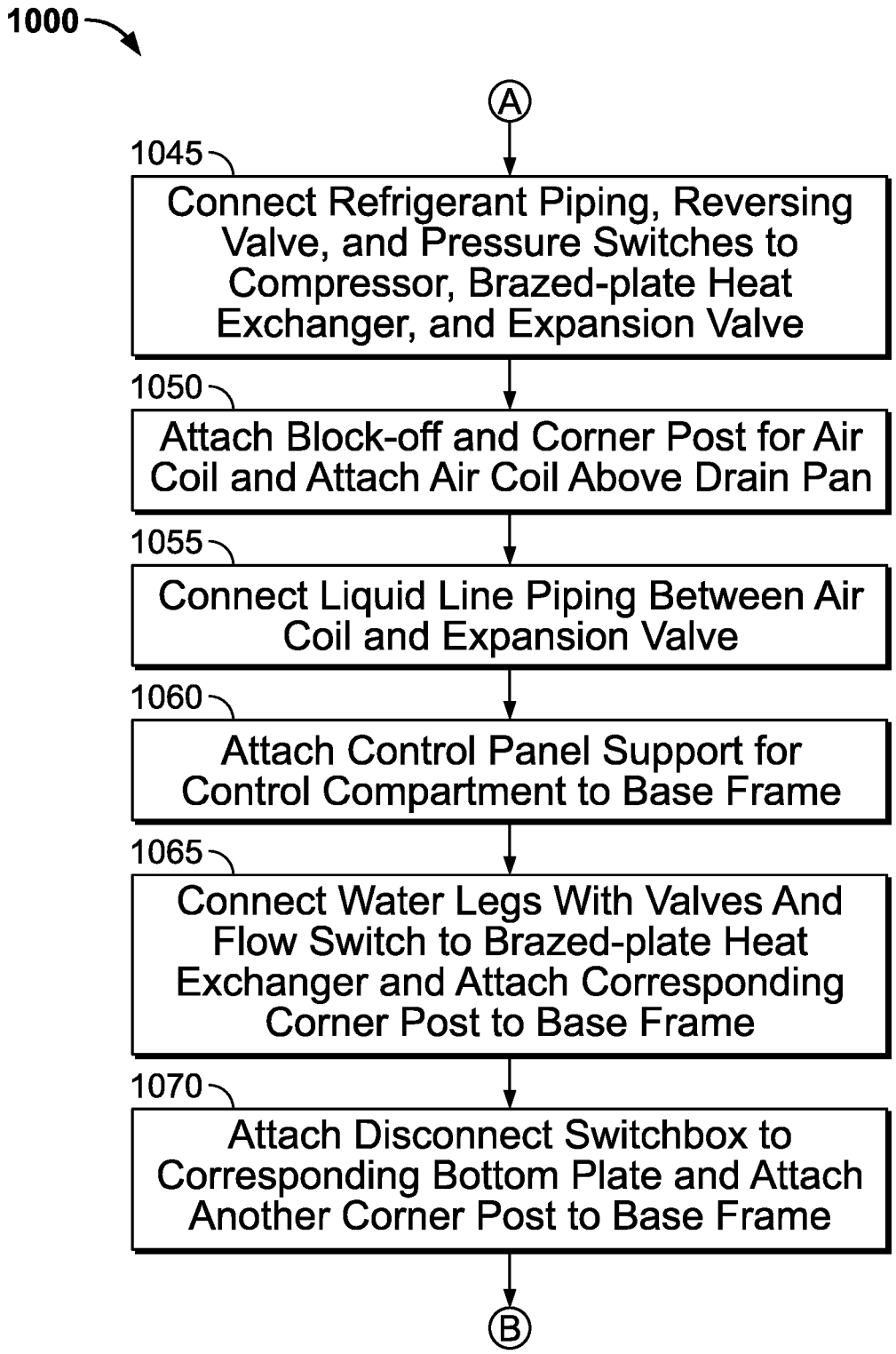
Figure 29C:
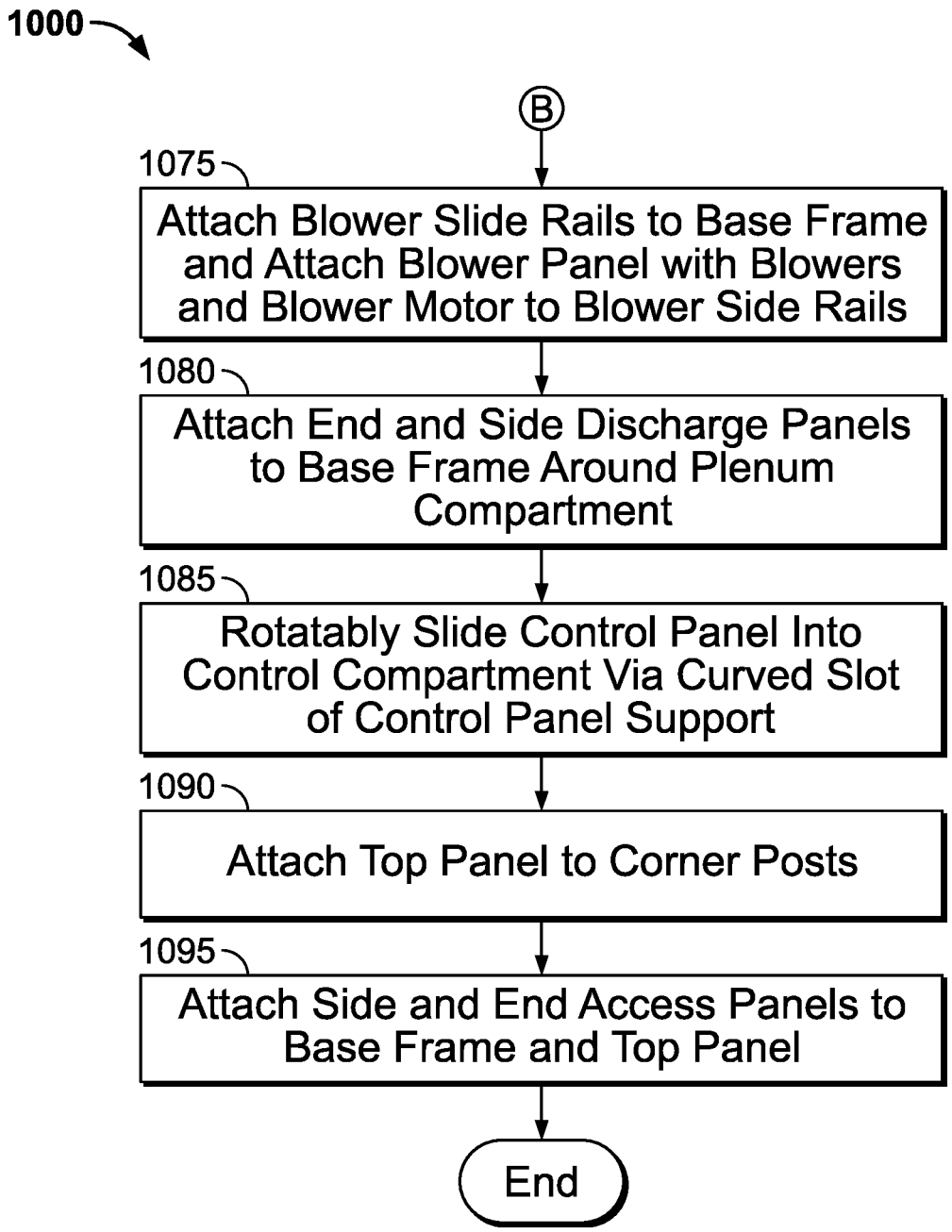

FIGS. 29A-29C depict a flowchart of an example method 1000 to assembled the heat pump system 5 disclosed herein. While the example method 1000 is described with reference to the flowchart illustrated in FIGS. 29A-29C, many other methods of assembling the heat pump system 5 may alternatively be used. For example, the order of execution of the blocks may be rearranged, changed, eliminated, and/or combined to perform the method 1000. Further, because the method 1000 is disclosed in connection with the components of FIGS. 1-28, some functions of those components will not be described in detail below.

Initially, at block 1005, a base of the frame is assembled together at a workstation in an upside down configuration.

For example, the side rails 112, 114, the end rails 122, 124, and the cross rails 132, 134, 136 are coupled together to form the base of the frame 100. At block 1010, the drain pan 710 and the bottom panels 212, 214, 216, 218, 220 are attached to the base of the frame 100 in an upside-down configuration. At block 1015, the base of the frame 100, the drain pan 710, and the bottom panels 212, 214, 216, 218, 220 are rotated right-side up and positioned on an assembly line for further assembly.

At block 1020, the compressor cross rails 312, 314 are attached to the side rails 112, 114 of the base of the frame 100. The compressor cross rail 312 is positioned to extend along and rest on the cross rail 132, and the compressor cross rail 314 is positioned to extend along and rest on the cross rail 134. At block 1025, the divider 150, including the mullions 152, 154, and the divider 160 are attached to the base of the frame 100. For example, the divider 150 is positioned to extend between the side rails 112, 114 and along the cross rail 134, and the divider 160 is positioned to extend along the cross rail 136 and between the end rail 122 and the divider 150. The divider 150 is coupled to the cross rail 134, the side rail 112, and/or the side rail 114. The divider 160 is coupled to the end rail 122, the cross rail 134, the cross rail 136, and/or the divider 150.

At block 1030, the compressor support rails 316, 318 are attached to the compressor cross rails 312, 314, for example, in a perpendicular manner. The compressor 300 is previously coupled to the compressor support rails 316, 318 such that coupling the compressor support rails 316, 318 to the compressor cross rails 312, 314 results in the compressor 300 being coupled to the base of the frame 100. At block 1035, the heat exchanger 400 is attached to the base of the frame 100 via the support bracket 410. For example, the heat exchanger 400 is a brazed-plate heat exchanger that is coupled to the frame 100 in an upright or vertical manner. At block 1040, the expansion valve 500 and the filter drier 510 are attached to the heat exchanger 400 via a portion of the refrigerant conduit 600. At block 1045, the reversing valve 330, the pressure switches 342, 344, the pressure switch 360, the compressor 300, the heat exchanger 400, the expansion valve 500, and the filter drier 510 are fluidly connected to each other via portions of the refrigerant conduit 600.

At block 1050, the support bracket 720 for the air coil 700 and the corner post 170 are attached to the base of the frame 100. For example, the support bracket 720 is coupled to and extends along the side rail 112, and the corner post 170 is coupled to the side rail 112 and/or the end rail 122. Additionally, the air coil 700 is attached to the support bracket 720, the side rail 112, the divider 150 (e.g., the mullion 152 of the divider 150), and/or the corner post 170 so that the air coil 700 is positioned above the drain pan 710. At block 1055, the air coil 700 is fluidly connected to other components of the heat pump system 5, such as the expansion valve 500, via portions of the refrigerant conduit 600.

At block 1060, the electronics housing 930 is coupled to the base of the frame 100. For example, the base panel 932 of the electronics housing 930 is coupled to and extends along the cross rail 132, and the arm panels 934 of the electronics housing 930 extend between the cross rail 132 and the end rail 124 of the frame 100.

At block 1065, the corner post 180 is attached to the base of the frame 100 and water legs are connected to the heat exchanger 400. For example, the is coupled to the side rail 114 and/or the end rail 124 of the frame 100. The inlet water leg is assembled that extends between the inlet port 404 of the heat exchanger 400 and the inlet opening 184 defined by the corner post 180. The flow regulator valve 450, the motorized valve 430, and the strainer valve 440 are positioned along the inlet water leg. The outlet water leg is assembled that extends between the outlet port 402 of the heat exchanger 400 and the outlet opening 182 defined by the corner post 180. The flow switch 420 is positioned along the outlet water leg.

At block 1070, the corner post 190 is attached to the base of the frame 100, and the disconnect switchbox 940 is assembled on the bottom panel 216. For example, the corner post 190 is coupled to the side rail 112 and/or the end rail 124 of the frame 100. To assemble the disconnect switchbox 940, (1) the cover 946 is positioned within the front housing 944, (2) the switch body 942 is positioned on the cover 946 such that the switch 943 extends through the switch opening 947, (3) the rear housing 948 is positioned over the front housing 944 to enclose the cover 946 and the switch body 942 within the front and rear housings 944, 948, and (4) the switch body 942, the front housing 944, the cover 946, and the rear housing 948 are fastened together.

At block 1075, the blowers 810, 820 and the blower motor 830 are securely and slidably positioned within the blower compartment 60 of the cabinet 10. For example, the blowers 810, 820 and the blower motor 830 are mounted to the blower panel 840. The slider brackets 852, 854 are fastened in a vertical manner to opposing ends of the divider 160. The blower panel 840 is then slidably mounted to the slider brackets 852, 854 such that the blower panel 840 is positioned vertically within the blower compartment 60.

At block 1080, the discharge panels, including the end panel 230 and the side panel 250, are coupled to the frame 100 around the plenum compartment 50. For example, the end panel 230 is coupled to the end rail 122, the side rail 114, and/or the divider 160. The side panel 250 is coupled to the side rail 114 and/or the divider 150 (e.g., the mullion 154 of the divider 150).

At block 1085, the control panel 910 is securely positioned within the electronics compartment 80 of the cabinet 10. For example, the control panel 910 is mounted to the cover panel 920. The cover panel 920 include the pin 922 that is slidably received by the curved slot 936 of the electronics housing 930 to securely position the control panel 910 within the electronics compartment 80.

At block 1090, the top panel 270 is attached along the top side 20 of the cabinet 10. For example, the top panel 270 is coupled to the divider 150 (e.g., the mullions 152, 154 of the divider 150), the divider 160, the corner post 170, the corner post 180, the corner post 190, the end panel 235, and/or the side panel 250. At block 1095, the access panels, including the end panels 235, 240 and the side panels 255, 260, are attached to the frame 100 and/or the top panel 270 of the cabinet 10. For example, the end panel 235 is coupled to the end rail 122, the divider 160, the corner post 180, and/or the top panel 270. The end panel 240 is coupled to the end rail 124, the corner post 180, the corner post 180, and/or the top panel 270. The side panel 255 is coupled to the side rail 114, the divider 150 (e.g., the mullion 154 of the divider 150), the corner post 180, and/or the top panel 270. The side panel 260 is coupled to the side rail 114, the divider 150 (e.g., the mullion 152 of the divider 150), the corner post 190, and/or the top panel 270.

Figure 30:
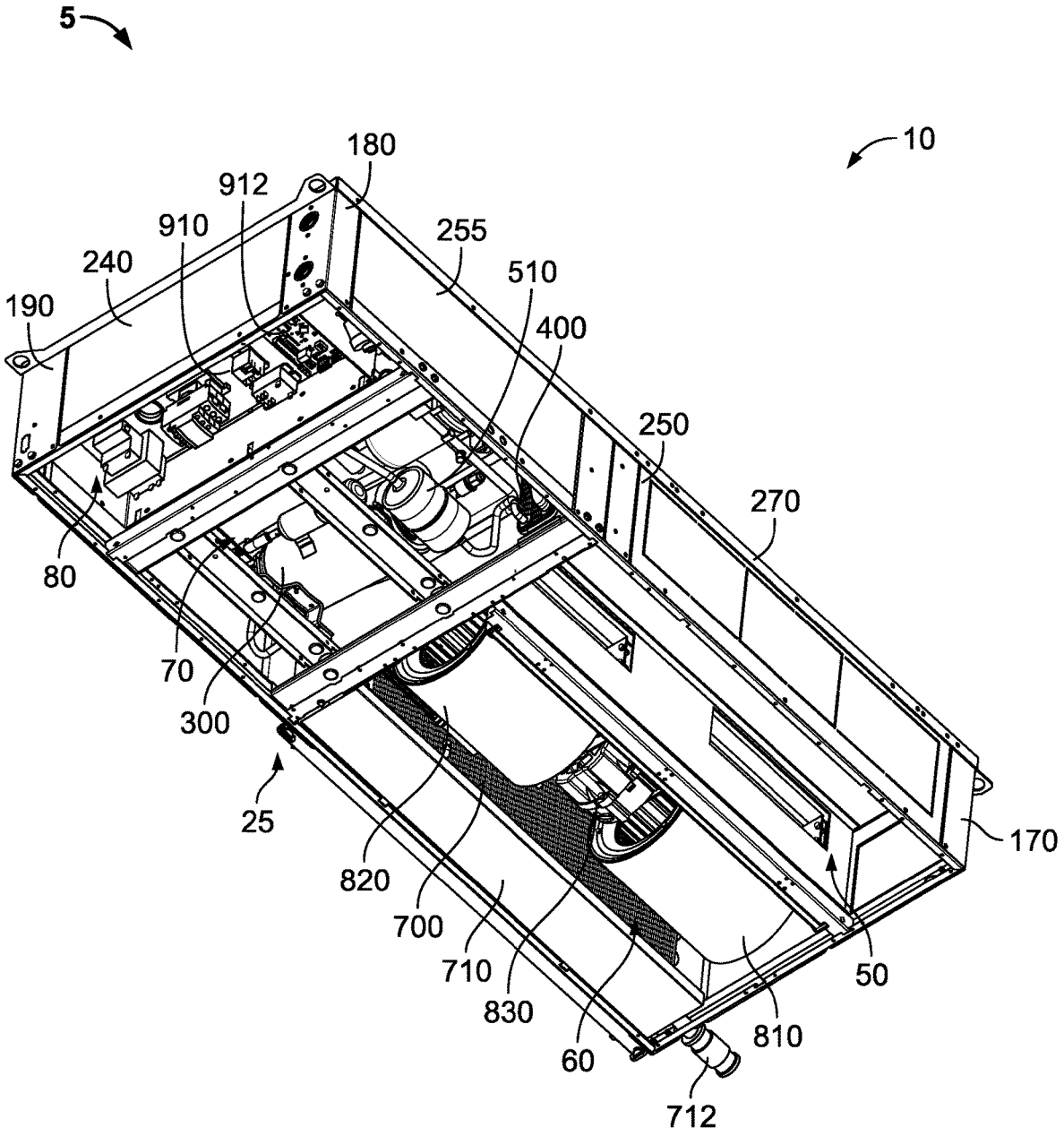
FIG. 30 is another perspective view of the system of FIG. 1 with bottom panels of the cabinet removed.
Figure 31:
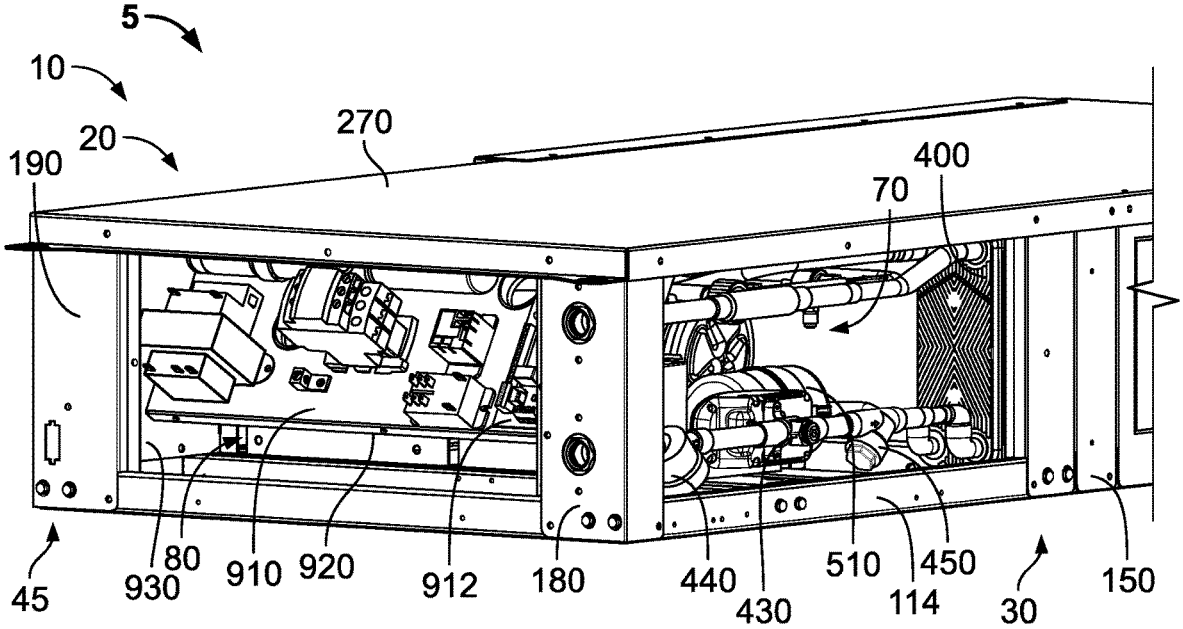
FIG. 31 is another perspective view of the system of FIG. 1 with panels removed to depict a control panel installed within an electronics compartment of the cabinet and rotated to be accessed horizontally.

FIG. 30 depicts the bottom side 25 of the heat pump system 5 with the bottom panels 212, 214, 216, 218, 220 removed from the frame 100 of the cabinet 10. For example, the bottom panel 212 is decoupled from the frame 100 to enable a technician positioned below the heat pump system 5 to easily access and service components of the heat pump system 5 housed within the blower compartment 60, such as the air coil 700, the drain pan 710, the blowers 810, 820, and the blower motor 830. Additionally or alternatively, the end panel 235 is configured to be decoupled from the frame 100 to facilitate the technician in accessing the components housed in the blower compartment 60. The bottom panel 214 is decoupled from the frame 100 to enable the technician positioned below the heat pump system 5 to easily access the plenum compartment 50. The bottom panels 216, 218 are decoupled from the frame 100 to enable the technician positioned below the heat pump system 5 to easily access and service components housed within the compressor compartment 70, such as the compressor 300, the heat exchanger 400, and the filter drier 510. Additionally or alternatively, the side panel 255 and the side panel 260 are configured to be decoupled from the frame 100 to facilitate the technician in accessing the components housed in the compressor compartment 70. For example, FIG. 31 depicts the heat pump system 5 when the side panel 260 is decoupled from the frame 100 of the cabinet 10 to provide access to the motorized valve 430, the strainer valve 440, the flow regulator valve 450, and the filter drier 510 of the heat pump system 5. The bottom panel 220 is decoupled from the frame 100 to enable the technician positioned below the heat pump system 5 to easily access and service components housed within the electronics compartment 80 of the cabinet 10, such as the controller 912 and/or other components of to the control panel 910. Additionally or alternatively, the end panel 240 is configured to be decoupled from the frame 100 to facilitate the technician in accessing the components of the heat pump system 5 housed in the electronics compartment 80. For example, FIG. 31 depicts the heat pump system 5 when the end panel 240 is decoupled from the frame 100 of the cabinet 10 to provide access to the control panel 910.

Figure 32:
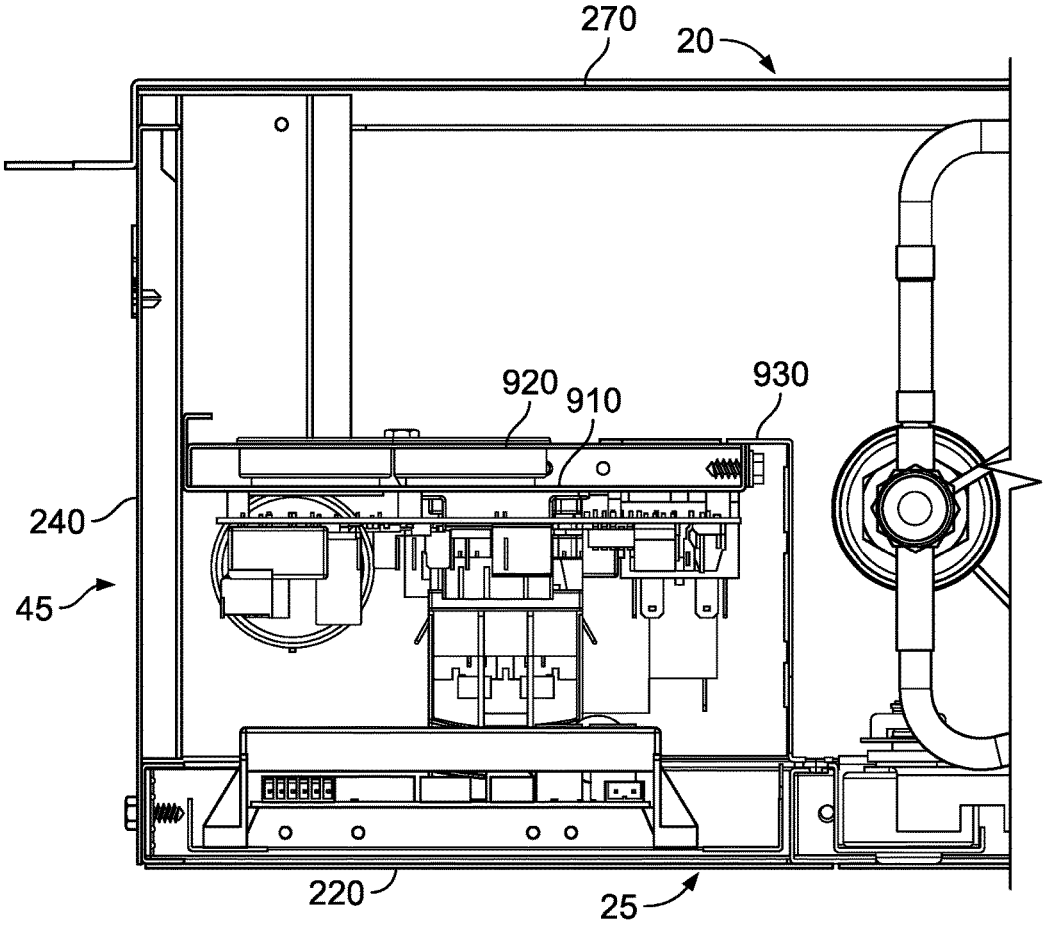
FIG. 32 is a cutaway side view of a portion of the system of FIG. 1 that depicts the control panel of FIG. 31 installed within the cabinet and rotated to be accessed from below.
Figure 33:
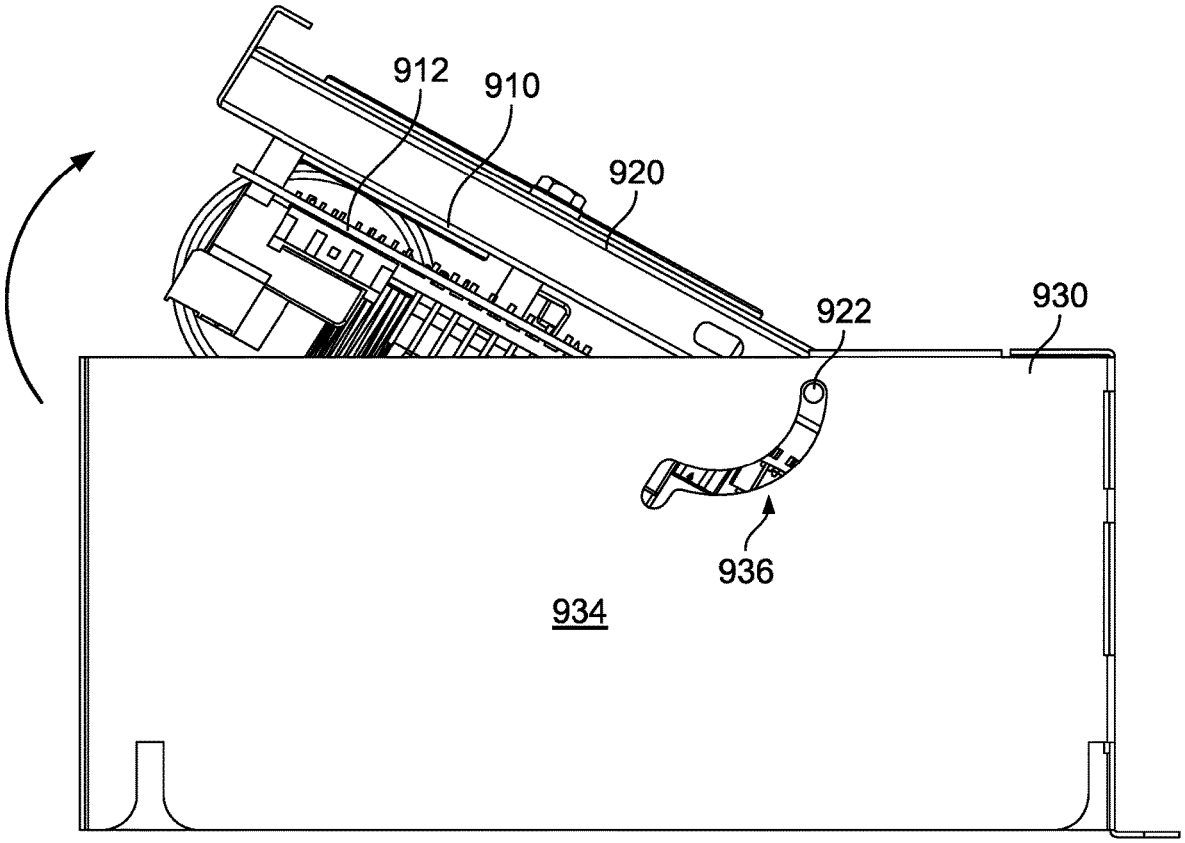
FIG. 33 is a side view of the electronics compartment of FIG. 31 as the control panel of FIG. 31 is being rotated to be accessed horizontally.
Figure 34:
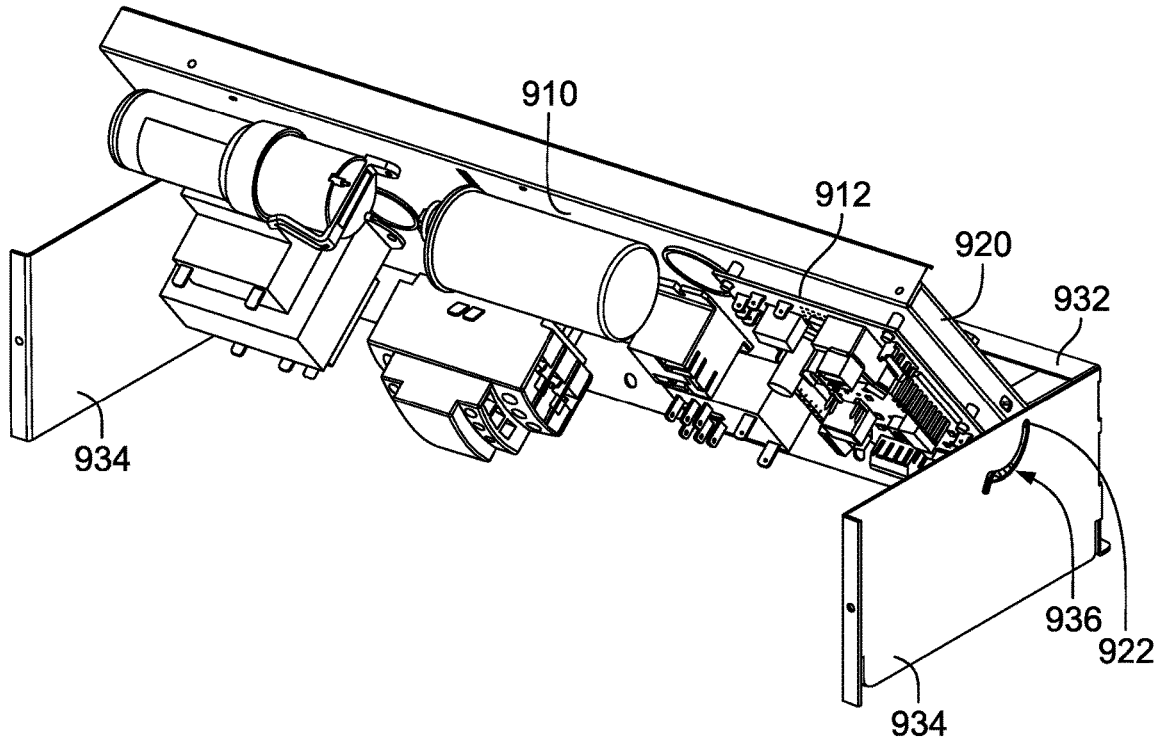
FIG. 34 is a perspective view of the electronics compartment of FIG. 31 as the control panel of FIG. 31 is being rotated to be accessed horizontally.

FIGS. 31-34 further depict features of the cabinet 10 that enable the technician to access and, in turn, service and/or replace electrical components of the control panel 910 such as the controller 912, when the heat pump system 5 is installed along a ceiling surface. FIG. 31 depicts the control panel 910 housed securely within and rotated to be accessed horizontally via the first side 30, the second side 35, and/or the second end 45. The electronics compartment 80 is defined by the bottom panel 220, the cover panel 920, and the electronics housing 930. FIG. 32 is a cutaway side view of the control panel 910 housed securely within the electronics compartment 80 and oriented to be accessed from below the heat pump system 5. FIGS. 33-34 depict the control panel 910 being rotated within the electronics housing 930 via the pin 922 and the curved slot 936.

To secure the control panel 910 within the electronics compartment 80, the end panel 240 is detached from the frame 100. The control panel 910 and the cover panel 920 is then inserted into the electronics compartment 80 through an opening where the end panel 240 was previously located. The control panel 910 and the cover panel 920 are positioned and oriented such that the pin 922 of the cover panel 920 is inserted into the curved slot 936 of the electronics housing 930. A cap is attached to the pin 922 to securely retain the pin 922 within the curved slot 936. The pin 922 of the cover panel 920 is then slid to an upper end of the curved slot 936 at which the pin 922 rests such that the cover panel 920 and the control panel 910 is slid and rotated into a rest position within the electronics compartment 80. In some examples, an edge of the cover panel 920 is secured to the corner posts 180, 190 via fasteners to further secure the control panel 910 in place. The end panel 240 is then reattached to the frame 100 to securely enclose the control panel within the electronics compartment 80.

When the control panel 910 is installed within the electronics compartment 80, the curved slot 936 and the pin 922 enable the control panel to be rotated by the technician (e.g., about 120 degrees) so that the control panel 910 faces slightly upward and toward the second end 45 of the cabinet 10. To access the control panel 910 for service, the end panel 240, the side panel 255, and/or the side panel 260 is detached from the frame 100. In some examples, the cover panel 920 is decoupled from the corner posts 180, 190 while the control panel 910 remains facing downward. The control panel 910 and the cover panel 920 are slid and rotated (e.g., about 120 degrees) via the pin 922 and the curved slot 936 so that the control panel 910 faces slightly upward and toward the second end 45 of the cabinet 10. Once the control panel 910 is serviced, the control panel 910, cover panel 920, the end panel 240, the side panel 255, and/or the side panel 260 are securely retained to their rest positions.

Figure 35:
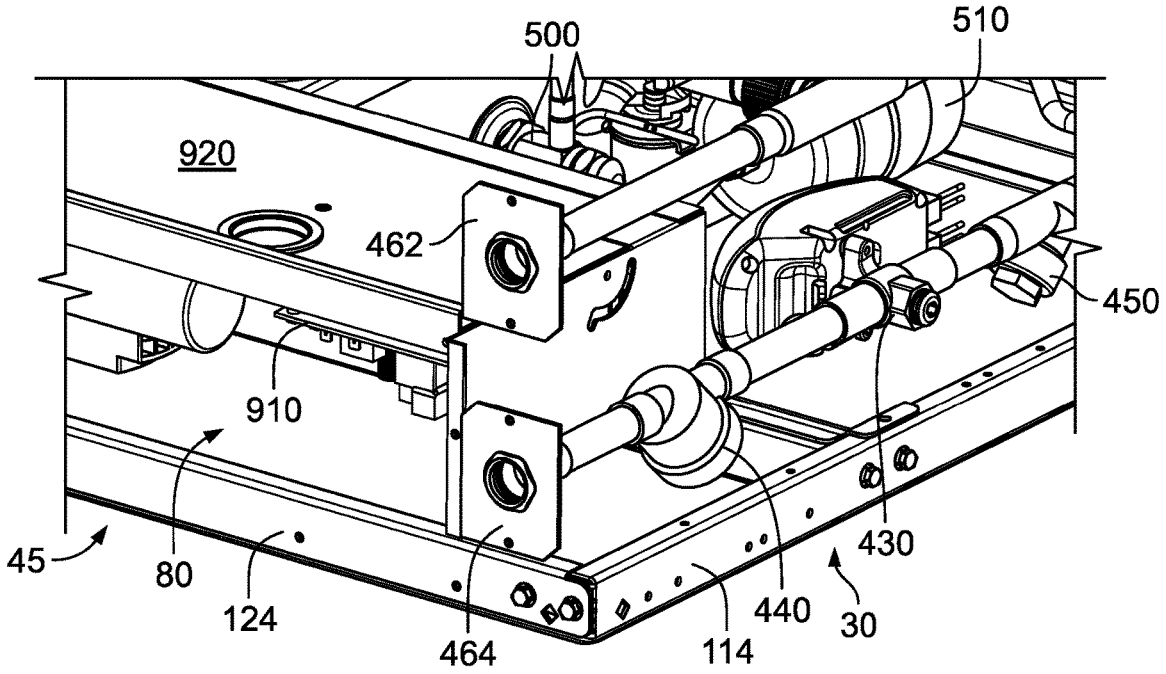
FIG. 35 depicts a portion of the control panel of FIG. 31 and external water connections of the system of FIG. 1.

FIG. 35 depicts a corner of the cabinet 10 that is formed where the first side 30 and the second end 45 meet. In the illustrated example, the corner post 180, the end panel 240, and the side panel 255 are decoupled from the end rail 124 and the side rail 114 of the frame 100. Components housed within the electronics compartment, such as the controller 912, are accessible to the technician when the end panel 240 is detached from the frame 100. Components housed within the compressor compartment 70, such as the motorized valve 430, the strainer valve 440, the flow regulator valve 450, the expansion valve 500, and the filter drier 510, are accessible to the technician when the side panel 255 is detached from the frame 100. The plate fittings 462, 464 are accessible when the corner post 180 is detached from the frame 100.

Figure 36:
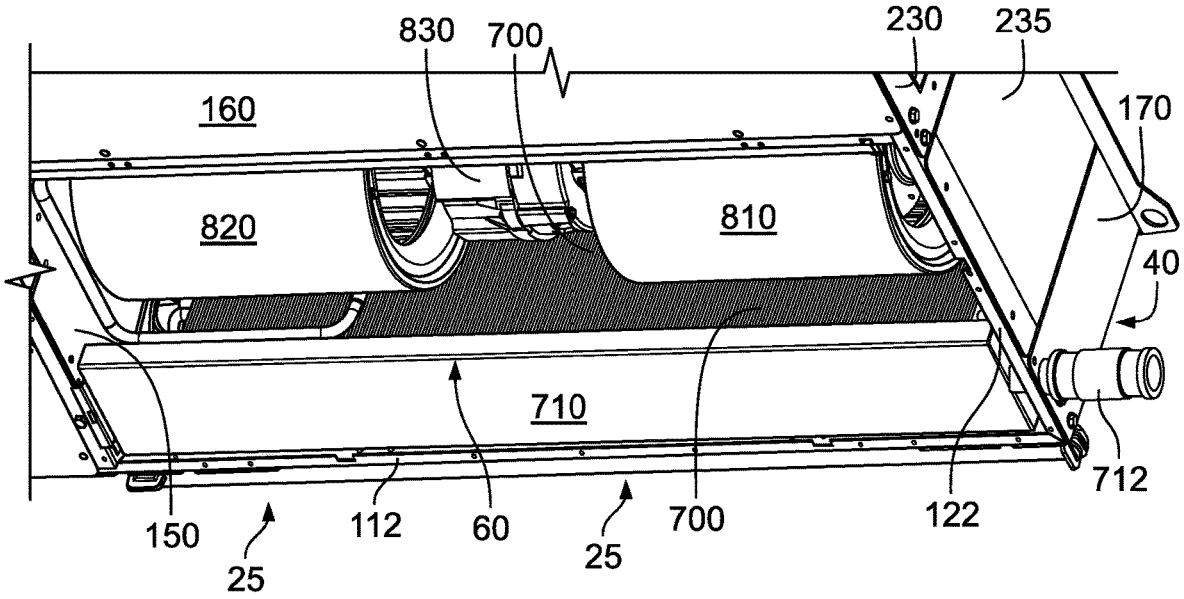
FIG. 36 is a perspective view of a portion of the system of FIG. 1 with a bottom panel of the cabinet removed to access a blower-and-coil compartment of the cabinet.
Figure 37:
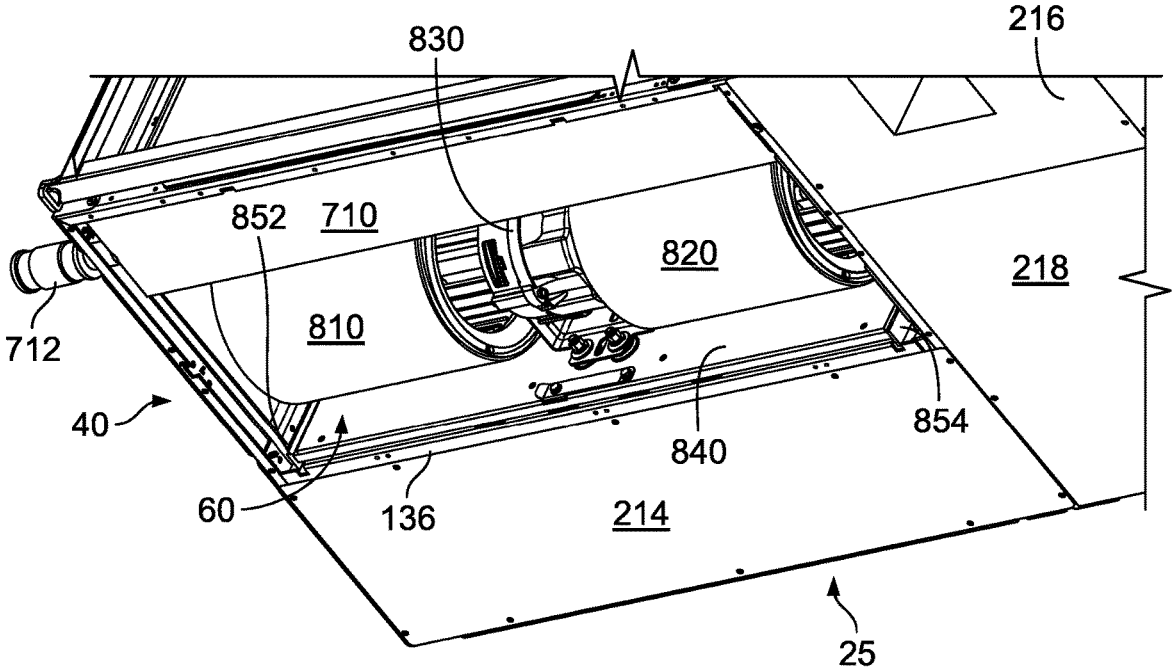
FIG. 37 is another perspective view of the blower-and-coil compartment of FIG. 36.

FIGS. 36-41 features of the cabinet 10 that enable components housed within the blower compartment 60, such as the air coil 700, the drain pan 710, the blowers 810, 820, and the blower motor 830, to be easily accessed by the technician from below the heat pump system 5. As shown in FIGS. 36-37 the blower compartment 60 is accessed by decoupling the bottom panel 212 from the frame 100. For example, the bottom panel 212 is detached from the side rail 112, the end rail 122, the cross rail 134, and/or the cross rail 136 of the frame 100.

As further depicted in FIGS. 38A-42, the blower assembly includes a sliding mechanism that facilitates the technician in accessing the blowers 810, 820 and the blower motor 830 from the below the heat pump system 5 installed to a ceiling surface. The blower panel 840 is slidingly engaged to the slider brackets 852, 854 of the blower assembly. The blower panel 840 is configured to slide along the slider brackets 852, 854, which that are fixed in place, to slide the blowers 810, 820 and the blower motor 830 into and/or out of the blower compartment 60 of the cabinet 10. The blower assembly also includes a latch 842 that enables the sliding mechanism to rest in a retracted position at which the blowers 810, 820 and the blower motor 830 are completely within the blower compartment 60. The blower assembly is configured to provide a rigidity to the cabinet 10 that reduces vibrations and/or lowers acoustic signatures without incorporating additional noise-insulating materials.

Figure 38B:
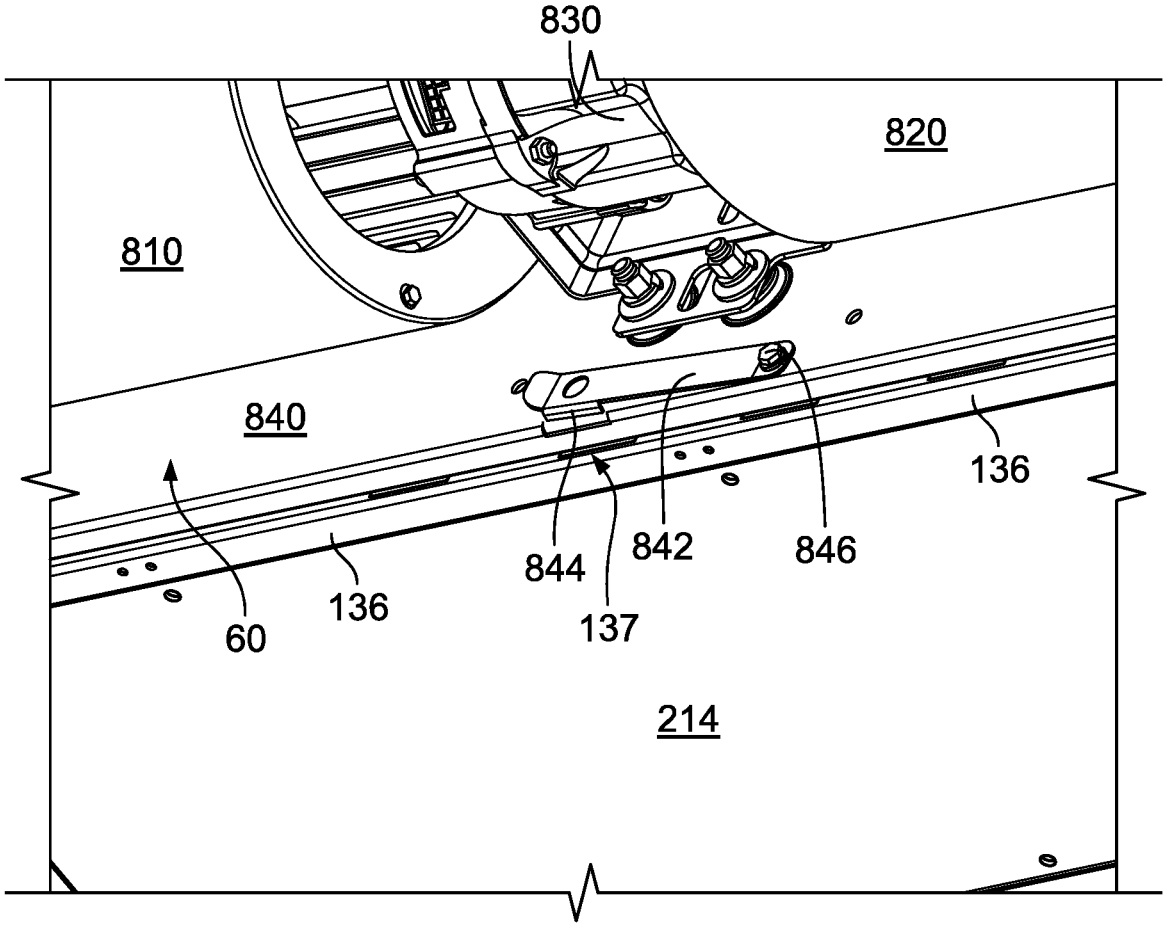
FIG. 38B is another expanded view of the blower panel of FIG. 38A with the latch in a sliding position.

FIGS. 38A and 38B depict the blower assembly in the retracted position. More specifically, FIG. 38A depicts the sliding mechanism in the retracted position with the latch 842 in a locked position, and FIG. 38B depicts the sliding mechanism in the retracted position with the latch 842 in an unlocked position. A first end of the latch 842 is fastened to the blower panel 840 via a first fastener 846, and an opposing second end of the latch 842 is couplable to the blower panel 840 via a second fastener 848. The latch 842 is spring loaded and also includes a lock blade 844 that extends from the second end. When the latch 842 is in the locked position as shown in FIG. 38A, the second fastener 848 is coupled to the blower panel 840 to secure the second end of the latch 842 to the blower panel 840. In turn, the lock blade 844 extends into one of the blade openings 137 (FIGS. 14A-140) defined by the lips 138 (FIGS. 14A-14C) of the cross rail 136. When lock blade 844 is extended into one of the blade openings 137, the lock blade 844 of the latch 842 prevents the blower panel 840 from sliding downward via the slider brackets 852, 854. To transition the latch 842 to the unlocked position as shown in FIG. 38B, the second fastener 848 is decoupled from the blower panel 840. The second end of the latch 842 is biased to flex away from the surface of the blower panel 840. In turn, when the second fastener 848 is removed, the second end of the latch 842 flexes away from the blower panel 840 and the lock blade 844 of the latch 842 is slide out of the blade opening 137. When the lock blade 844 is removed from the blade opening 137, the blower panel 840 is enabled to slide downward via the slider brackets 852, 854.

Figure 39:
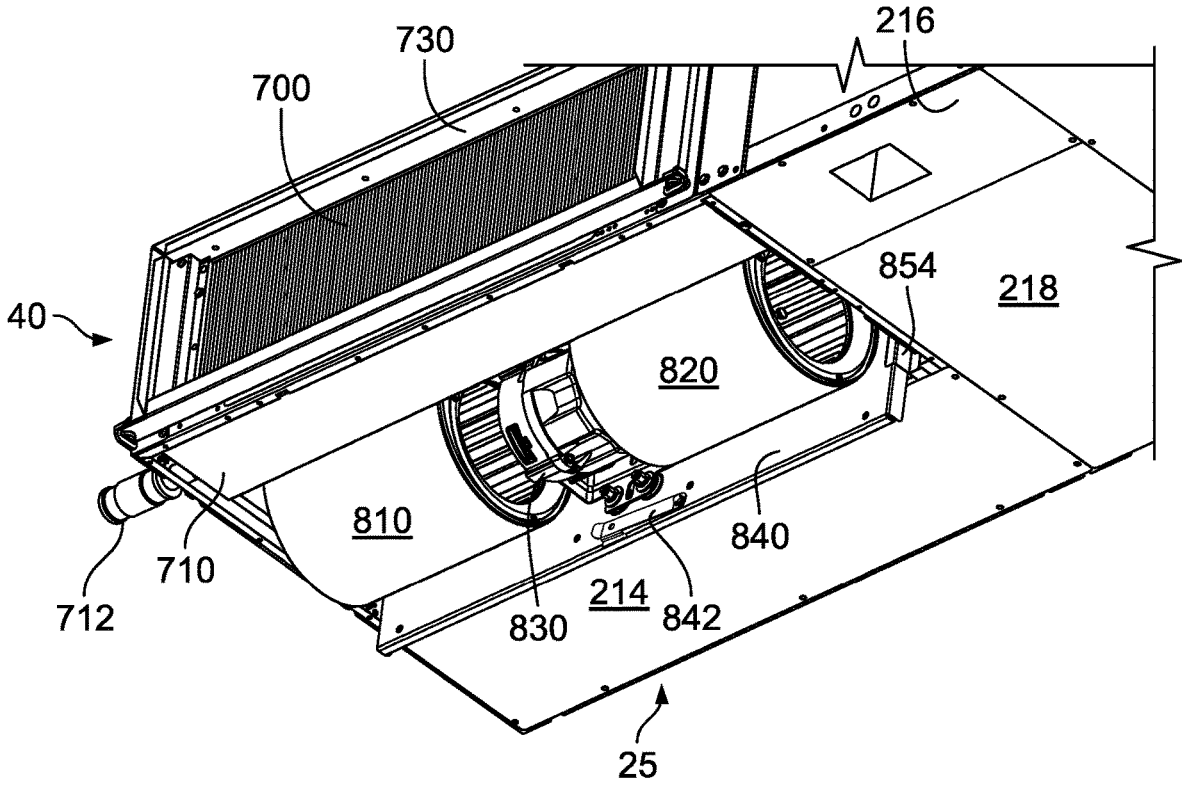
FIG. 39 depicts the blower assembly of FIG. 38A partially lowered from the blower-and-coil compartment of FIG. 36 via the blower panel of FIG. 38A.
Figure 40:
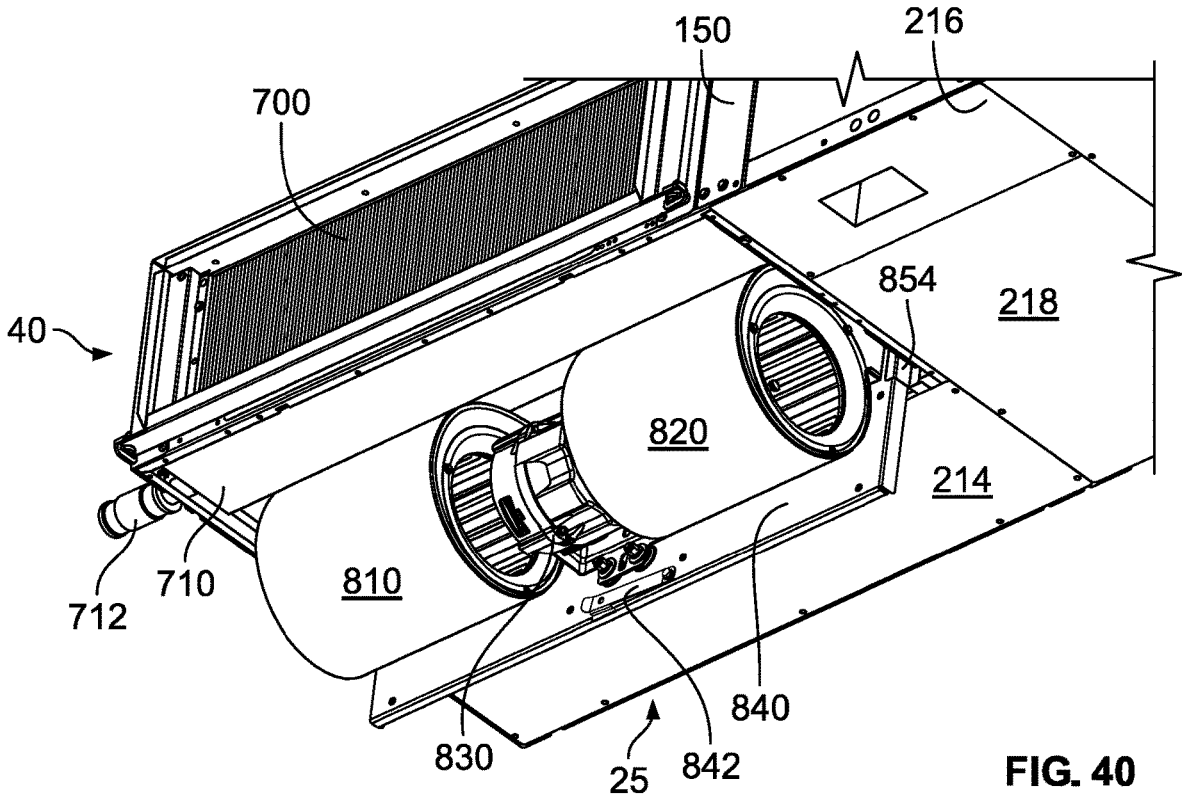
FIG. 40 depicts the blower assembly of FIG. 38A further lowered from the blower-and-coil compartment of FIG. 36 via the blower panel of FIG. 38A.
Figure 41:
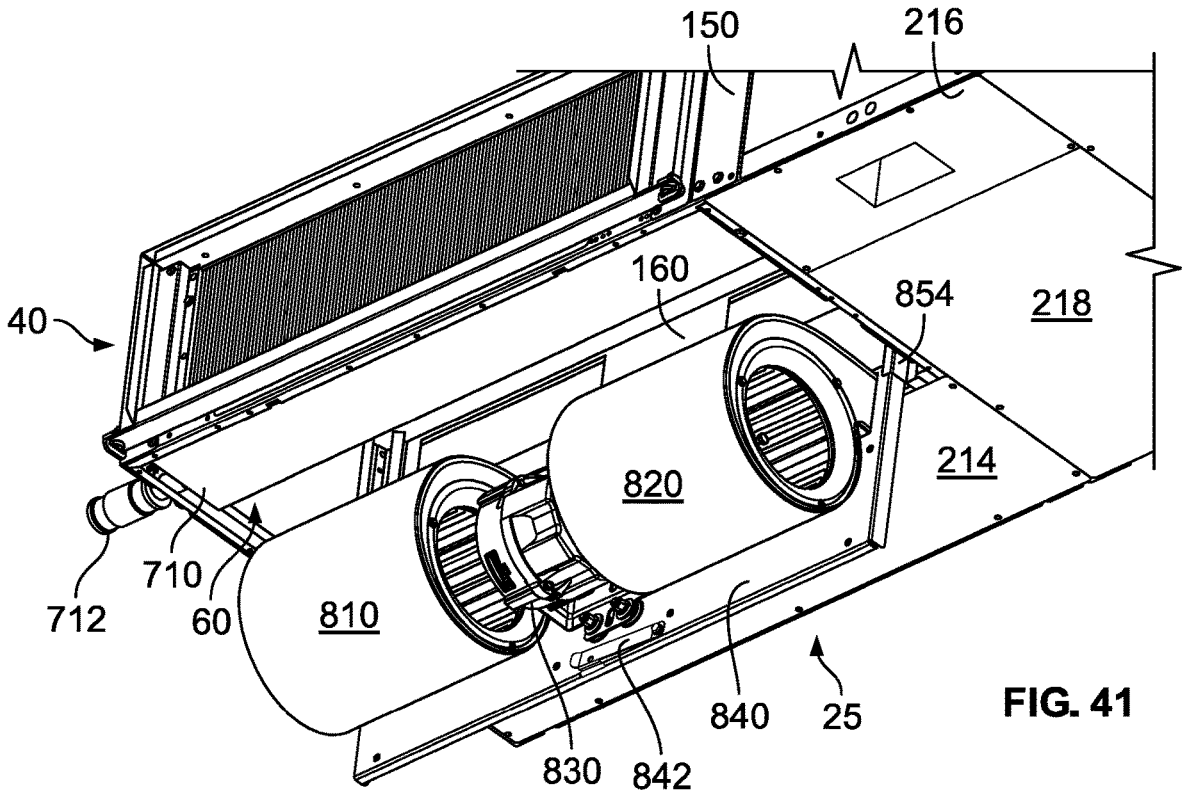
FIG. 41 depicts the blower assembly of FIG. 38A fully lowered from the blower-and-coil compartment of FIG. 36 via the blower panel of FIG. 38A.
Figure 42:
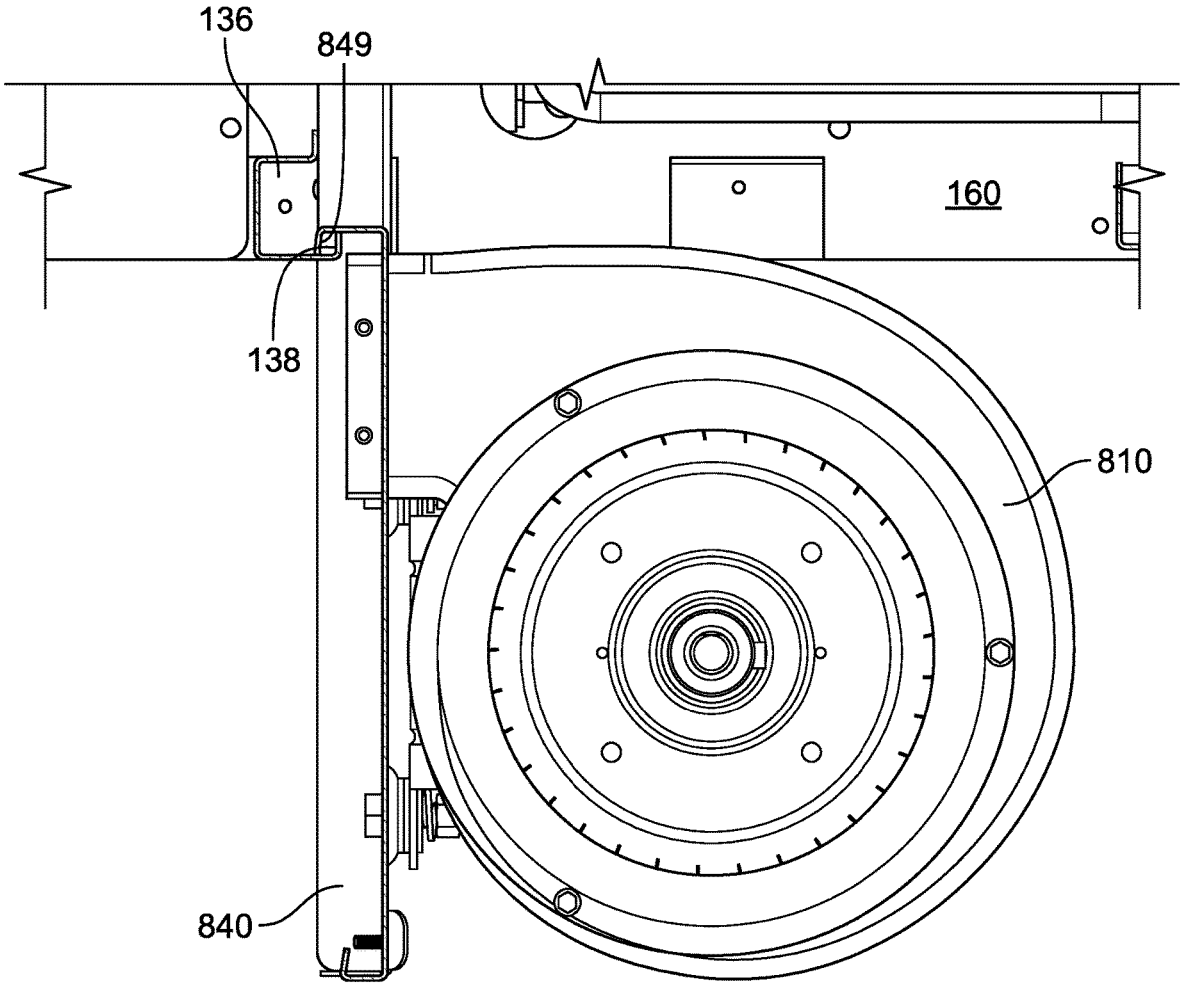
FIG. 42 is a side cutaway view of the blower assembly of FIG. 38A.

FIGS. 39 and 40 depict respective intermediate positions at which the blowers 810, 820 and the blower motor 830 are extended partially out of the blower compartment 60. FIGS. 41 depicts the sliding mechanism in a fully extended position at which the blowers 810, 820 and the blower motor 830 are completely outside of the blower compartment 60. As shown in FIG. 42, the blower assembly includes a hanger-stop assembly that deters the blower panel 840 from unintentionally sliding beyond and disconnecting from the slider brackets 852, 854. The hanger-stop assembly includes one or more of the lips 138 of the cross rail 136 and a lip 849 at a top end of the blower panel 840. When the blower panel 840 has been slid to the bottom of the slider brackets 852, 854 at the fully extended position, the lip 849 of the blower panel 840 engages and hangs from the lips 138 of the cross rail 136 in such a manner that the blower panel 840 is impeded from disconnecting from the slider brackets 852, 854. The hanger-stop assembly also is configured to enable the technician to fully remove the blower panel 840. For example, to remove the blower panel 840, the technician is to lift the blower panel 840 slightly upward, tilt the blower panel 840 toward the side rail 112, and pull the blower panel 840 away from the slider brackets 852, 854.

Figure 43:
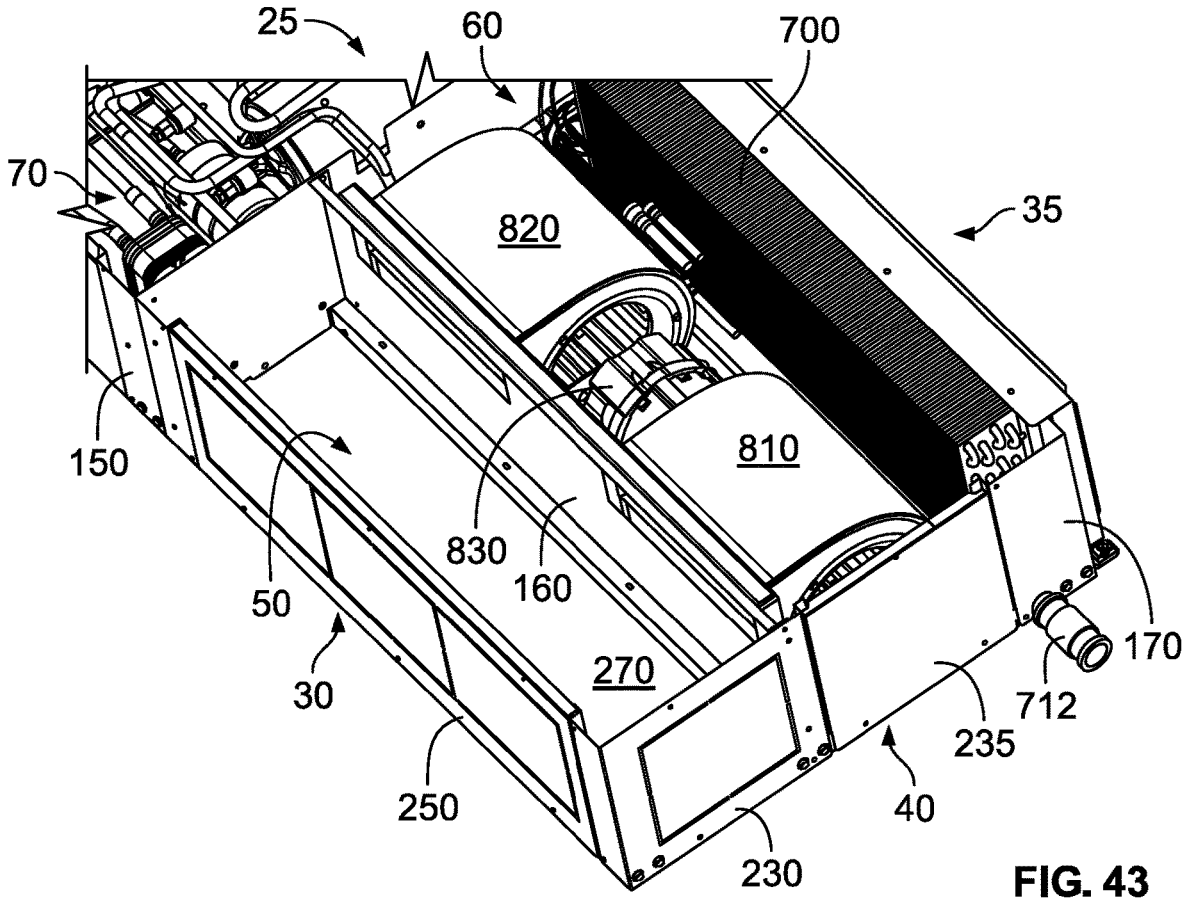
FIG. 43 depicts a perspective view of a portion of the system of FIG. 1 with a top panel of the cabinet removed.

FIG. 43 further depicts the bottom side 25 of a portion of the cabinet 10 with the bottom panels 212, 214, 216, 218 removed from the frame 100. For example, the bottom panel 212 is decoupled from the frame 100 to provide access to components of the heat pump system 5 housed within the blower compartment 60, such as the air coil 700, the blowers 810, 820, and the blower motor 830. The bottom panel 214 is decoupled from the frame 100 to provide access to the plenum compartment 50. The bottom panels 216, 218 are decoupled from the frame 100 to provide access to components housed within the compressor compartment 70.

In the illustrated example, the plenum compartment 50 is formed by the divider 150, the divider 160, the bottom panel 212, the end panel 230, the side panel 250, and the top panel 270. The blower compartment 60 is formed by the divider 150, the divider 160, the corner post 170, the bottom panel 214, the end panel 235, and the top panel 270. Additionally, the compressor compartment 70 is formed by the divider 150, the divider 160, the corner posts 180, 190, the bottom panels 216, 218, the end panel 240, the side panels 255, 260, and the top panel 270. The electronics compartment 80 is formed by the bottom panel 220, the end panel 240, the top panel 270, and the electronics housing 930.

Figure 44:
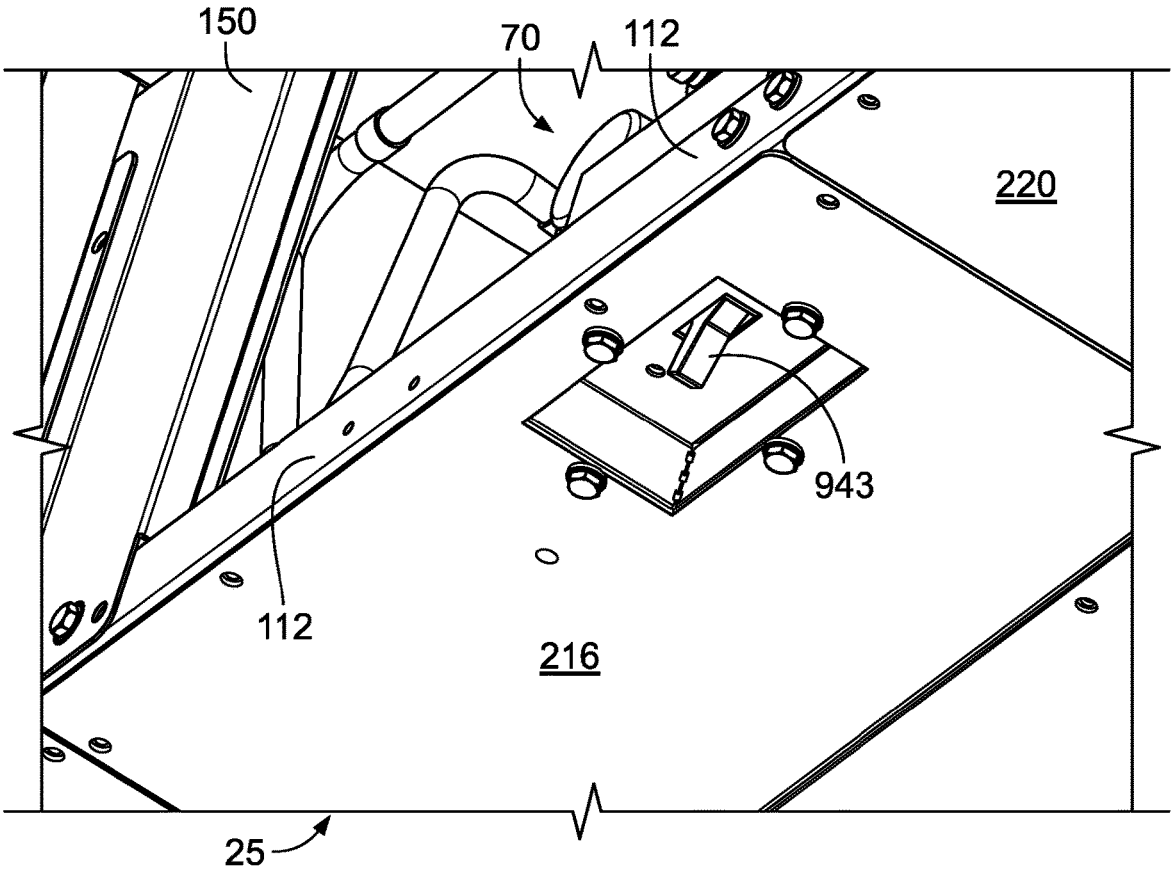
FIG. 44 is a perspective view of a bottom panel of the system of FIG. 1 through which a disconnect switch extends.
Figure 45:
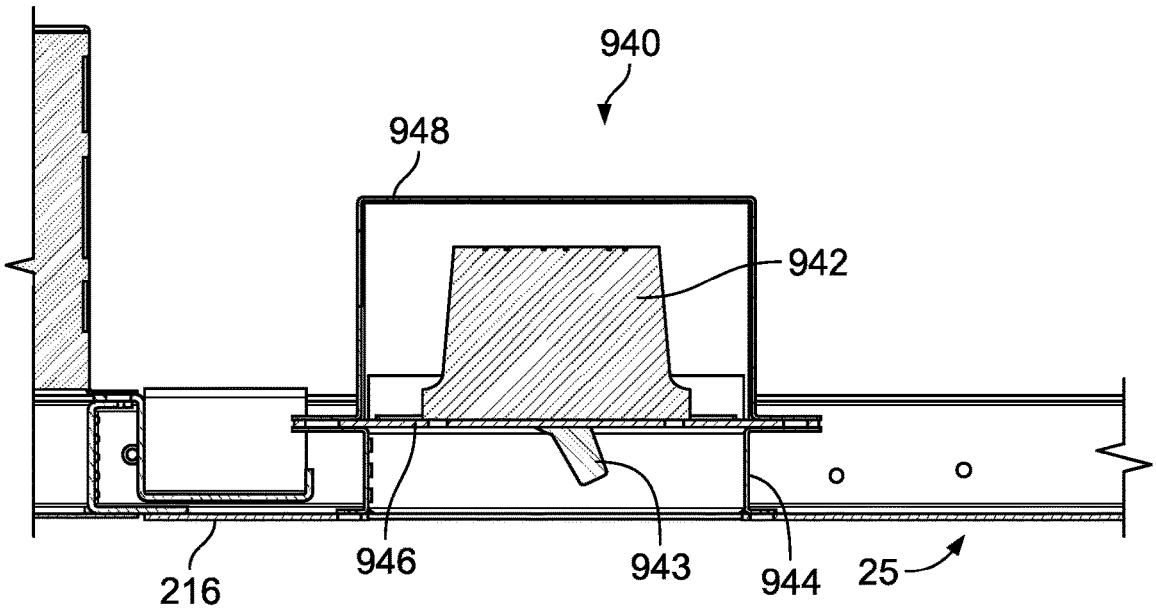
FIG. 45 is a cutaway side view of a switchbox housing the disconnect switch of FIG. 44.

FIGS. 44-45 further depict the disconnect switchbox 940 of the heat pump system 5 that is coupled to the bottom panel 216. As shown in FIG. 45, the front housing 944 is coupled to an inner surface of the bottom panel 216. The cover 946 is positioned within the front housing 944. The switch body 942 is positioned on the cover 946 such that the switch 943 extends through the switch opening 947. The rear housing 948 is positioned over the front housing 944 such that the cover 946 and the switch body 942 are enclosed by the front and rear housings 944, 948. The switch 943 extends through the switch opening 947 and out of the bottom side 25 of the cabinet 10 to enable the technician to easily change the position of the switch 943 thereby safely shutting off electrical power to the heat pump system 5 from below the heat pump system 5 before accessing components of the heat pump system 5 housed within the interior of the cabinet 10.

Figure 46:
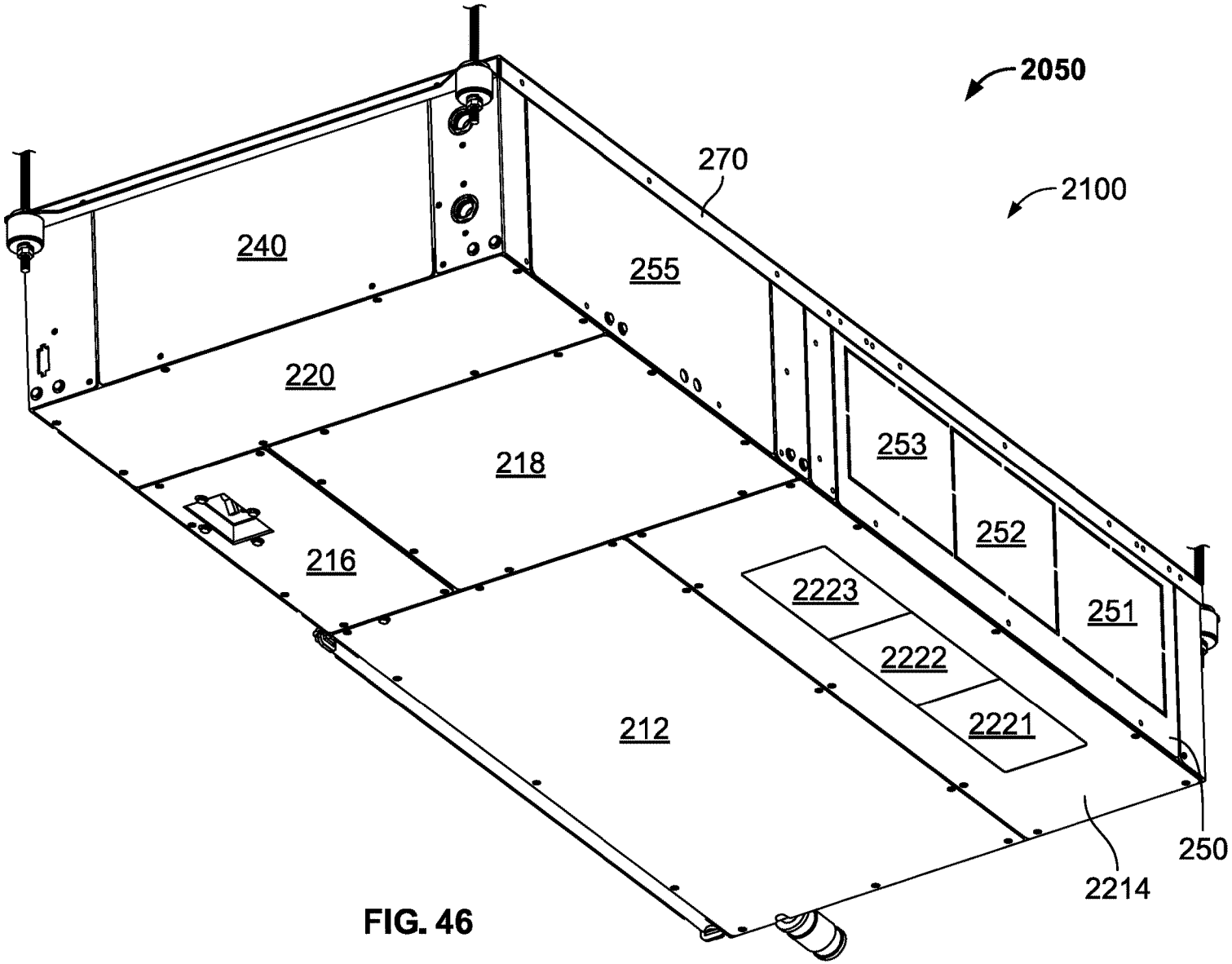
FIG. 46 is a perspective view of another embodiment of a low-height heat pump system of the instant disclosure.
Figure 47:
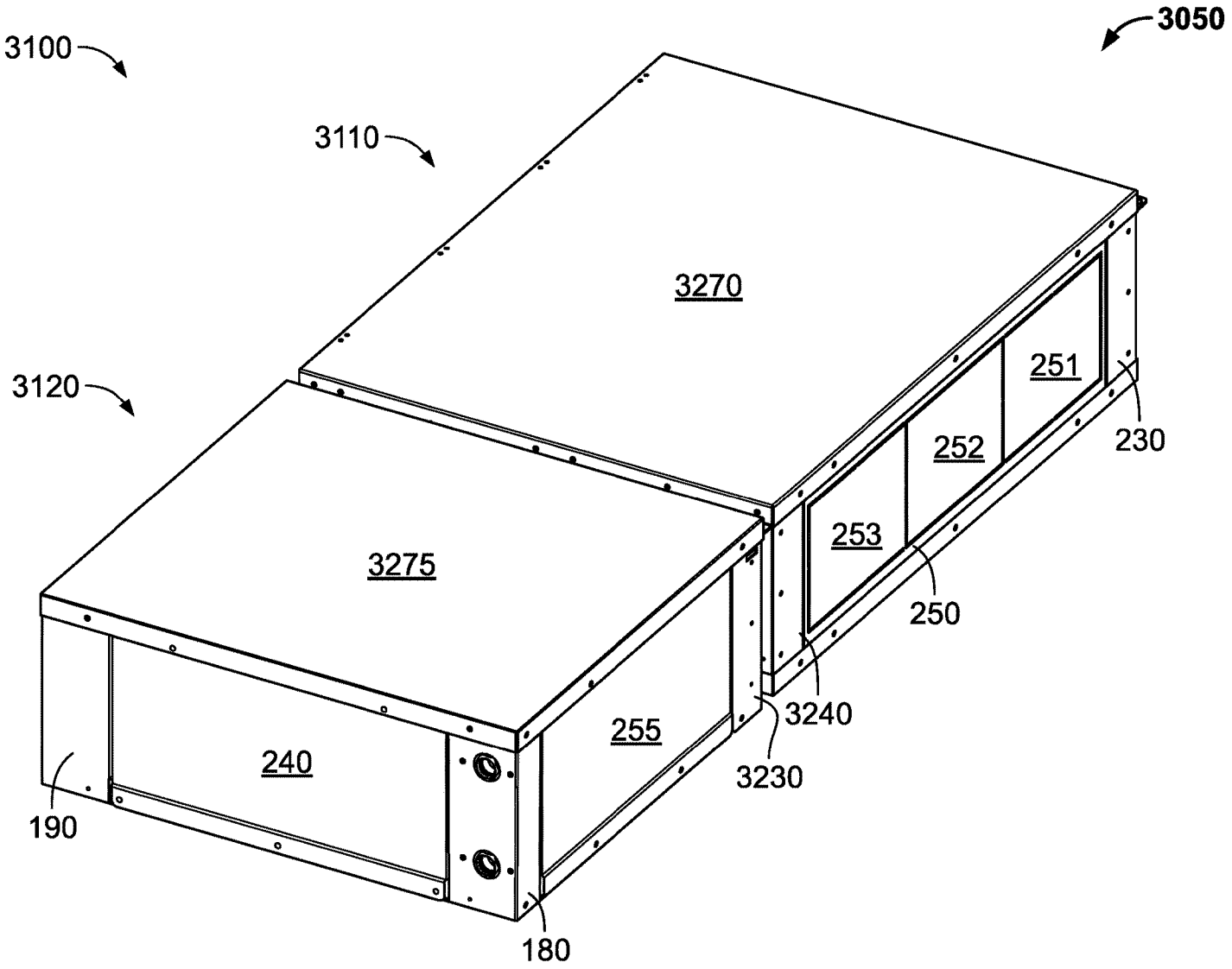
FIG. 47 is a perspective view of another embodiment of a low-height heat pump system of the instant disclosure.
Figure 48:
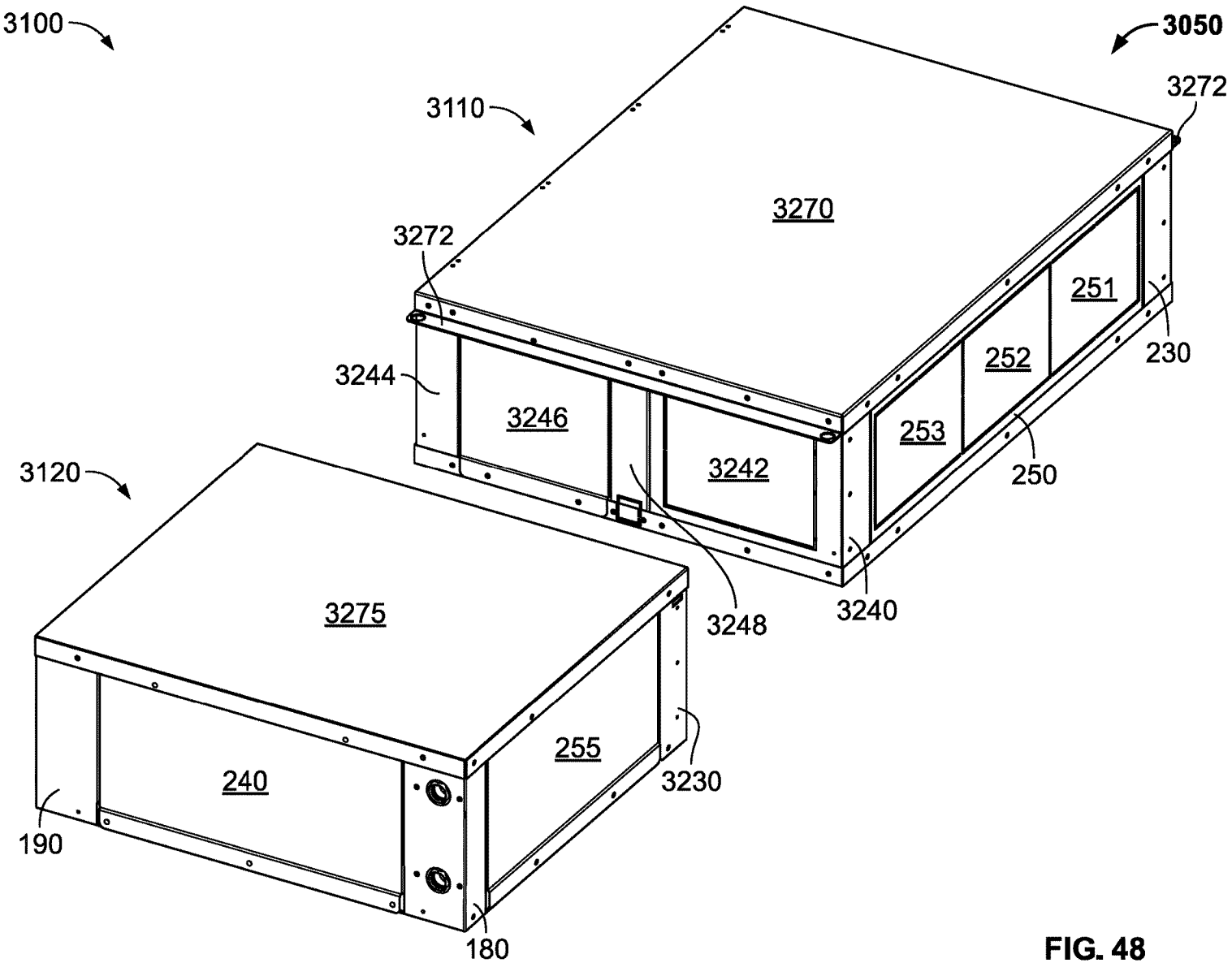
FIG. 48 is another perspective view of the system of FIG. 47.

FIG. 46 depicts another embodiment of a low-height heat pump system 2050 having a low-height heat pump cabinet 2100 as disclosed herein. The components of the heat pump system 2050 housed within the cabinet 2100 may be identical to those housed in the cabinet 10. Additionally, the cabinet 2100 is substantially similar to the cabinet 10. For example, the bottom panels 212, 216, 218, 220; the end panel 240; the side panels 250, 255; the top panel 270 and other components not shown are identical to those of the cabinet 10. As such, those components and their functionality are not disclosed in further detail below with respect to the heat pump system 2050 and the cabinet 2100.

As shown in FIG. 46, the cabinet 2100 includes a bottom panel 2214 that is adjacent the plenum compartment 50. The bottom panel 2214 is coupled to the side rail 114, the end rail 122, and/or the cross rails 134, 136 via one or more fasteners (e.g., threaded fasteners). The bottom panel 2214 includes a plurality of duct panels 2221, 2222, 2223 (also referred to as a "knockout panels") that are arranged in a side-by-side manner. Each of the duct panels 2221, 2222, 2223 are removable from the bottom panel 2214 to form an opening for ductwork connecting to the plenum compartment 50 of the cabinet 2100. Ductwork of the HVAC system may fluidly connect to the cabinet 2100 via an opening formed by the removal of one or more of the duct panels 2221, 2222, 2223 in addition to or as an alternative to ductwork connecting to the cabinet 2100 via the end panel 230 and/or the side panel 250. For example, ductwork of the HVAC system may connect to the cabinet 2100 via only the end panel 230, via only the side panel 250, via only the bottom panel 2214 and/or simultaneously via any combination of the end panel 230, the side panel 250, and the bottom panel 2214. In the illustrated example, each of the duct panels 2221, 2222, 2223 are equally sized. In other examples, the duct panels 2221, 2222, 2223 are sized differently with respect to each other to facilitate differently-sized ducts in connecting to the cabinet 2100. Additionally or alternatively, different combinations of the duct panels 2221, 2222, 2223 may be removed to facilitate differently-sized ducts in connecting to the cabinet 2100.

FIGS. 47-50 depicts another embodiment of a low-height heat pump system 3050 having a low-height heat pump cabinet assembly 3100 as disclosed herein. The components of the heat pump system 3050 housed within the cabinet assembly 3100 may be similar to those housed in the cabinet 10. For example, the compressor 300, the reversing valve 330, the expansion valve 500, the filter drier 510, the heat exchanger 400, the air coil 700, the control panel 910, the blower assembly, the sensors, the switches, etc. are identical to those housed in the cabinet 10. Additionally, the cabinet assembly 3100 is substantially similar to the cabinet 10. For example, the corner posts 170, 180, 190; the bottom panel 220; the end panels 230, 240; the side panels 250, 255, 260; and other components not shown are identical to those of the cabinet 10. As such, those components and their functionality are not disclosed in further detail below with respect to the heat pump system 3050 and the cabinet assembly 3100.

As shown in FIGS. 47-50, the heat pump system 3050 is a split system with the cabinet assembly 3100 including a first cabinet 3110 and a second cabinet 3120 that are split apart from each other. The first cabinet 3110 includes the plenum compartment 50 and the blower compartment 60, and the second cabinet 3120 includes the compressor compartment 70 and the electronics compartment 80. The first cabinet 3110 is connected to the second cabinet 3120 via refrigeration lines, electrical/power lines, and/or computer control lines. The first cabinet 3110 and/or the second cabinet 3120 may be wired or wirelessly (Wi-Fi/cellular/Bluetooth, etc.) connected to one another and/or to other local or remote equipment, including a thermostat, a controller, a display, and/or a user interface operating in a web browser, for example. In this way, a user may locally or remotely monitor a sensor, component, or function of heat pump system 3050 or locally or remotely interact with and/or control a function of heat pump system 3050. The split configuration of heat pump system 3050 allows the first cabinet 3110 to be mounted in a different location than the second cabinet 3120 to accommodate architectural/physical constraints, such as beams, purlins, structural members, plumbing, and other building systems, and to provide maximum flexibility for installation in a particular building. For example, the second cabinet 3120 can be positioned in a closet adjacent to, for example, an apartment's water heating system while the first cabinet 3110 can be positioned in the ceiling. Example embodiments of the first cabinet 3110 may be about 35 inches long, about 25 inches wide, and a maximum of about 9 inches in height. In the illustrated example, the first cabinet 3110 has a low height of 9 inches, a length of 33.71 inches, and a depth of 22.5 inches. Example embodiments of the second cabinet 3120 may be about 27.5 inches long, about 25 inches wide, and a maximum of about 9 inches in height. The second cabinet 3120 of the illustrated example has a low height of 9 inches, a length of 26.097 inches, and a depth of 22.5 inches.

In the illustrated example, the second cabinet 3120 includes the corner posts 180, 190; end panels 240, 3230; side panels 255, 260; bottom panels 220, 3218; and a top panel 3275. The end panels 240, 3230, the side panels 255, 260, and the bottom panels 220, 3128 are configured to be removed from the second cabinet 3120 to provide access to components of the heat pump system 3050 housed within the first cabinet 3120. For example, in FIG. 49, the end panel 240 is removed to provide access to the control panel 910 housed within the electronics compartment 80 of the second cabinet 3120.

Figure 49:
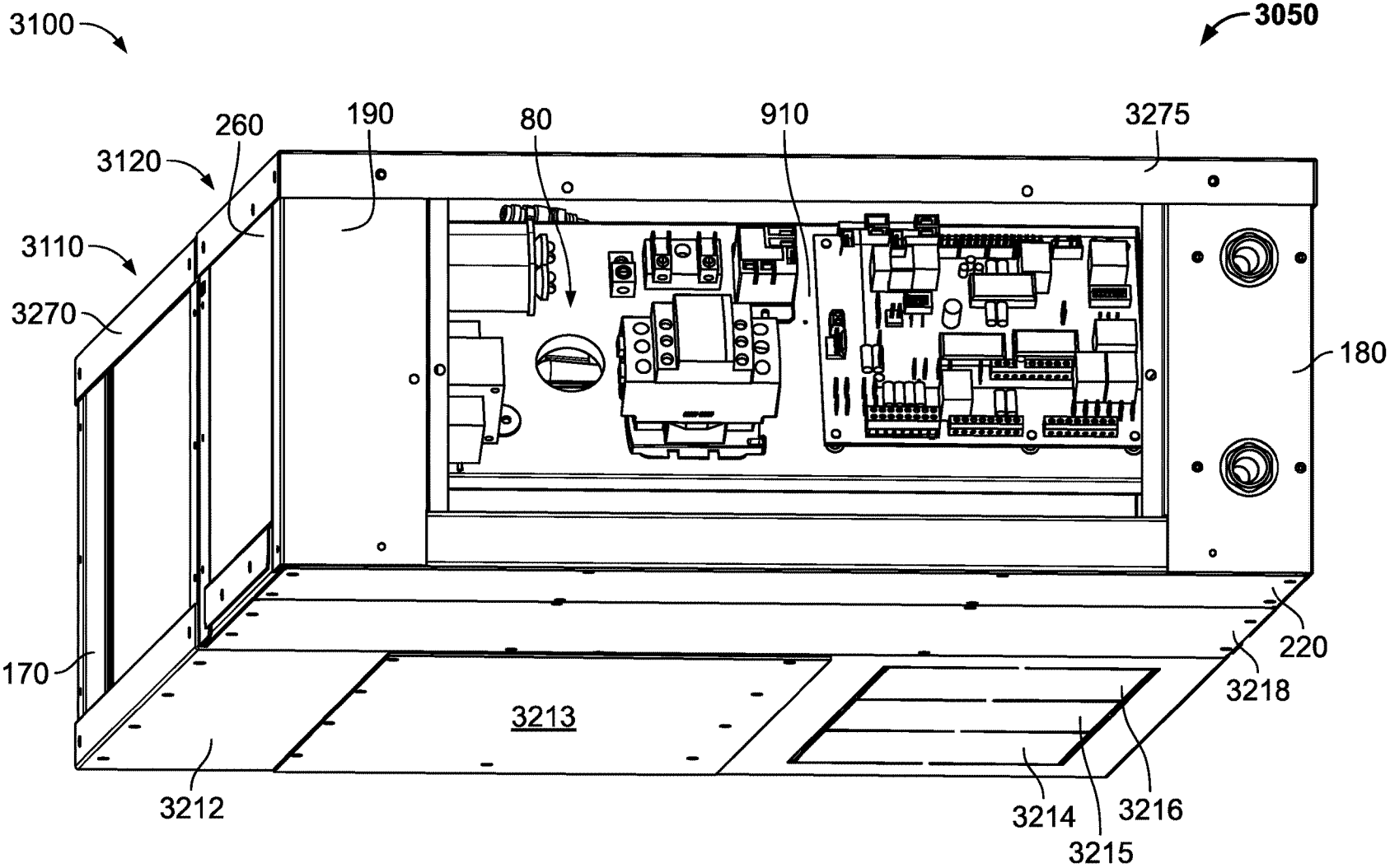
FIG. 49 is an end perspective view of the system of FIG. 47 with a panel of the cabinet removed to show a control panel of the system.
Figure 50:
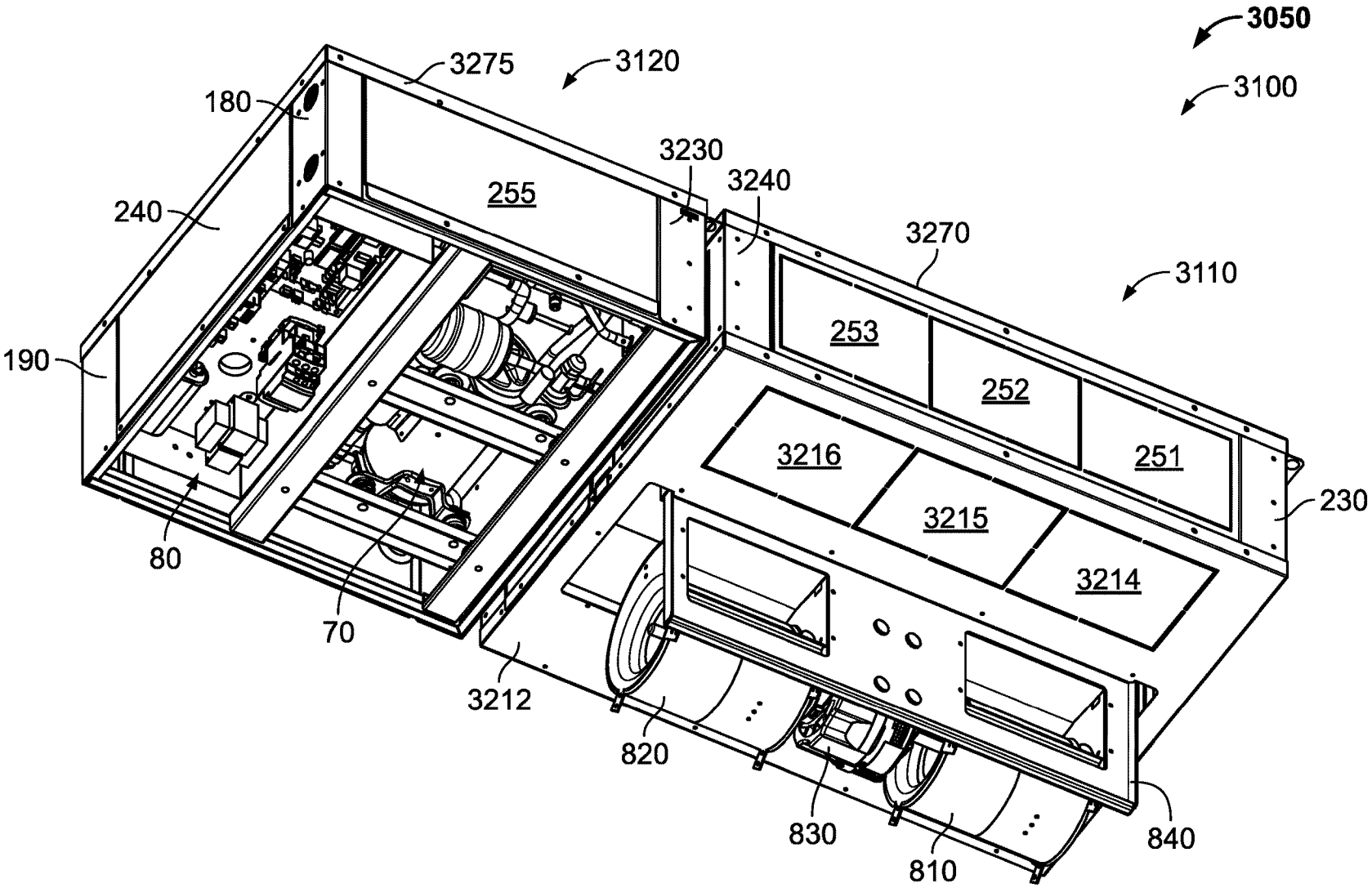
FIG. 50 is another perspective view of the system of FIG. 47 with a blower assembly in its fully lowered position and one or more bottom panels of the cabinet removed to show various system components inside in the cabinet.

The first cabinet 3110 of the illustrated example includes the corner post 170; end panels 230, 3240, 3244; knockout panels 3242, 3246; a mullion 3248; the side panel 250; a bottom panel 3212, and a top panel 3270. The end panel 230 is located on a first end of the first cabinet 3110 The end panels 3240, 3244; the knockout panels 3242, 3246; and the mullion 3248 are located on an opposing second side. The knockout panels 3242, 3246 are configured to be removed from first cabinet 3110 to provide access to the plenum compartment 50 and/or the blower compartment 60. For example, one or more of the knockout panel 3242, 3246 is removed from the first cabinet 3110 to enable a portion of the refrigerant conduit 600 and/or electrical wiring to extend between (1) the plenum compartment 50 and/or the blower compartment 60 of the first cabinet 3110 and (2) the compressor compartment 70 and/or the electronics compartment 80 of the second cabinet 3120. The side panel 250 includes the duct panels 251, 252, 253 that are removable to form an opening for ductwork connecting to the plenum compartment 50. The bottom panel 3212 also includes duct panels 3214, 3215, 3216 that are removable to form an opening for ductwork connecting to the plenum compartment 50. As shown in FIG. 49, another bottom panel 3213 is coupled to the bottom panel 3212 that extends a length and width of the first cabinet 3110. As shown in FIG. 50, the bottom panel 3213 is configured to be decoupled from the bottom panel 3212 to provide access to the blowers 810, 820; the blower motor 830; and the blower panel 840 of the blower assembly housed within the blower compartment 60.

Figure 51:
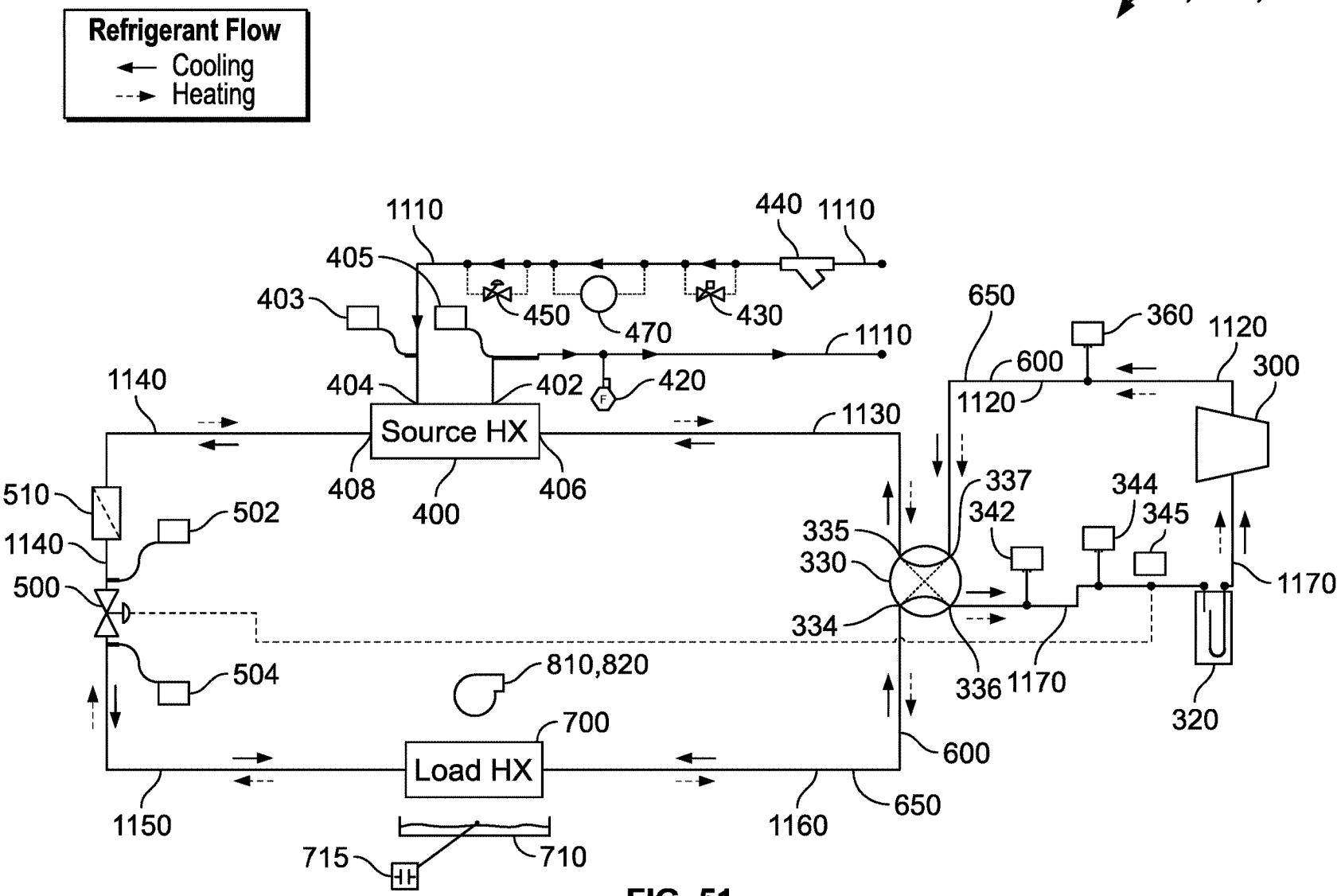
FIG. 51 is a schematic diagram illustrating an embodiment of a heat pump system of the instant disclosure.

FIG. 51 is a schematic illustrating the modes of operation of heat pump systems 5, 2050, 3050. The components of heat pump systems 5, 2050, 3050 are fluidly coupled together via refrigerant conduit 600. Control components, including control input devices and control output devices, of heat pump systems 5, 2050, 3050 are communicatively coupled to the controller 912. For example, control input devices of heat pump systems 5, 2050, 3050 include the temperature sensors 403, 405, 502, 504, the flow switch 420, and the pressure switches 342, 344, 360. The control input devices of heat pump systems 5, 2050, 3050 that are communicatively coupled to the controller 912 to control the conditioning of the space include, for example, the compressor 300, the reversing valve 330, and the blowers 810, 820.

In the illustrated example, refrigerant circuit 650 of heat pump systems 5, 2050, 3050 includes various portions of refrigerant conduit 600 to convey refrigerant therethrough, including first portion 1120 extending from the compressor 300 to the fourth port 337 of reversing valve 330, second portion 1130 extending from the second port 335 of reversing valve 330 to the port 406 of the refrigerant-to-liquid source heat exchanger 400, third portion 1140 extending from the port 408 of the source heat exchanger 400 to the filter drier 510 and to the expansion valve 500, fourth portion 1150 extending from the expansion valve 500 to the refrigerant-to-air load heat exchanger identified in these example embodiments as air coil 700, fifth portion 1160 extending from the air coil 700 to the first port 334 of reversing valve 330, and sixth portion 1170 extending from the third port 336 of reversing valve 330 to a suction accumulator 320 (FIG. 15) and to the compressor 300.

Heat pump systems 5, 2050, 3050 also include source loop 1110 to convey a liquid, such as water or brine, for example, to and from a source and to and from source heat exchanger 400 to enable heat exchange between the refrigerant and the liquid from the source.

The source loop 1110 of the illustrated example includes the inlet water leg and the outlet water leg. The inlet water leg is connected to the inlet port 404 of the heat exchanger 400 and the outlet water leg is connected to the outlet port 402 of the heat exchanger 400.

In the illustrated example, the inlet water leg is configured to receive water, or brine, or other liquid from a source. The inlet side of the strainer valve 440 is configured to receive the water, for example, from the source. The outlet side of the strainer valve 440 is connected to the inlet side of the optional motorized valve 430, the outlet side of the motorized valve 430 is connected to the inlet side of the optional pump 470, the outlet side of the pump 470 is connected to the inlet side of the optional flow regulator valve 450, and the outlet side of the flow regulator valve 450 is connected to the inlet port 404 of the heat exchanger 400. In some examples, the motorized valve 430, the pump 470, and/or the flow regulator valve 450 are optional components that may not be included in the source loop 1110. Additionally, the temperature sensor 403 is positioned along the inlet water leg adjacent the inlet port 404 to measure the temperature of water entering the heat exchanger 400.

The outlet water leg of the illustrated example is configured to return the water to the source. The outlet port 402 of the heat exchanger 400 side is connected to the inlet side of the flow switch 420, and the outlet side of the flow switch 420 is fluidly connected to the source. As disclosed below in greater detail, the flow switch 420 is configured to detect when the flow rate of the water leaving the heat exchanger 400 is less than a predefined temperature threshold. In other examples, a flow sensor and/or other flow monitoring device is used to detect when the flow rate is less than the predefined temperature threshold. Additionally, the temperature sensor 405 is positioned along the outlet water leg adjacent the outlet port 402 to measure the temperature of water leaving the heat exchanger 400.

As illustrated in FIG. 51, the temperature sensor 502 is positioned along the third portion 1140 of the refrigerant conduit 600 of refrigerant circuit 650 between the filter drier 510 (if present) and adjacent to the expansion valve 500 to measure a temperature of the refrigerant along the third portion 1140. The temperature sensor 504 is positioned along the fourth portion 1150 of the refrigerant conduit 600 of refrigerant circuit 650 adjacent to the expansion valve 500 to measure a temperature of the refrigerant along the fourth portion 1150. A condensate sensor 715 is positioned on or near drain pan 710 to detect the presence of condensate collected by the drain pan 710 from air coil 700.

The pressure switches 342, 344 are positioned along the sixth portion 1170 of the refrigerant conduit 600 of refrigerant circuit 650 between the reversing valve 330 and the suction accumulator 320 to monitor for a low pressure of the refrigerant during a cooling mode. As disclosed below in greater detail, the pressure switches 342, 344 are configured to detect when the pressure along the sixth portion 1170 is less than respective predefined pressure thresholds. In other examples, pressure sensors and/or other pressure monitoring devices are used to detect when the pressure is less than the predefined pressure thresholds. Additionally, in the illustrated example, a connection point 345 to controller 912 is positioned along the sixth portion 1170 between the reversing valve 330 and the suction accumulator 320 for monitoring a temperature and a pressure of the expansion valve 500.

The pressure switch 360 is positioned along the first portion 1120 of the refrigerant conduit 600 of refrigerant circuit 650 to monitor for a high pressure of the refrigerant during a cooling mode. As disclosed below in greater detail, the pressure switch 360 is configured to detect when the pressure along the first portion 1120 is greater than a predefined pressure threshold. In other examples, a pressure sensor and/or other pressure monitoring device is used to detect when the pressure is greater than the predefined pressure threshold.

The heat pump systems 5, 2050, 3050 of the illustrated example are reversible flow heat pumps and can be configured to operate in a cooling mode and a heating mode by configuring reversing valve 330 to change the direction of flow of the refrigerant (see arrows in FIG. 51) through refrigerant conduit 600. In one operating mode, the heat pump systems 5, 2050, 3050 can be configured to operate in a cooling mode to provide air conditioning and, thus, cool a space. For example, when heat pump systems 5, 2050, 3050 are configured to operate in a cooling mode, the blowers 810, 820 may draw air through and/or across the air coil 700 acting as an evaporator to cool air for the space. In another operating mode, the heat pump systems 5, 2050, 3050 can be configured to operate in a heating mode to heat the space. For example, when heat pump systems 5, 2050, 3050 are configured to operate in a heating mode, the blowers 810, 820 may draw air through and/or across the air coil 700 configured as a condenser to heat air for the space. The controller 912 is configured to control a configuration of the reversing valve 330 to transition between the cooling mode and the heating mode of the heat pump systems 5, 2050, 3050.

To place heat pump systems 5, 2050, 3050 in a cooling mode, the controller 912 sends a signal to the reversing valve 330 that causes the reversing valve 330 to fluidly connect (1) the first port 334 to the third port 336 and (2) the second port 335 to the fourth port 337. In the illustrated example, the refrigerant flows in a counterclockwise direction through the refrigerant conduit 600. Superheated refrigerant gas leaving the compressor is directed to (1) the fourth port 337 of the reversing valve 330, (2) which conveys the refrigerant from the second port 335 of the reversing valve 330 to port 406 and through the heat exchanger 400 acting as a condenser, (3) through the filter drier 510, (4) through the expansion valve 500, (5) through the air coil 700 acting as an evaporator, (6) through the first port 334 of the reversing valve 330, (7) through the third port 336 of the reversing valve 330, (8) through the suction accumulator 320, and (9) back to the compressor 300.

To place heat pump systems 5, 2050, 3050 in a heating mode, the controller 912 sends a signal to the reversing valve 330 that causes the reversing valve 330 to fluidly connect (1) the first port 334 to the fourth port 337 and (2) the second port 335 to the third port 336. In the illustrated example, the refrigerant flows in a clockwise direction through the refrigerant conduit 600. Superheated refrigerant gas leaving the compressor is directed to (1) the fourth port 337 of the reversing valve 330, (2) which conveys the refrigerant from the fourth port 337 of the reversing valve 330 to the first port 334 and through the air coil 700 acting as a condenser, (3) through the expansion valve 500, (4) through the filter drier 510, (5) through the heat exchanger 400 acting as an evaporator, (6) through the second port 335 of the reversing valve 330, (7) through the third port 336 of the reversing valve 330, (8) through the suction accumulator 320, and (9) back to the compressor 300.

As described above for heat pump system 3050, heat pump systems 5, 2050 may be wired or wirelessly (Wi-Fi/cellular/Bluetooth, etc.) connected to other local or remote equipment, including a thermostat, a controller, a display, and/or a user interface operating in a web browser, for example. In this way, a user may locally or remotely monitor a sensor, component, or function of heat pump systems 5, 3050 or locally or remotely interact with and/or control a function of heat pump systems 5, 3050.

FIG. 52 depicts electronic components of the heat pump system 5, the heat pump system 2050, and/or the heat pump system 3050. In the illustrated example, the electronic components include the controller 912, a thermostat 918, one or more input devices, and one or more output devices.

The controller 912 includes a processor 914 and memory 916. The processor 914 may include any suitable processing device or set of processing devices such as, but not limited to, a microprocessor, a microcontroller-based platform, an integrated circuit. The memory 916 may include volatile memory (e.g., RAM, etc.), non-volatile memory (e.g., disk memory, FLASH memory, etc.), unalterable memory (e.g., EPROMs), read-only memory, and/or combinations thereof. The memory 916 is computer readable media on which one or more sets of instructions, such as the software for operating the methods of the present disclosure, can be embedded. For example, the instructions may embody one or more of the methods or logic as described herein.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The input devices include the pressure switch 342, the pressure switch 344, the pressure switch 360, the temperature sensor 403, the temperature sensor 405, flow switch 420, the temperature sensor 502, the temperature sensor 504, and/or any other input device of the heat pump system 5. The output devices include the compressor 300, the reversing valve 330, and the blower motor 830. In the illustrated example, the controller 912 is communicatively coupled (e.g., via wires) to the thermostat 918. The controller 912 also is communicatively coupled (e.g., via wires) to the compressor 300, the reversing valve 330, and the blower motor 830. Further, in other examples, the controller 912 is communicatively coupled (e.g., via wires) to other devices, such as the motorized valve 430, the pump 470, the expansion valve 500, the air coil 700, etc.

Figure 53A:
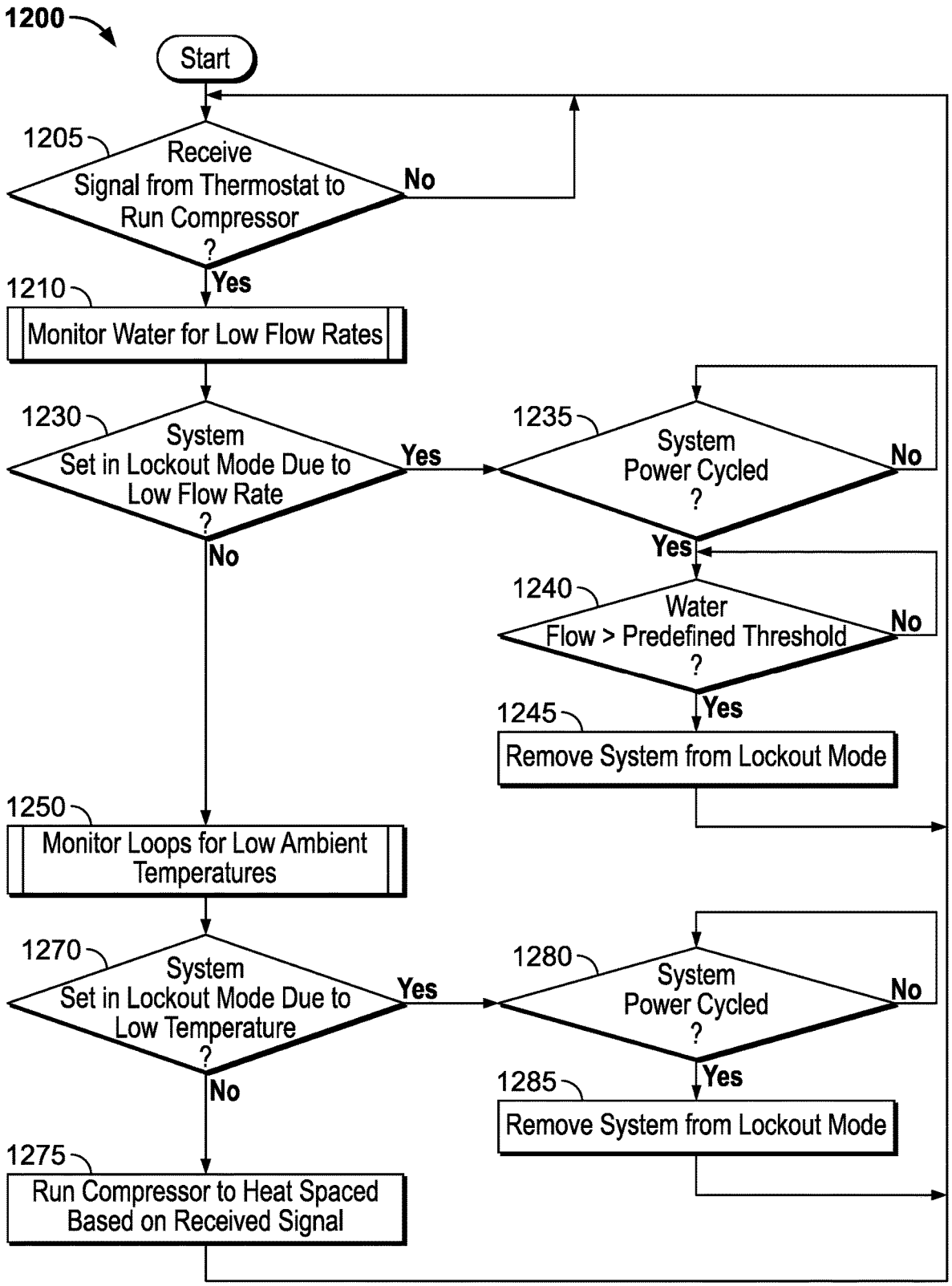
FIGS. 53A-53C depict an example flowchart for providing freeze protection for a heat exchanger associated with a heat pump system of the instant disclosure.
Figure 53B:
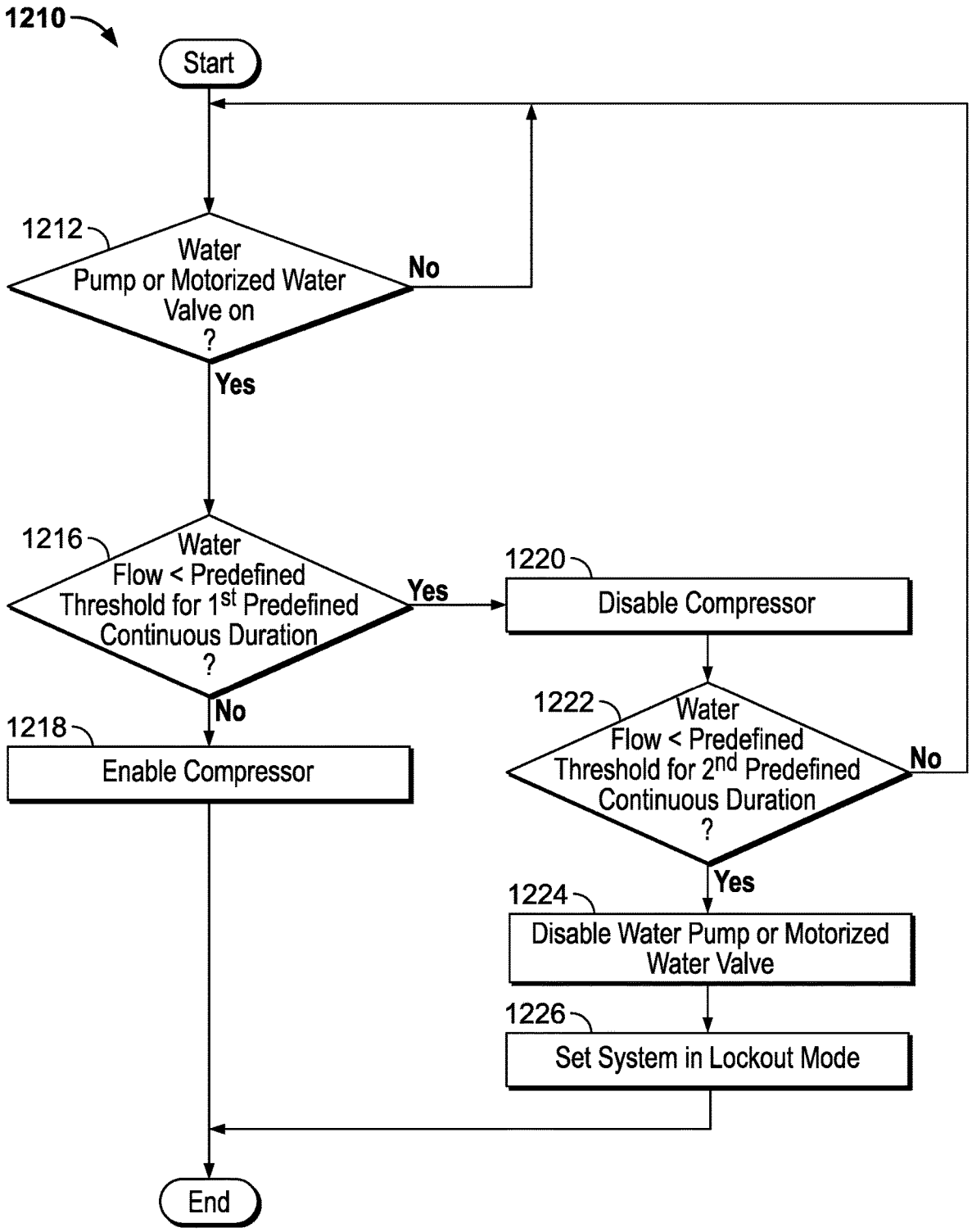
Figure 53C:
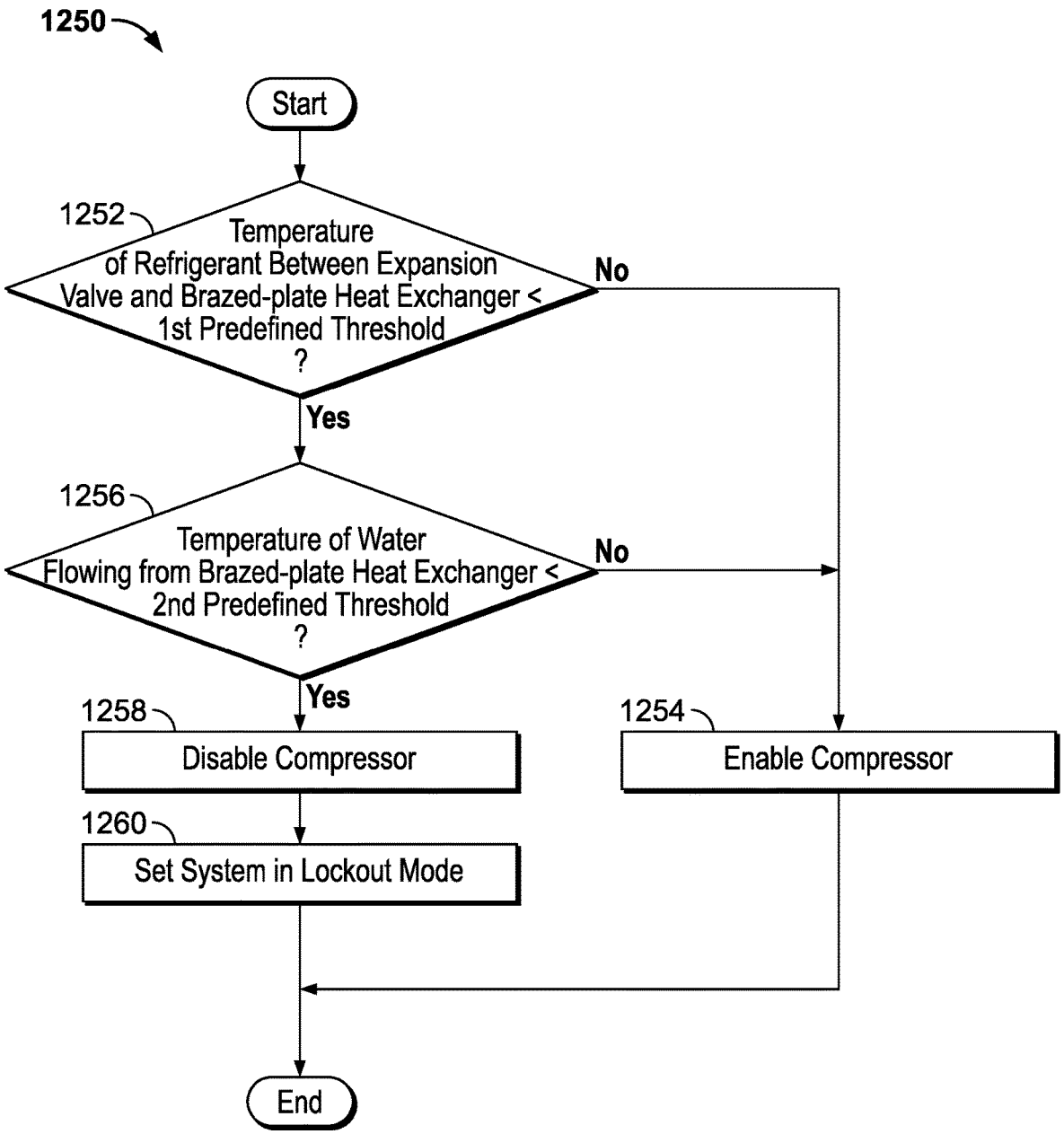

FIGS. 53A-53C depict a flowchart of an example method 1200 for operating a freeze-protection system for the heat exchanger 400 of the heat pump system 5, the heat pump system 2050, and/or the heat pump system 3050. One of ordinary skill would appreciate that the freeze protection system and related methods disclosed herein may be applied to any liquid source heat pump or similar system to minimize risk of damage to components that may arise due to ambient freezing conditions. The freeze-protection system of the instant disclosure is configured to prevent the water, brine, brine mixture, or other source liquid in the heat pump system 5, the heat pump system 2050, and/or the heat pump system 3050 from freezing conditions and, in turn, protect the heat exchanger 400 from being damaged, particularly but not exclusively when the heat exchanger 400 is a brazed-plate heat exchanger that is sized to be installed vertically within the low-height cabinet 10, the cabinet 2100, and/or the cabinet 3100 and/or in systems with small liquid source volume. For example, the freeze-protection system is configured to prevent the water, brine, brine mixture, or other source liquid from freezing that may otherwise occur due to (1) a startup at low ambient temperatures that corresponds with a low evaporating temperature and pressure, (2) no and/or otherwise disrupted flow rate of the water through the source loop 1110, and/or (3) a simultaneous stopping of the compressor 300 and the pump 470 (also referred to as a "water pump") at low suction temperatures. Additionally, the strainer valve 440 (e.g., a 20-mesh y strainer) deters the refrigerant from freezing that may otherwise occur due to fouling.

The flowchart of FIGS. 53A-53C is configured to be executed by the controller 912. For example, the flowchart is representative of machine readable instructions that are stored in memory and include one or more programs which, when executed by the controller 912, cause the heat pump system 5, the heat pump system 2050, and/or the heat pump system 3050 to perform the blocks of FIGS. 53A-53C. While the example program is described with reference to the flowchart illustrated in FIGS. 53A-53C, many other methods of performing a freeze-protection sequence may alternatively be used. For example, the order of execution of the blocks may be rearranged, changed, eliminated, and/or combined to perform the method 1200. Further, because the method 1200 is disclosed in connection with the components of FIGS. 1-28 and 30-52, some functions of those components will not be described in detail below.

Initially, at block 1205 of Fig, 53A, the controller 912 determines whether a signal has been received from a thermostat to turn the compressor 130 on. In response to the controller 912 determining that such a signal has not been received, the method 1200 returns to block 1205. Otherwise, in response to the controller 912 determining that such a signal has been received, the method 1200 proceeds to block 1210 at which the water flowing through the source loop 1110 is monitored for low flow rates.

FIG. 53B depicts a flowchart of an example method 1210 to perform the block 1210 of FIG. 53B for monitoring the flow rate of water flowing through the source loop 1110. Initially, at block 1212, the controller 912 determines whether the pump 470 or the motorized valve 430 is on. In response to the controller 912 determining that the pump 470 or the motorized valve 430 is not on, the method 1210 returns to block 1212. Otherwise, in response to the controller 912 determining that the pump 470 or the motorized valve 430 is on, the method 1210 proceeds to block 1216. At block 1216, the controller 912 determines whether the water flowing of the source loop 1110 is less than a predefined flowrate threshold and has been less than the predefined flowrate threshold continuously for at least a first predefined duration (e.g., 10 seconds). For example, the flow switch 420 is configured to monitor the water flow rate. In some examples, the flow switch 420 has an open contact when the flow rate is less than the predefined flowrate threshold and sends a corresponding signal to the controller 912. In turn, the controller 912 determines that the water flow rate has been less than the predefined flowrate threshold for at least the first predefined duration when it continuously receives a corresponding signal from the flow switch 420 for the first predefined duration.

In response to the controller 912 determining that the water flowrate (1) is not currently less than the predefined flowrate threshold or (2) has not been less than the predefined flowrate threshold continuously for at least the first predefined duration, the method 1210 proceeds to block 1218 at which the controller 912 enables the compressor 300 to be run. Otherwise, in response to the controller 912 determining that the water flowrate is currently less than the predefined flowrate threshold and has been less than the predefined flowrate threshold continuously for at least the first predefined duration, the method 1210 proceeds to block 1220 at which the controller 912 disables the compressor 300.

At block 1222, the controller 912 determines whether the water flowing of the source loop 1110 is less than the predefined flowrate threshold and has been less than the predefined flowrate threshold continuously for at least a second predefined duration (e.g., 50 seconds). The second predefined duration is greater than the first predefined duration. In response to the controller 912 determining that the water flowrate (1) is not currently less than the predefined flowrate threshold or (2) has not been less than the predefined flowrate threshold continuously for at least the second predefined duration, the method 1210 returns to block 1212. Otherwise, in response to the controller 912 determining that the water flowrate is currently less than the predefined flowrate threshold and has been less than the predefined flowrate threshold continuously for at least the second predefined duration, the method 1210 proceeds to block 1224 at which the controller 912 disables the pump 470 or the motorized valve 430. At block 1226, the controller 912 sets the heat pump system 5, the heat pump system 2050, or the heat pump system 3050 into a lockout mode.

Returning to FIG. 53A, the controller 912 determines, at block 1230, whether the heat pump system 5, the heat pump system 2050, or the heat pump system 3050 has been set in the lockout mode due to a low flow rate of the water of the source loop 1110.

In response to the controller 912 determining that the heat pump system 5, the heat pump system 2050, or the heat pump system 3050 is set in the lockout mode, the method 1200 proceeds to block 1235 at which the controller 912 determines whether power for the heat pump system 5, the heat pump system 2050, or the heat pump system 3050 has been cycled since being set to the lockout mode. In response to the controller 912 determining that power for the heat pump system 5, the heat pump system 2050, or the heat pump system 3050 has not been cycled, the method 1200 remains at block 1235. Otherwise, in response to the controller 912 determining that power for the heat pump system 5, the heat pump system 2050, or the heat pump system 3050 has been cycled, the method 1200 proceeds to block 1240.

At block 1240, the controller 912 determines whether the water flowrate of the source loop 1110 has increased to be greater than the predefined flowrate threshold. In response to the controller 912 determining the water flowrate is not greater than the predefined threshold, the method 1200 remains at block 1240. Otherwise, in response to the controller 912 determining the water flowrate is greater than the predefined predefined threshold, the method 1200 returns to block 1205.

Returning back to block 1230, in response to the controller 912 determining that the heat pump system 5, the heat pump system 2050, or the heat pump system 3050 is not set in the lockout mode, the method 1200 proceeds to block 1250 at which the controller 912 monitors the water of the source loop 1110 and the refrigerant of the refrigerant circuit 650 for low temperatures.

FIG. 53C depicts a flowchart of an example method 1250 to perform the block 1250 of FIG. 53A for monitoring the temperature of fluids flowing through the heat pump system 5, the heat pump system 2050, or the heat pump system 3050. Initially, at block 1252, the controller 912 determines whether a temperature of the refrigerant is less than a first predefined temperature threshold. For example, the temperature sensor 502 is configured to measure the temperature of the refrigerant flowing through the refrigerant conduit 600 of refrigerant circuit 650 near the expansion valve 500. The controller 912 receives a signal from the temperature sensor 502 indicative of the measured temperature and compares the measured temperature to the first predefined threshold.

In response to the controller 912 determining that the temperature of the refrigerant is not less than the first predefined temperature threshold, the method 1250 proceeds to block 1254 at which the controller 912 enables the compressor 300 to be run. Otherwise, in response to the controller 912 determining that the temperature of the refrigerant is less than the first predefined temperature threshold, the method 1250 proceeds to block 1256. It should be understood that block 1252 may be performed at the same time as block 1256. Alternatively, block 1256 may be performed before block 1252.

At block 1256, the controller 912 determines whether a temperature of the water flowing through the source loop 1110 is less than a second predefined temperature threshold. For example, the temperature sensor 405 is configured to measure the temperature of the water flowing from the heat exchanger 400 within the source loop 1110. The controller 912 receives a signal from the temperature sensor 405 indicative of the measured temperature and compares the measured temperature to the second predefined threshold.

In response to the controller 912 determining that the temperature of the water is not less than the second predefined temperature threshold, the method 1250 proceeds to block 1254 at which the controller 912 enables the compressor 300 to be run. Otherwise, in response to the controller 912 determining that the temperature of the water is less than the second predefined temperature threshold, the method 1250 proceeds to block 1258 at which the controller 912 disables the compressor 300. At block 1260, the controller 912 sets the heat pump system 5, the heat pump system 2050, or the heat pump system 3050 into the lockout mode.

While blocks 1252, 1256 are shown in a sequential manner in FIG. 53C, the controller 912 is configured to perform blocks 1252, 1256 simultaneously. For example, the controller 912 simultaneously checks whether (1) the temperature of the water flowing through the source loop 1110 is less than the second predefined temperature threshold and (2) the temperature of the refrigerant is less than the first predefined temperature threshold. If the controller 912 determines that both are simultaneously true, the controller 912 disables the compressor 300 at block 1258 and sets the heat pump system 5, the heat pump system 2050, or the heat pump system 3050 in the lockout mode at block 1260. Otherwise, the controller 912 enables the compressor 300 to be run at block 1254.

Returning to FIG. 53A, the controller 912 determines, at block 1270, whether the heat pump system 5, the heat pump system 2050, or the heat pump system 3050 has been set in the lockout mode due to low fluid temperatures.

In response to the controller 912 determining that the heat pump system 5, the heat pump system 2050, or the heat pump system 3050 is set in the lockout mode, the method 1200 proceeds to block 1280 at which the controller 912 determines whether power for the heat pump system 5, the heat pump system 2050, or the heat pump system 3050 has been cycled since being set to the lockout mode. In response to the controller 912 determining that power for the heat pump system 5, the heat pump system 2050, or the heat pump system 3050 has not been cycled, the method 1200 remains at block 1280. Otherwise, in response to the controller 912 determining that power for the heat pump system 5, the heat pump system 2050, or the heat pump system 3050 has been cycled, the method 1200 returns to block 1205.

In response to the controller 912 determining that the heat pump system 5, the heat pump system 2050, or the heat pump system 3050 is set in the lockout mode, the method 1200 proceeds to block 1275 at which the controller 912 causes the compressor 300 to run to heat the space based on the signal received from the thermostat.

While specific embodiments have been described in detail, it will be appreciated by those skilled in the art that various modifications and alternatives to those details could be developed in light of the overall teachings of the disclosure. Accordingly, the disclosure herein is meant to be illustrative only and not limiting as to its scope and should be given the full breadth of the appended claims and any equivalents thereof.

What is claimed is:

1. A heat pump system, comprising:

a cabinet configured to be mounted to a ceiling, the cabinet comprising a frame and a plurality of panels that define a compressor compartment, a blower compartment, and a plenum compartment, wherein the frame includes one or more dividers that separate the blower compartment, the plenum compartment, and the compressor compartment from each other;

a compressor installed in the compressor compartment;

a heat exchanger installed in the compressor compartment;

a blower assembly installed in the blower compartment; and an air coil installed in the blower compartment.

2. The heat pump system of claim 1, wherein the frame includes side rails, end rails, cross rails, side panels, end panels, bottom panels, and a top panel.

3. The heat pump system of claim 1, wherein the frame includes a first divider that separates the blower compartment from the plenum compartment.

4. The heat pump system of claim 3, wherein the frame further includes a second divider that separates the compressor compartment from the blower compartment and the plenum compartment.

5. The heat pump system of claim 1, wherein the frame includes an end panel and a side panel that partially form the plenum compartment, wherein each of the end panel and the side panel includes one or more knockout panels that are removable to enable ductwork to fluidly connect to the plenum compartment.

6. The heat pump system of claim 1, wherein the plurality of panels includes a first bottom panel that partially forms the blower compartment and is detachable from the frame to facilitate a technician in accessing the blower compartment from below the cabinet when the cabinet is mounted to the ceiling.

7. The heat pump system of claim 6, further comprising a drain pan that is installed below the air coil in the blower compartment, wherein the drain pan is configured to be removable from the blower compartment when the cabinet is mounted to the ceiling.

8. The heat pump system of claim 6, wherein the blower assembly includes a blower panel, one or more blowers, and a blower motor, wherein the one or more blowers and the blower motor are mounted to the blower panel.

9. The heat pump system of claim 8, wherein the blower assembly further includes slider brackets to which the blower panel is slidably mounted, wherein the blower panel is configured to be slidably lowered at least partially out of the blower compartment when the first bottom panel is detached from the frame to facilitate the technician in accessing the one or more blowers and the blower motor from below the cabinet when the cabinet is mounted to the ceiling.

10. The heat pump system of claim 9, wherein the blower assembly further includes a latch coupled to the blower panel, wherein the latch is configured to engage the frame to secure the blower assembly in a retracted position in the blower compartment, wherein the latch is configured to disengage from the frame to enable the blower assembly to lower into an extended position.

11. The heat pump system of claim 10, wherein the latch is a spring-loaded latch.

12. The heat pump system of claim 1, wherein the plurality of panels includes an end panel, a plurality of side panels, and a plurality of bottom panels that partially form the compressor compartment, wherein each of the end panel, the plurality of side panels, and the plurality of bottom panels is detachable from the frame to facilitate a technician in accessing the compressor compartment when the cabinet is mounted to the ceiling.

13. The heat pump system of claim 1, wherein the air coil is a refrigerant-to-air heat exchanger.

14. The heat pump system of claim 1, wherein the heat exchanger is a brazed-plate heat exchanger.

15. The heat pump system of claim 1, wherein the compressor is a rotary compressor.

16. The heat pump system of claim 1, wherein the cabinet further includes a control panel, an electronics housing, and a cover panel, wherein the electronics housing and the cover panel partially define an electronics compartment of the cabinet, wherein the control panel is coupled to the cover panel.

17. The heat pump system of claim 16, wherein the cover panel includes a pin and the electronics housing defines a curved slot configured to receive the pin, and wherein the pin is configured to slide in the curved slot to enable the control panel to be rotated from a first position to a second position.

18. The heat pump system of claim 16, further comprising a disconnect switchbox that includes a switch extending outward from a bottom side of the cabinet to enable a technician to engage the switch before accessing an interior of the cabinet.

19. The heat pump system of claim 1, wherein the plurality of panels includes a top panel extending along a top side of the cabinet, wherein the top includes opposing flanges, wherein each of the opposing flanges defines mount holes such that one of the mount holes is located at each corner of the top panel.

20. The heat pump system of claim 19, further comprising a plurality of grommet assemblies configured to provide hanger mounts for the cabinet, wherein each of the plurality of grommet assemblies are configured to extend through a respective one of the mount holes and couple to a corresponding one of the opposing flanges to mount the cabinet to respective hanger rods.

21. The heat pump system of claim 1, wherein the cabinet has a height of about 9 inches.

22. A heat pump system, comprising:

a cabinet configured to be mounted to a ceiling, the cabinet comprising a frame and a plurality of panels that define a compressor compartment, a blower compartment, and a plenum compartment, wherein the frame includes one or more dividers that separate the blower compartment, the plenum compartment, and the compressor compartment from each other;

a rotary compressor positioned in the compressor compartment;

a brazed-plate heat exchanger positioned in the compressor compartment;

a control panel positioned in the cabinet;

a blower assembly positioned in the blower compartment; and an air coil positioned in the blower compartment.

* * * * *